US009961467B2

(12) United States Patent
Kim et al.

(10) Patent No.: US 9,961,467 B2
(45) Date of Patent: *May 1, 2018

(54) CONVERSION FROM CHANNEL-BASED AUDIO TO HOA

(71) Applicant: QUALCOMM Incorporated, San Diego, CA (US)

(72) Inventors: Moo Young Kim, San Diego, CA (US); Dipanjan Sen, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/266,895

(22) Filed: Sep. 15, 2016

(65) Prior Publication Data

US 2017/0105082 A1 Apr. 13, 2017

Related U.S. Application Data

(60) Provisional application No. 62/239,079, filed on Oct. 8, 2015.

(51) Int. Cl.

| | |
|---|---|
| ***H04R 5/02*** | (2006.01) |
| ***H04S 3/02*** | (2006.01) |
| ***G10L 19/008*** | (2013.01) |
| ***H04S 7/00*** | (2006.01) |
| *G10L 19/16* | (2013.01) |

(52) U.S. Cl.

CPC ..... *H04S 3/02* (2013.01); *G10L 19/008* (2013.01); *H04S 7/308* (2013.01); *G10L 19/167* (2013.01); *G10L 19/173* (2013.01); *H04S 2400/01* (2013.01); *H04S 2420/11* (2013.01)

(58) Field of Classification Search

CPC ..... H04R 5/02

See application file for complete search history.

(56) References Cited

U.S. PATENT DOCUMENTS

| | | | |
|---|---|---|---|
| 9,190,065 | B2 | 11/2015 | Sen |
| 9,288,603 | B2 | 3/2016 | Sen et al. |
| 2010/0318368 | A1 | 12/2010 | Thumpudi et al. |

(Continued)

FOREIGN PATENT DOCUMENTS

| | | | |
|---|---|---|---|
| EP | 2094032 | A2 | 8/2009 |
| WO | 2014013070 | A1 | 1/2014 |

OTHER PUBLICATIONS

Hellerud E., et al., "Encoding Higher Order Ambisonics with AAC," Audio Engineering Society, Convention Paper 7366,Presented at the 124th Convention, Amsterdam, Netherlands, May 17-20, 2008, pp. 8 pages.

(Continued)

*Primary Examiner* — Olisa Anwah

(74) *Attorney, Agent, or Firm* — Shumaker & Sieffert, P.A.

(57) ABSTRACT

In one example, a method includes obtaining a representation of a multi-channel audio signal for a source loudspeaker configuration; obtaining a representation of a plurality of spatial positioning vectors (SPVs), in a Higher-Order Ambisonics (HOA) domain, that are based on a source rendering matrix, which is based on the loudspeaker configuration; and generating a HOA soundfield based on the multi-channel audio signal and the plurality of spatial positioning vectors.

21 Claims, 28 Drawing Sheets

(56) References Cited

U.S. PATENT DOCUMENTS

| | | | | |
|---|---|---|---|---|
| 2011/0249821 | A1 | 10/2011 | Jaillet et al. | |
| 2011/0286614 | A1* | 11/2011 | Hess | H04S 7/303 381/302 |
| 2013/0216070 | A1 | 8/2013 | Keiler et al. | |
| 2013/0223658 | A1* | 8/2013 | Betlehem | H04R 5/02 381/307 |
| 2014/0013070 | A1 | 1/2014 | Toronyi et al. | |
| 2014/0016802 | A1 | 1/2014 | Sen et al. | |
| 2014/0086416 | A1 | 3/2014 | Sen | |
| 2014/0226823 | A1* | 8/2014 | Sen | G10L 19/167 381/17 |
| 2014/0355770 | A1 | 12/2014 | Peters et al. | |
| 2014/0358266 | A1 | 12/2014 | Peters et al. | |
| 2014/0358562 | A1 | 12/2014 | Sen et al. | |
| 2015/0030160 | A1* | 1/2015 | Lee | H04S 7/00 381/17 |
| 2015/0154965 | A1* | 6/2015 | Wuebbolt | G10L 19/008 704/500 |
| 2015/0163615 | A1* | 6/2015 | Boehm | H04S 3/008 381/1 |
| 2015/0213809 | A1 | 7/2015 | Peters et al. | |
| 2015/0243292 | A1 | 8/2015 | Morrell et al. | |
| 2015/0264484 | A1 | 9/2015 | Peters et al. | |
| 2015/0264510 | A1* | 9/2015 | Jin | H04S 7/30 381/303 |
| 2015/0332679 | A1 | 11/2015 | Kruger et al. | |
| 2015/0332683 | A1* | 11/2015 | Kim | G10L 19/008 704/500 |
| 2015/0332690 | A1 | 11/2015 | Kim et al. | |
| 2016/0029139 | A1 | 1/2016 | Lee et al. | |
| 2016/0035358 | A1 | 2/2016 | Sen | |
| 2016/0080886 | A1* | 3/2016 | De Bruijn | H04S 7/302 381/17 |
| 2016/0099001 | A1 | 4/2016 | Peters | |
| 2016/0125890 | A1* | 5/2016 | Jax | G10L 19/008 381/22 |
| 2016/0241980 | A1* | 8/2016 | Najaf-Zadeh | H04S 7/303 |
| 2017/0134874 | A1* | 5/2017 | Kordon | G10L 19/008 |
| 2017/0208410 | A1* | 7/2017 | Keiler | H04S 3/008 |
| 2017/0347218 | A1* | 11/2017 | Jeon | H04S 7/303 |
| 2017/0358308 | A1* | 12/2017 | Furse | H04S 7/30 |
| 2017/0366912 | A1* | 12/2017 | Stein | H04S 7/303 |

OTHER PUBLICATIONS

Response to Written Opinion from corresponding PCT Application Serial No. PCT/US2016/052221 filed on Jul. 17, 2017 (17 pages).

International Preliminary Report on Patentability from corresponding PCT Application Serial No. PCT/US2016/052221 dated Aug. 28, 2017 (19 pages).

Boehm, et al., "Detailed Technical Description of 3D Audio Phase 2 Reference Model 0 for HOA technologies", ISO/IEC JTC1/SC29/WG11, No. m35857, Oct. 19, 2014, 130 pp.

"Call for Proposals for 3D Audio," ISO/IEC JTC1/SC29/WG11/N13411, Jan. 2013, 20 pp.

Herre, et al., "MPEG-H 3D Audio—The New Standard for Coding of Immersive Spatial Audio," IEEE Journal of Selected Topics in Signal Processing, vol. 9, No. 5, Aug. 2015, pp. 770-779.

Poletti, "Three-Dimensional Surround Sound Systems Based on Spherical Harmonics," J. Audio Eng. Soc., vol. 53, No. 11, Nov. 2005, pp. 1004-1025.

"Information Technology—High Efficiency Coding and Media Delivery in Heterogeneous Environments—Part 3: Part 3: 3D Audio, Amendment 3: MPEG-H 3D Audio Phase 2," ISO/IEC JTC 1/SC 29N, Jul. 25, 2015, 208 pp.

"Information Technology—High Efficiency Coding and Media Delivery in Heterogeneous Environments—Part 3: 3D Audio," ISO/IEC JTC 1/SC 29 N, ISO/IEC CD 2300-8, Apr. 4, 2014, 337 pp.

Information Technology—High Efficiency Coding and Media Delivery in Heterogeneous Environments—Part 3: 3D Audio, ISO/IEC JTC 1/SC 29, ISO/IEC DIS 23008-3, Jul. 25, 2014, 311 pp.

"Information technology—Dynamic Adaptive Streaming over HTTP (DASH)—Part 1: Media Presentation Description and Segment Formats," ISO/IEC 23009-1, International Standard, Apr. 1, 2012, 132 pp.

Paila, et al., "Flute—File Delivery over Unidirectional Transport," Internet Engineering Task Force, RFC 6726, Nov. 2012, 46 pp.

Sen et al., "RM1-HOA Working Draft Text", MPEG Meeting; Jan. 2014; San Jose; (Motion Picture Expert Group or ISO/IEC JTC1/SC29/WG11), No. m31827, 83 pp.

Hollerweger, et al., "An Introduction to Higher Order Ambisonic," Oct. 2008, 13 pp.

Sen et al., "Technical Description of the Qualcomm's HOA Coding Technology for Phase II," ISO/IEC JTC/SC29/WG11 MPEG 2014/M34104, Jul. 2014, 4 pp.

Schonefeld, "Spherical Harmonics," Jul. 1, 2005, 25 pp., Accessed online [Jul. 9, 2013] at URL:http://videoarch1.s-inf.de/~volker/prosem_paper.pdf.

International Search Report and Written Opinion from International Application No. PCT/US2016/052221, dated Dec. 9, 2016, 15 pp.

Herre et al., "MPEG-H Audio—The New Standard for Universal Spatial/3D Audio Coding", Joint Institution of Universitat Erlangen-Nurnberg and Fraunhofer IIS, vol. 62, Issue. 12, Dec. 2014, pp. 1-12.

Zotter, et al., "All-Round Ambisonic Panning and Decoding", JAES, AES, 60 East 42nd Street, Room 2520, New York 10165-2520, USA, vol. 60, No. 10, Oct. 1, 2012 (Oct. 1, 2012), pp. 807-820.

Boehm, et al., "Decoding for 3-D", AES Convention 130; May 2011, AES, 60 East 42nd Street, Room 2520 New York 10165-2520, USA, May 13, 2011 (May 13, 2011), 16 pp.

U.S. Appl. No. 15/266,874, filed Sep. 15, 2016 and entitled Quantization of Spatial Vectors.

U.S. Appl. No. 15/266,910, filed Sep. 15, 2016 and entitled Conversion From Channel-Based Audio to HOA.

U.S. Appl. No. 15/266,929, filed Sep. 15, 2016 and entitled Mixed Domain Coding of Audio.

Kim et al., "Flexible rendering of channel/object based contents," MM Advanced Tech 13011, MPEG ISO/IEC JTC1/SC29/WG11, 4 pp.

Merchel et al., "Analysis and Implementation of a Stereophonic Play Back System for Adjusting the "Sweet Spot" to the Listener's Position," Audio Engineering Society Convention Paper, May 7-10, 2009, Munich, Germany, 9 pp.

Pulkki, "Virtual Sound Source Positioning Using Vector Base Amplitude Panning," Journal of Audio Engineering Society, vol. 45, No. 6, Jun. 1997, 11 pp.

Office Action from U.S. Appl. No. 15/266,874, dated Jul. 10, 2017, 24 pp.

Response to Office Action dated Jul. 10, 2017, from U.S. Appl. No. 15/266,874, filed Oct. 3, 2017, 16 pp.

Final Office Action from U.S. Appl. No. 15/266,874, dated Jan. 12, 2018, 19 pp.

Office Action from U.S. Appl. No. 15/266,910, dated Oct. 10, 2017, 12 pp.

Response to Office Action dated Oct. 10, 2017, from U.S. Appl. No. 15/266,910, filed Jan. 10, 2018, 19 pp.

* cited by examiner

130

| LoudspeakerGeometry as defined in ISO/IEC 23001-8) | Channel | Azimuth [deg] (131) | Elevation [deg] (132) | Azimuth start angle of sector [deg] (133) | Azimuth end angle of sector [deg] (134) | Elevation start angle of sector [deg] (135) | Elevation end angle of sector [deg] (136) | Ch. is LFE | Position is relative |
|---|---|---|---|---|---|---|---|---|---|
| | CH_EMPTY | n/a | n/a | n/a | n/a | n/a | n/a | 0 | 0 |
| 0 | CH_M_L030 | +30 | 0 | +23 | +37 | -9 | +20 | 0 | 0 |
| 1 | CH_M_R030 | -30 | 0 | -37 | -23 | -9 | +20 | 0 | 0 |
| 2 | CH_M_000 | 0 | 0 | -7 | +7 | -9 | +20 | 0 | 0 |
| 3 | CH_LFE1 | 0 | n/a | n/a | n/a | n/a | n/a | 1 | 0 |
| 4 | CH_M_L110 | +110 | 0 | +101 | +124 | -45 | +20 | 0 | 0 |
| 5 | CH_M_R110 | -110 | 0 | -124 | -101 | -45 | +20 | 0 | 0 |
| 6 | CH_M_L022 | +22 | 0 | +8 | +22 | -9 | +20 | 0 | 0 |
| 7 | CH_M_R022 | -22 | 0 | -22 | -8 | -9 | +20 | 0 | 0 |
| 8 | CH_M_L135 | +135 | 0 | 125 | 142 | -45 | +20 | 0 | 0 |
| 9 | CH_M_R135 | -135 | 0 | -142 | -125 | -45 | +20 | 0 | 0 |
| 10 | CH_M_180 | 180 | 0 | 158 | -158 | -45 | +20 | 0 | 0 |
| 13 | CH_M_L090 | +90 | 0 | +76 | +100 | -45 | +20 | 0 | 0 |
| 14 | CH_M_R090 | -90 | 0 | -100 | -76 | -45 | +20 | 0 | 0 |
| 15 | CH_M_L060 | +60 | 0 | +53 | +75 | -9 | +20 | 0 | 0 |
| 16 | CH_M_R060 | -60 | 0 | -75 | -53 | -9 | +20 | 0 | 0 |
| 17 | CH_U_L030 | +30 | +35 | +11 | +37 | +21 | +60 | 0 | 0 |
| 18 | CH_U_R030 | -30 | +35 | -37 | -11 | +21 | +60 | 0 | 0 |
| 19 | CH_U_000 | 0 | +35 | -10 | +10 | +21 | +60 | 0 | 0 |
| 20 | CH_U_L135 | +135 | +35 | +125 | +157 | +21 | +60 | 0 | 0 |
| 21 | CH_U_R135 | -135 | +35 | -157 | -125 | +21 | +60 | 0 | 0 |
| 22 | CH_U_180 | 180 | +35 | +158 | -158 | +21 | +60 | 0 | 0 |
| 23 | CH_U_L090 | +90 | +35 | +67 | +100 | +21 | +60 | 0 | 0 |
| 24 | CH_U_R090 | -90 | +35 | -100 | -67 | +21 | +60 | 0 | 0 |
| 25 | CH_T_000 | 0 | +90 | -180 | +180 | +61 | +90 | 0 | 0 |
| 26 | CH_LFE2 | +45 | n/a | n/a | n/a | n/a | n/a | 1 | 0 |
| 27 | CH_L_L045 | +45 | -15 | +11 | +75 | -45 | -10 | 0 | 0 |
| 28 | CH_L_R045 | -45 | -15 | -75 | -11 | -45 | -10 | 0 | 0 |
| 29 | CH_L_000 | 0 | -15 | -10 | +10 | -45 | -10 | 0 | 0 |
| 30 | CH_U_L110 | +110 | +35 | +101 | +124 | +21 | +60 | 0 | 0 |
| 31 | CH_U_R110 | -110 | +35 | -124 | -101 | +21 | +60 | 0 | 0 |
| 32 | CH_U_L045 | +45 | +35 | +38 | +66 | +21 | +60 | 0 | 0 |
| 33 | CH_U_R045 | -45 | +35 | -66 | -38 | +21 | +60 | 0 | 0 |
| 34 | CH_M_L045 | +45 | 0 | +38 | +52 | -9 | +20 | 0 | 0 |
| 35 | CH_M_R045 | -45 | 0 | -52 | -38 | -9 | +20 | 0 | 0 |
| 36 | CH_LFE3 | -45 | n/a | n/a | n/a | n/a | n/a | 1 | 0 |
| 37 | CH_M_LSCR | +60 | 0 | n/a | n/a | n/a | n/a | 0 | 1 |
| 38 | CH_M_RSCR | -60 | 0 | n/a | n/a | n/a | n/a | 0 | 1 |
| 39 | CH_M_LSCH | +30 | 0 | n/a | n/a | n/a | n/a | 0 | 1 |
| 40 | CH_M_RSCH | -30 | 0 | n/a | n/a | n/a | n/a | 0 | 1 |
| 41 | CH_M_L150 | +150 | 0 | 143 | 157 | -45 | +20 | 0 | 0 |
| 42 | CH_M_R150 | -150 | 0 | -157 | -143 | -45 | +20 | 0 | 0 |

FIG. 7

140

| Index $q$ | $\theta_q^{(cm)}$ in rad | $\phi_q^{(cm)}$ in rad |
|---|---|---|
| 0 | Invalid direction of the last frame | |
| 1 | 0 | 0 |
| 2 | 1.648625 | 0 |
| 3 | 1.51815 | -2.96216 |
| 4 | 1.571378 | 0.671212 |
| 5 | 1.237221 | 1.016946 |
| 6 | 0.897563 | -1.92145 |
| 7 | 1.567518 | 2.116244 |
| 8 | 1.309935 | -3.02669 |
| 9 | 2.250228 | -2.62446 |
| 10 | 1.675124 | 1.798562 |
| 11 | 2.105204 | -2.99223 |
| 12 | 2.729947 | -1.86764 |
| 13 | 2.68145 | -2.14937 |
| 14 | 0.561639 | 1.353982 |
| 15 | 0.441046 | -0.43087 |
| 16 | 1.795203 | -0.67314 |
| 17 | 1.142487 | -1.79862 |
| 18 | 0.434926 | 2.82874 |
| 19 | 1.787413 | 1.737062 |
| 20 | 2.837147 | -2.98967 |
| 21 | 1.718636 | 3.034998 |
| 22 | 1.524985 | 0.347348 |
| 23 | 1.618312 | -1.14935 |
| 24 | 1.015458 | 3.05368 |
| 25 | 1.410034 | 0.364289 |
| 26 | 0.63386 | -2.62496 |
| 27 | 2.3607 | -0.04809 |
| 28 | 1.850847 | -1.64304 |
| 29 | 0.831862 | -1.66093 |
| 30 | 0.215816 | 0.647003 |
| 31 | 0.323405 | -2.1392 |
| 32 | 1.129028 | 1.484131 |
| 33 | 1.570313 | 1.608203 |
| 34 | 2.045559 | -0.62332 |
| 35 | 1.451641 | 1.921551 |
| 36 | 1.945764 | 0.190834 |
| 37 | 1.73565 | 0.099258 |
| 38 | 0.436971 | -1.99658 |
| 39 | 0.670962 | 1.512933 |
| 40 | 1.324883 | -0.40034 |
| 41 | 1.58031 | 2.594724 |
| 42 | 1.188528 | 2.911703 |
| 43 | 0.9478 | -0.38474 |
| 44 | 2.160853 | -0.10694 |
| 45 | 2.001857 | -3.09111 |
| 46 | 1.967778 | 0.426967 |
| 47 | 2.037793 | 3.050091 |
| 48 | 1.835989 | 2.993912 |
| 49 | 1.182972 | -2.64165 |
| 50 | 0.872258 | 2.502549 |
| 51 | 1.409198 | -1.56769 |
| 52 | 2.228638 | -3.08293 |
| 53 | 1.961864 | 2.170421 |
| 54 | 1.569879 | 1.480563 |
| 55 | 1.156157 | 0.928946 |
| 56 | 0.553321 | 1.586825 |
| 57 | 2.736746 | -2.74048 |
| 58 | 1.420082 | 2.37143 |
| 59 | 2.518823 | -2.9235 |
| 60 | 1.552504 | 1.086965 |
| 61 | 1.481645 | 0.126685 |
| 62 | 1.577656 | 2.720318 |
| 63 | 0.379951 | -0.70778 |
| 64 | 0.996813 | -1.05418 |
| 65 | 0.661003 | -2.27195 |
| 66 | 1.548501 | -0.71772 |
| 67 | 1.909692 | -2.70419 |
| 68 | 1.295493 | -0.75275 |
| 69 | 1.004689 | 1.971741 |
| 70 | 1.854814 | -0.26834 |
| 71 | 2.067658 | -0.19824 |
| 72 | 1.725336 | 2.423184 |
| 73 | 1.517999 | 2.982654 |
| 74 | 2.533863 | 0.925501 |
| 75 | 0.220892 | 1.727021 |
| 76 | 0.676211 | 0.534883 |
| 77 | 1.212656 | -2.29022 |
| 78 | 1.222854 | -2.77413 |
| 79 | 0.13665 | -3.04163 |
| 80 | 2.494965 | -2.33317 |
| 81 | 2.611129 | 0.740177 |
| 82 | 1.014936 | -2.84226 |
| 83 | 1.966651 | -0.88556 |
| 84 | 1.954772 | 2.95192 |
| 85 | 1.480695 | 2.505321 |
| 86 | 1.187389 | 2.668544 |
| 87 | 2.676225 | 1.740344 |
| 88 | 1.640673 | -0.90084 |
| 89 | 0.482541 | 0.059576 |
| 90 | 2.265975 | 2.572881 |
| 91 | 2.241061 | 2.729216 |
| 92 | 2.690038 | 2.060117 |
| 93 | 0.675048 | -1.86952 |
| 94 | 2.445658 | 1.649253 |
| 95 | 0.910335 | 2.176253 |
| 96 | 1.081852 | 1.24646 |
| 97 | 0.332153 | 1.909563 |
| 98 | 1.968 | -1.03418 |
| 99 | 2.003419 | 1.18763 |
| 100 | 2.407503 | -0.42968 |
| 101 | 0.968667 | -0.11519 |
| 102 | 1.945363 | 2.31683 |
| 103 | 0.932698 | -1.27416 |
| 104 | 1.599876 | 3.073713 |
| 105 | 1.612046 | -2.55108 |
| 106 | 2.050616 | 2.403566 |
| 107 | 1.830822 | -1.76855 |
| 108 | 1.680093 | 1.415554 |
| 109 | 1.007833 | 1.137923 |
| 110 | 2.926729 | 2.26373 |
| 111 | 2.737941 | 0.707526 |
| 112 | 0.568385 | -0.4058 |
| 113 | 1.638646 | 2.210016 |
| 114 | 0.266392 | -1.34935 |
| 115 | 0.327662 | 0.477288 |
| 116 | 0.927636 | 2.227249 |
| 117 | 1.14146 | 3.038443 |
| 118 | 2.06762 | -2.85318 |
| 119 | 2.222768 | 1.133575 |
| 120 | 2.403726 | 0.247727 |
| 121 | 0.885579 | 3.100704 |
| 122 | 1.680358 | 1.542949 |
| 123 | 0.54978 | 1.625814 |
| 124 | 2.407241 | -2.99473 |
| 125 | 2.201696 | -2.48101 |
| 126 | 1.393328 | -2.59653 |
| 127 | 1.76511 | -0.34617 |
| 128 | 2.799968 | -0.90523 |
| 129 | 1.429846 | -2.15061 |
| 130 | 0.713687 | 2.967188 |
| 131 | 0.999577 | 2.525136 |
| 132 | 1.185633 | -3.0043 |
| 133 | 1.626546 | -1.60675 |

FIG. 8

CONVERSION FROM CHANNEL-BASED AUDIO TO HOA

This application claims the benefit of U.S. Provisional Patent Application 62/239,079, filed Oct. 8, 2015, the entire content of which is incorporated herein by reference.

TECHNICAL FIELD

This disclosure relates to audio data and, more specifically, coding of higher-order ambisonic audio data.

BACKGROUND

A higher-order ambisonics (HOA) signal (often represented by a plurality of spherical harmonic coefficients (SHC) or other hierarchical elements) is a three-dimensional representation of a soundfield. The HOA or SHC representation may represent the soundfield in a manner that is independent of the local speaker geometry used to playback a multi-channel audio signal rendered from the SHC signal. The SHC signal may also facilitate backwards compatibility as the SHC signal may be rendered to well-known and highly adopted multi-channel formats, such as a 5.1 audio channel format or a 7.1 audio channel format. The SHC representation may therefore enable a better representation of a soundfield that also accommodates backward compatibility.

SUMMARY

In one example, a device includes a memory configured to store a coded audio bitstream; and one or more processors electrically coupled to the memory. In this example, the one or more processors are configured to: obtain, from the coded audio bitstream, a representation of a multi-channel audio signal for a source loudspeaker configuration; obtain, in a Higher-Order Ambisonics (HOA) domain, a representation of a plurality of spatial positioning vectors that are based on a source rendering matrix, which is based on the source loudspeaker configuration; generate a HOA soundfield based on the multi-channel audio signal and the plurality of spatial positioning vectors; and render the HOA soundfield to generate a plurality of audio signals based on a local loudspeaker configuration that represents positions of a plurality of local loudspeakers, wherein each respective audio signal of the plurality of audio signals corresponds to a respective loudspeaker of the plurality of local loudspeakers.

In another example, a device includes one or more processors configured to: receive a multi-channel audio signal for a source loudspeaker configuration; obtain a source rendering matrix that is based on the source loudspeaker configuration; obtain, based on the source rendering matrix, a plurality of spatial positioning vectors, in a Higher-Order Ambisonics (HOA) domain, that, in combination with the multi-channel audio signal, represent an HOA soundfield that corresponds the multi-channel audio signal; and encode, in a coded audio bitstream, a representation of the multi-channel audio signal and an indication of the plurality of spatial positioning vectors. In this example the device also includes a memory, electrically coupled to the one or more processors, configured to store the coded audio bitstream.

In another example, a method includes obtaining, from a coded audio bitstream, a representation of a multi-channel audio signal for a source loudspeaker configuration; obtaining, in a Higher-Order Ambisonics (HOA) domain, a representation of a plurality of spatial positioning vectors that are based on a source rendering matrix, which is based on the source loudspeaker configuration; generating a HOA soundfield based on the multi-channel audio signal and the plurality of spatial positioning vectors; and rendering the HOA soundfield to generate a plurality of audio signals based on a local loudspeaker configuration that represents positions of a plurality of local loudspeakers, wherein each respective audio signal of the plurality of audio signals corresponds to a respective loudspeaker of the plurality of local loudspeakers.

In another example, a method includes receiving a multi-channel audio signal for a source loudspeaker configuration; obtaining a source rendering matrix that is based on the source loudspeaker configuration; obtaining, based on the source rendering matrix, a plurality of spatial positioning vectors, in a Higher-Order Ambisonics (HOA) domain, that, in combination with the multi-channel audio signal, represent an HOA soundfield that corresponds to the multi-channel audio signal; and encoding, in a coded audio bitstream, a representation of the multi-channel audio signal and an indication of the plurality of spatial positioning vectors.

The details of one or more aspects of the disclosure are set forth in the accompanying drawings and the description below. Other features, objects, and advantages of the techniques described in this disclosure will be apparent from the description and drawings, and from the claims.

BRIEF DESCRIPTION OF DRAWINGS

FIG. 7 is a table showing an example set of ideal spherical design positions.

FIG. 8 is a table showing another example set of ideal spherical design positions.

DETAILED DESCRIPTION

Figure 1:
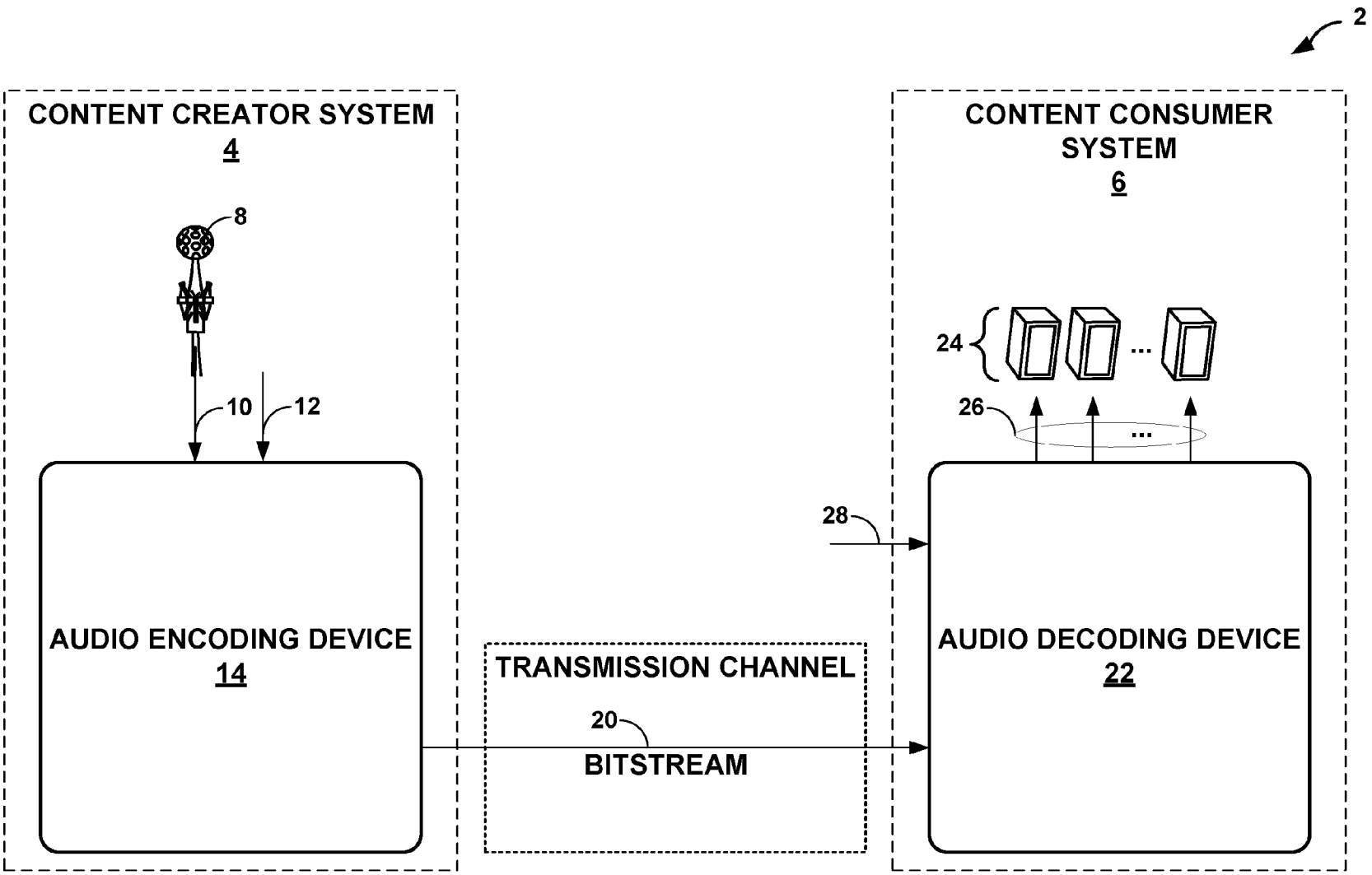
FIG. 1 is a diagram illustrating a system that may perform various aspects of the techniques described in this disclosure.

The evolution of surround sound has made available many output formats for entertainment nowadays. Examples of such consumer surround sound formats are mostly 'channel' based in that they implicitly specify feeds to loudspeakers in certain geometrical coordinates. The consumer surround sound formats include the popular 5.1 format (which includes the following six channels: front left (FL), front right (FR), center or front center, back left or surround left, back right or surround right, and low frequency effects (LFE)), the growing 7.1 format, various formats that includes height speakers such as the 7.1.4 format and the 22.2 format (e.g., for use with the Ultra High Definition Television standard). Non-consumer formats can span any number of speakers (in symmetric and non-symmetric geometries) often termed 'surround arrays'. One example of such an array includes 32 loudspeakers positioned on coordinates on the corners of a truncated icosahedron.

Audio encoders may receive input in one of three possible formats: (i) traditional channel-based audio (as discussed above), which is meant to be played through loudspeakers at pre-specified positions; (ii) object-based audio, which involves discrete pulse-code-modulation (PCM) data for single audio objects with associated metadata containing their location coordinates (amongst other information); and (iii) scene-based audio, which involves representing the soundfield using coefficients of spherical harmonic basis functions (also called "spherical harmonic coefficients" or SHC, "Higher-order Ambisonics" or HOA, and "HOA coefficients").

In some examples, an encoder may encode the received audio data in the format in which it was received. For instance, an encoder that receives traditional 7.1 channel-based audio may encode the channel-based audio into a bitstream, which may be played back by a decoder. However, in some examples, to enable playback at decoders with 5.1 playback capabilities (but not 7.1 playback capabilities), an encoder may also include a 5.1 version of the 7.1 channel-based audio in the bitstream. In some examples, it may not be desirable for an encoder to include multiple versions of audio in a bitstream. As one example, including multiple version of audio in a bitstream may increase the size of the bitstream, and therefore may increase the amount of bandwidth needed to transmit and/or the amount of storage needed to store the bitstream. As another example, content creators (e.g., Hollywood studios) would like to produce the soundtrack for a movie once, and not spend effort to remix it for each speaker configuration. As such, it may be desirable to provide an encoding into a standardized bitstream and a subsequent decoding that is adaptable and agnostic to the speaker geometry (and number) and acoustic conditions at the location of the playback (involving a renderer).

In some examples, to enable an audio decoder to playback the audio with an arbitrary speaker configuration, an audio encoder may convert the input audio in a single format for encoding. For instance, an audio encoder may convert multi-channel audio data and/or audio objects into a hierarchical set of elements, and encode the resulting set of elements in a bitstream. The hierarchical set of elements may refer to a set of elements in which the elements are ordered such that a basic set of lower-ordered elements provides a full representation of the modeled soundfield. As the set is extended to include higher-order elements, the representation becomes more detailed, increasing resolution.

One example of a hierarchical set of elements is a set of spherical harmonic coefficients (SHC), which may also be referred to as higher-order ambisonics (HOA) coefficients. Equation (1), below, demonstrates a description or representation of a soundfield using SHC.

$$p_i(t, r_r, \theta_r, \varphi_r) = \sum_{\omega=0}^{\infty}\left[4\pi\sum_{n=0}^{\infty} j_n(kr_r)\sum_{m=-n}^{n} A_n^m(k)Y_n^m(\theta_r, \varphi_r)\right]e^{j\omega t}, \quad (1)$$

Equation (1) shows that the pressure $p_i$ at any point $\{r_r, \theta_r, \varphi_r\}$ of the soundfield, at time t, can be represented uniquely by the SHC, $A_n^m(k)$. Here, $$k = \frac{\omega}{c},$$

c is the speed of sound (~343 m/s), $\{r_r, \theta_r, \varphi_r\}$ is a point of reference (or observation point), $j_n(\bullet)$ is the spherical Bessel function of order n, and $Y_n^m(\theta_r, \varphi_r)$ are the spherical harmonic basis functions of order n and suborder m. It can be recognized that the term in square brackets is a frequency-domain representation of the signal (i.e., $S(\omega, r_r, \theta_r, \varphi_r)$) which can be approximated by various time-frequency transformations, such as the discrete Fourier transform (DFT), the discrete cosine transform (DCT), or a wavelet transform. Other examples of hierarchical sets include sets of wavelet transform coefficients and other sets of coefficients of multiresolution basis functions. For purposes simplicity, the disclosure below is described with reference to HOA coefficients. However, it should be appreciated that the techniques may be equally applicable to other hierarchical sets.

However, in some examples, it may not be desirable to convert all received audio data into HOA coefficients. For instance, if an audio encoder were to convert all received audio data into HOA coefficients, the resulting bitstream may not be backward compatible with audio decoders that are not capable of processing HOA coefficients (i.e., audio decoders that can only process one or both of multi-channel audio data and audio objects). As such, it may be desirable for an audio encoder to encode received audio data such that the resulting bitstream enables an audio decoder to playback the audio data with an arbitrary speaker configuration while also enabling backward compatibility with content consumer systems that are not capable of processing HOA coefficients.

In accordance with one or more techniques of this disclosure, as opposed to converting received audio data into HOA coefficients and encoding the resulting HOA coefficients in a bitstream, an audio encoder may encode, in a bitstream, the received audio data in its original format along with information that enables conversion of the encoded audio data into HOA coefficients. For instance, an audio encoder may determine one or more spatial positioning vectors (SPVs) that enable conversion of the encoded audio data into HOA coefficients, and encode a representation of the one or more SPVs and a representation of the received audio data in a bitstream. In some examples, the representation of a particular SPV of the one or more SPVs may be an index that corresponds to the particular SPV in a codebook. The spatial positioning vectors may be determined based on a source loudspeaker configuration (i.e., the loudspeaker configuration for which the received audio data is intended for playback). In this way, an audio encoder may output a bitstream that enables an audio decoder to playback the received audio data with an arbitrary speaker configuration while also enabling backward compatibility with audio decoders that are not capable of processing HOA coefficients.

An audio decoder may receive the bitstream that includes the audio data in its original format along with the information that enables conversion of the encoded audio data into HOA coefficients. For instance, an audio decoder may receive multi-channel audio data in the 5.1 format and one or more spatial positioning vectors (SPVs). Using the one or more spatial positioning vectors, the audio decoder may generate an HOA soundfield from the audio data in the 5.1 format. For example, the audio decoder may generate a set of HOA coefficients based on the multi-channel audio signal and the spatial positioning vectors. The audio decoder may render, or enable another device to render, the HOA soundfield based on a local loudspeaker configuration. In this way, an audio decoder that is capable of processing HOA coefficients may play back multi-channel audio data with an arbitrary speaker configuration while also enabling backward compatibility with audio decoders that are not capable of processing HOA coefficients.

As discussed above, an audio encoder may determine and encode one or more spatial positioning vectors (SPVs) that enable conversion of the encoded audio data into HOA coefficients. However, it some examples, it may be desirable for an audio decoder to play back received audio data with an arbitrary speaker configuration when the bitstream does not include an indication of the one or more spatial positioning vectors.

In accordance with one or more techniques of this disclosure, an audio decoder may receive encoded audio data and an indication of a source loudspeaker configuration (i.e., an indication of loudspeaker configuration for which the encoded audio data is intended for playback), and generate spatial positioning vectors (SPVs) that enable conversion of the encoded audio data into HOA coefficients based on the indication of the source loudspeaker configuration. In some examples, such as where the encoded audio data is multi-channel audio data in the 5.1 format, the indication of the source loudspeaker configuration may indicate that the encoded audio data is multi-channel audio data in the 5.1 format.

Using the spatial positioning vectors, the audio decoder may generate an HOA soundfield from the audio data. For example, the audio decoder may generate a set of HOA coefficients based on the multi-channel audio signal and the spatial positioning vectors. The audio decoder may render, or enable another device to render, the HOA soundfield based on a local loudspeaker configuration. In this way, an audio decoder may output a bitstream that enables an audio decoder to may playback the received audio data with an arbitrary speaker configuration while also enabling backward compatibility with audio encoders that may not generate and encode spatial positioning vectors.

As discussed above, an audio coder (i.e., an audio encoder or an audio decoder) may obtain (i.e., generate, determine, retrieve, receive, etc.), spatial positioning vectors that enable conversion of the encoded audio data into an HOA soundfield. In some examples, the spatial positioning vectors may be obtained with the goal of enabling approximately "perfect" reconstruction of the audio data. Spatial positioning vectors may be considered to enable approximately "perfect" reconstruction of audio data where the spatial positioning vectors are used to convert input N-channel audio data into an HOA soundfield which, when converted back into N-channels of audio data, is approximately equivalent to the input N-channel audio data.

To obtain spatial positioning vectors that enable approximately "perfect" reconstruction, an audio coder may determine a number of coefficients $N_{HOA}$ to use for each vector. If an HOA soundfield is expressed in accordance with Equations (2) and (3), and the N-channel audio that results from rendering the HOA soundfield with rendering matrix D is expressed as in accordance with Equations (4) and (5), then approximately "perfect" reconstruction may be possible if the number of coefficients is selected to be greater than or equal to the number of channels in the input N-channel audio data.

$$\lfloor H_1 H_2 \ldots H_{N_{HOA}} \rfloor : M \times N_{HOA} \tag{2}$$

$$[\underbrace{H_1 \ \ldots \ H_i \ \ldots \ H_{N_{HOA}}}_{N_{HOA}}], \tag{3}$$

$$\lfloor C_1 C_2 \ldots C_N \rfloor : M \times N \tag{4}$$

$$\underbrace{[\ldots \ C_i \ \ldots]}_{N} \tag{5}$$

In other words, approximately "perfect" reconstruction may be possible if Equation (6) is satisfied.

$$N \leq N_{HOA} \tag{6}$$

In other words, approximately "perfect" reconstruction may be possible if the number of input channels N is less than or equal to the number of coefficients $N_{HOA}$ used for each spatial positioning vector.

An audio coder may obtain the spatial positioning vectors with the selected number of coefficients. An HOA soundfield H may be expressed in accordance with Equation (7).

$$H = \sum_{i=1}^{N} H_i \tag{7}$$

In Equation (7), $H_i$ for channel i may be the product of audio channel $C_i$ for channel i and the transpose of spatial positioning vector $V_i$ for channel i as shown in Equation (8).

$$H_i = C_i V_i^T = ((M \times 1)(N_{HOA} \times 1)^T). \tag{8}$$

$H_i$ may be rendered to generate channel-based audio signal $\tilde{\Gamma}_i$ as shown in Equation (9).

$$\tilde{\Gamma}_i = H_i D^T = ((M \times N_{HOA})(N \times N_{HOA})^T) = C_i V_i^T D^T \tag{9}$$

Equation (9) may hold true if Equation (10) or Equation (11) is true, with the second solution to Equation (11) being removed due to being singular.

$$V_i^T D^T = \overbrace{\left[0, \ldots, 0, \underbrace{1}_{i^{th}\ element}, 0, \ldots, 0\right]}^{N} \text{ or} \tag{10}$$

$$V_i^T = \begin{cases} [0, \ldots, 0, 1, 0, \ldots, 0](DD^T)^{-1} D \\ \cancel{[0, \ldots, 0, 1, 0, \ldots,] D (D^T D)^{-1}} \end{cases} \tag{11}$$

If Equation (10) or Equation (11) is true, then channel-based audio signal $\tilde{\Gamma}_i$ may be represented in accordance with Equations (12)-(14).

$$\tilde{\Gamma}_i = C_i[0, \ldots, 0, 1, 0, \ldots, 0](DD^T)^{-1} DD^T \tag{12}$$

$$\tilde{\Gamma}_i = C_i[0, \ldots, 0, 1, 0, \ldots, 0] \tag{13}$$

$$\tilde{\Gamma}_i = \underbrace{[0 \ \ldots \ 0 \ C_i \ 0 \ \ldots]}_{N} \tag{14}$$

As such, to enable approximately "perfect" reconstruction, an audio coder may obtain spatial positioning vectors that satisfy Equations (15) and (16).

$$V_i = \left[\overbrace{\left[0, \ldots, 0, \underbrace{1}_{i^{th}\ element}, 0, \ldots, 0\right]}^{N}(DD^T)^{-1} D\right]^T \tag{15}$$

$$N \leq N_{HOA} \tag{16}$$

For completeness, the following is a proof that spatial positioning vectors that satisfy the above equations enable approximately "perfect" reconstruction. For a given N-channel audio expressed in accordance with Equation (17), an audio coder may obtain spatial positioning vectors which may be expressed in accordance with Equations (18) and (19), where D is a source rendering matrix determined based on the source loudspeaker configuration of the N-channel audio data, [0, . . . , 1, . . . , 0] includes N elements and the $i^{th}$ element is one with the other elements being zero.

$$\Gamma = [C_1, C_2, \ldots, C_N] \tag{17}$$

$$\{V_i\}_{i=1, \ldots, N} \tag{18}$$

$$V_i = [[0, \ldots, 1, \ldots, 0](DD^T)^{-1} D]^T \tag{19}$$

The audio coder may generate the HOA soundfield H based on the spatial positioning vectors and the N-channel audio data in accordance with Equation (20).

$$H = \sum_{i=1}^{N} C_i V_i^T \tag{20}$$

The audio coder may convert the HOA soundfield H back into N-channel audio data $\tilde{\Gamma}$ in accordance with Equation (21), where D is a source rendering matrix determined based on the source loudspeaker configuration of the N-channel audio data.

$$\tilde{\Gamma} = HD^T \tag{21}$$

As discussed above, "perfect" reconstruction is achieved if $\tilde{\Gamma}$ is approximately equivalent to Γ. As shown below in Equations (22)-(26), $\tilde{\Gamma}$ is approximately equivalent to Γ, therefore approximately "perfect" reconstruction may be possible:

$$\tilde{\Gamma} = \sum_{i=1}^{N} C_i V_i^T D^T \tag{22}$$

$$\tilde{\Gamma} = \sum_{i=1}^{N} \tilde{\Gamma}_i \tag{23}$$

$$\tilde{\Gamma} = [C_1 0 \ \ldots \ 0] + [0 C_2 0 \ \ldots \ 0] + \ldots \ [00 \ \ldots \ C_N] \tag{24}$$

$$\tilde{\Gamma} = C_1 C_2 \ \ldots \ C_N \tag{25}$$

$$\tilde{\Gamma} = \Gamma \tag{26}$$

Matrices, such as rendering matrices, may be processed in various ways. For example, a matrix may be processed (e.g., stored, added, multiplied, retrieved, etc.) as rows, columns, vectors, or in other ways.

FIG. 1 is a diagram illustrating a system 2 that may perform various aspects of the techniques described in this disclosure. As shown in the example of FIG. 1, system 2 includes content creator system 4 and content consumer system 6. While described in the context of content creator system 4 and content consumer system 6, the techniques may be implemented in any context in which audio data is encoded to form a bitstream representative of the audio data. Moreover, content creator system 4 may include any form of computing device, or computing devices, capable of implementing the techniques described in this disclosure, including a handset (or cellular phone), a tablet computer, a smart phone, or a desktop computer to provide a few examples. Likewise, content consumer system 6 may include any form of computing device, or computing devices, capable of implementing the techniques described in this disclosure, including a handset (or cellular phone), a tablet computer, a smart phone, a set-top box, an AV-receiver, a wireless speaker, or a desktop computer to provide a few examples.

Content creator system 4 may be operated by various content creators, such as movie studios, television studios, internet streaming services, or other entity that may generate audio content for consumption by operators of content consumer systems, such as content consumer system 6. Often, the content creator generates audio content in conjunction with video content. Content consumer system 6 may be operated by an individual. In general, content consumer system 6 may refer to any form of audio playback system capable of outputting multi-channel audio content.

Content creator system 4 includes audio encoding device 14, which may be capable of encoding received audio data into a bitstream. Audio encoding device 14 may receive the audio data from various sources. For instance, audio encoding device 14 may obtain live audio data 10 and/or pre-generated audio data 12. Audio encoding device 14 may receive live audio data 10 and/or pre-generated audio data 12 in various formats. As one example, audio encoding device 14 may receive live audio data 10 from one or more microphones 8 as HOA coefficients, audio objects, or multi-channel audio data. As another example, audio encoding device 14 may receive pre-generated audio data 12 as HOA coefficients, audio objects, or multi-channel audio data.

As stated above, audio encoding device 14 may encode the received audio data into a bitstream, such as bitstream 20, for transmission, as one example, across a transmission channel, which may be a wired or wireless channel, a data storage device, or the like. In some examples, content creator system 4 directly transmits the encoded bitstream 20 to content consumer system 6. In other examples, the encoded bitstream may also be stored onto a storage medium or a file server for later access by content consumer system 6 for decoding and/or playback.

As discussed above, in some examples, the received audio data may include HOA coefficients. However, in some examples, the received audio data may include audio data in formats other than HOA coefficients, such as multi-channel audio data and/or object based audio data. In some examples, audio encoding device 14 may convert the received audio data in a single format for encoding. For instance, as discussed above, audio encoding device 14 may convert multi-channel audio data and/or audio objects into HOA coefficients and encode the resulting HOA coefficients in bitstream 20. In this way, audio encoding device 14 may enable a content consumer system to playback the audio data with an arbitrary speaker configuration.

However, in some examples, it may not be desirable to convert all received audio data into HOA coefficients. For instance, if audio encoding device 14 were to convert all received audio data into HOA coefficients, the resulting bitstream may not be backward compatible with content consumer systems that are not capable of processing HOA coefficients (i.e., content consumer systems that can only process one or both of multi-channel audio data and audio objects). As such, it may be desirable for audio encoding device 14 to encode the received audio data such that the resulting bitstream enables a content consumer system to playback the audio data with an arbitrary speaker configuration while also enabling backward compatibility with content consumer systems that are not capable of processing HOA coefficients.

In accordance with one or more techniques of this disclosure, as opposed to converting received audio data into HOA coefficients and encoding the resulting HOA coefficients in a bitstream, audio encoding device 14 may encode the received audio data in its original format along with information that enables conversion of the encoded audio data into HOA coefficients in bitstream 20. For instance, audio encoding device 14 may determine one or more spatial positioning vectors (SPVs) that enable conversion of the encoded audio data into HOA coefficients, and encode a representation of the one or more SPVs and a representation of the received audio data in bitstream 20. In some examples, audio encoding device 14 may determine one or more spatial positioning vectors that satisfy Equations (15) and (16), above. In this way, audio encoding device 14 may output a bitstream that enables a content consumer system to playback the received audio data with an arbitrary speaker configuration while also enabling backward compatibility with content consumer systems that are not capable of processing HOA coefficients.

Content consumer system 6 may generate loudspeaker feeds 26 based on bitstream 20. As shown in FIG. 1, content consumer system 6 may include audio decoding device 22 and loudspeakers 24. Loudspeakers 24 may also be referred to as local loudspeakers. Audio decoding device 22 may be capable of decoding bitstream 20. As one example, audio decoding device 22 may decode bitstream 20 to reconstruct the audio data and the information that enables conversion of the decoded audio data into HOA coefficients. As another example, audio decoding device 22 may decode bitstream 20 to reconstruct the audio data and may locally determine the information that enables conversion of the decoded audio data into HOA coefficients. For instance, audio decoding device 22 may determine one or more spatial positioning vectors that satisfy Equations (15) and (16), above.

In any case, audio decoding device 22 may use the information to convert the decoded audio data into HOA coefficients. For instance, audio decoding device 22 may use the SPVs to convert the decoded audio data into HOA coefficients, and render the HOA coefficients. In some examples, audio decoding device may render the resulting HOA coefficients to output loudspeaker feeds 26 that may drive one or more of loudspeakers 24. In some examples, audio decoding device may output the resulting HOA coefficients to an external render (not shown) which may render the HOA coefficients to output loudspeaker feeds 26 that may drive one or more of loudspeakers 24. In other words, a HOA soundfield is played back by loudspeakers 24. In various examples, loudspeakers 24 may be a vehicle, home, theater, concert venue, or other locations.

Audio encoding device 14 and audio decoding device 22 each may be implemented as any of a variety of suitable circuitry, such as one or more integrated circuits including microprocessors, digital signal processors (DSPs), application specific integrated circuits (ASICs), field programmable gate arrays (FPGAs), discrete logic, software, hardware, firmware, or any combinations thereof. When the techniques are implemented partially in software, a device may store instructions for the software in a suitable, non-transitory computer-readable medium and execute the instructions in hardware such as integrated circuitry using one or more processors to perform the techniques of this disclosure.

Figure 2:
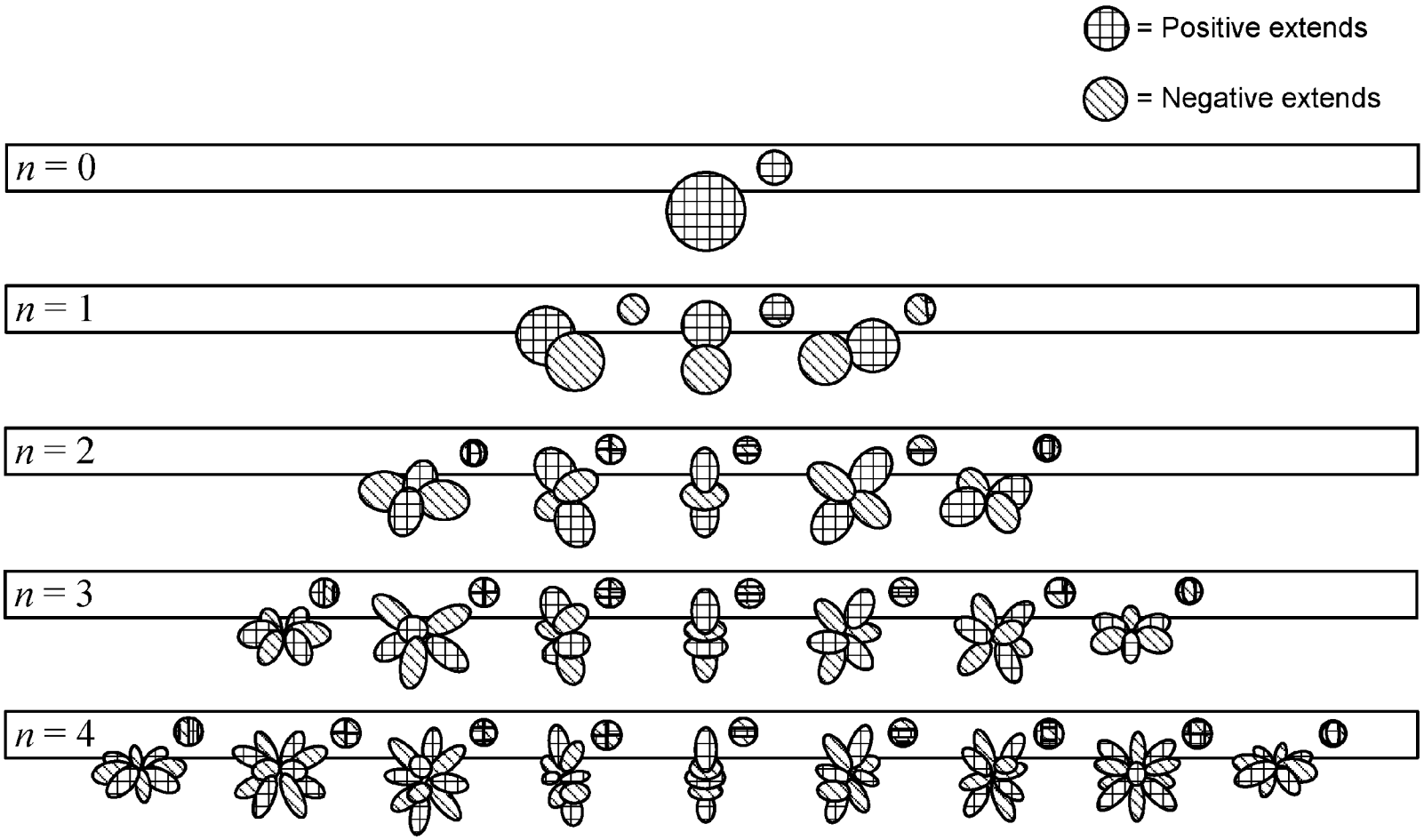
FIG. 2 is a diagram illustrating spherical harmonic basis functions of various orders and sub-orders.

FIG. 2 is a diagram illustrating spherical harmonic basis functions from the zero order (n=0) to the fourth order (n=4). As can be seen, for each order, there is an expansion of suborders m which are shown but not explicitly noted in the example of FIG. 1 for ease of illustration purposes.

The SHC $A_n^m(k)$ can either be physically acquired (e.g., recorded) by various microphone array configurations or, alternatively, they can be derived from channel-based or object-based descriptions of the soundfield. The SHC represent scene-based audio, where the SHC may be input to an audio encoder to obtain encoded SHC that may promote more efficient transmission or storage. For example, a fourth-order representation involving $(1+4)^2$ (25, and hence fourth order) coefficients may be used.

As noted above, the SHC may be derived from a microphone recording using a microphone array. Various examples of how SHC may be derived from microphone arrays are described in Poletti, M., "Three-Dimensional Surround Sound Systems Based on Spherical Harmonics," J. Audio Eng. Soc., Vol. 53, No. 11, 2005 November, pp. 1004-1025.

To illustrate how the SHCs may be derived from an object-based description, consider the following equation. The coefficients $A_n^m(k)$ for the soundfield corresponding to an individual audio object may be expressed as shown in Equation (27), where i is $\sqrt{-1}$, $h_n^{(2)}(\bullet)$ is the spherical Hankel function (of the second kind) of order n, and $\{r_s, \theta_s, \varphi_s\}$ is the location of the object.

$$A_n^m(k)=g(\omega)(-4\pi ik)h_n^{(2)}(kr_s)Y_n^{m*}(\theta_s,\varphi_s) \tag{27}$$

Knowing the object source energy $g(\omega)$ as a function of frequency (e.g., using time-frequency analysis techniques, such as performing a fast Fourier transform on the PCM stream) allows us to convert each PCM object and the corresponding location into the SHC $A_n^m(k)$. Further, it can be shown (since the above is a linear and orthogonal decomposition) that the $A_n^m(k)$ coefficients for each object are additive. In this manner, a multitude of PCM objects can be represented by the $A_n^m(k)$ coefficients (e.g., as a sum of the coefficient vectors for the individual objects). Essentially, the coefficients contain information about the soundfield (the pressure as a function of 3D coordinates), and the above represents the transformation from individual objects to a representation of the overall soundfield, in the vicinity of the observation point $\{r_r, \theta_r, \varphi_r\}$.

Figure 3:
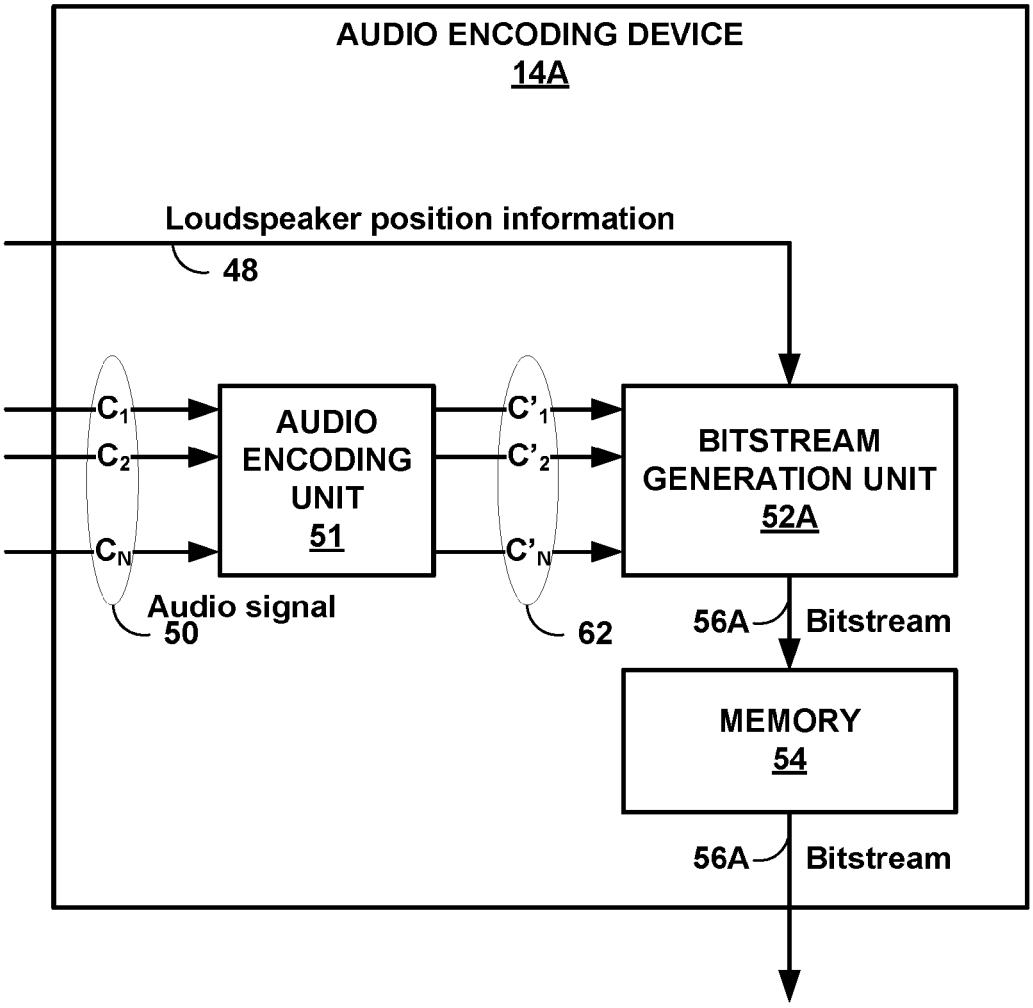
FIG. 3 is a block diagram illustrating an example implementation of an audio encoding device, in accordance with one or more techniques of this disclosure.

FIG. 3 is a block diagram illustrating an example implementation of audio encoding device 14, in accordance with one or more techniques of this disclosure. The example implementation of audio encoding device 14 shown in FIG. 3 is labeled audio encoding device 14A. Audio encoding device 14A includes audio encoding unit 51, bitstream generation unit 52A, and memory 54. In other examples, audio encoding device 14A may include more, fewer, or different units. For instance, audio encoding device 14A may not include audio encoding unit 51 or audio encoding unit 51 may be implemented in a separate device may be connected to audio encoding device 14A via one or more wired or wireless connections.

Audio signal 50 may represent an input audio signal received by audio encoding device 14A. In some examples, audio signal 50 may be a multi-channel audio signal for a source loudspeaker configuration. For instance, as shown in FIG. 3, audio signal 50 may include N channels of audio data denoted as channel $C_1$ through channel $C_N$. As one example, audio signal 50 may be a six-channel audio signal for a source loudspeaker configuration of 5.1 (i.e., a front-left channel, a center channel, a front-right channel, a surround back left channel, a surround back right channel, and a low-frequency effects (LFE) channel). As another example, audio signal 50 may be an eight-channel audio signal for a source loudspeaker configuration of 7.1 (i.e., a front-left channel, a center channel, a front-right channel, a surround back left channel, a surround left channel, a surround back right channel, a surround right channel, and a low-frequency effects (LFE) channel). Other examples are possible, such as a twenty-four-channel audio signal (e.g., 22.2), a nine-channel audio signal (e.g., 8.1), and any other combination of channels.

In some examples, audio encoding device 14A may include audio encoding unit 51, which may be configured to encode audio signal 50 into coded audio signal 62. For instance, audio encoding unit 51 may quantize, format, or otherwise compress audio signal 50 to generate audio signal 62. As shown in the example of FIG. 3, audio encoding unit 51 may encode channels $C_1$-$C_N$ of audio signal 50 into channels $C'_1$-$C'_N$ of coded audio signal 62. In some examples, audio encoding unit 51 may be referred to as an audio CODEC.

Source loudspeaker setup information 48 may specify the number of loudspeakers (e.g., N) in a source loudspeaker setup and positions of the loudspeakers in the source loudspeaker setup. In some examples, source loudspeaker setup information 48 may indicate the positions of the source loudspeakers in the form of an azimuth and an elevation (e.g., $\{\theta_i,\varphi_i\}_{i=1,\ldots,N}$). In some examples, source loudspeaker setup information 48 may indicate the positions of the source loudspeakers in the form of a pre-defined set-up (e.g., 5.1, 7.1, 22.2). In some examples, audio encoding device 14A may determine a source rendering format D based on source loudspeaker setup information 48. In some examples, source rendering format D may be represented as a matrix.

Bitstream generation unit 52A may be configured to generate a bitstream based on one or more inputs. In the example of FIG. 3, bitstream generation unit 52A may be configured to encode loudspeaker position information 48 and audio signal 50 into bitstream 56A. In some examples, bitstream generation unit 52A may encode audio signal without compression. For instance, bitstream generation unit 52A may encode audio signal 50 into bitstream 56A. In some examples, bitstream generation unit 52A may encode audio signal with compression. For instance, bitstream generation unit 52A may encode coded audio signal 62 into bitstream 56A.

In some examples, to loudspeaker position information 48 into bitstream 56A, bitstream generation unit 52A may encode (e.g., signal) the number of loudspeakers (e.g., N) in the source loudspeaker setup and the positions of the loudspeakers of the source loudspeaker setup in the form of an azimuth and an elevation (e.g., $\{\theta_i,\phi_i\}_{i=1,\ldots,N}$). Furthers in some examples, bitstream generation unit 52A may determine and encode an indication of how many HOA coefficients are to be used (e.g., $N_{HOA}$) when converting audio signal 50 into an HOA soundfield. In some examples, audio signal 50 may be divided into frames. In some examples, bitstream generation unit 52A may signal the number of loudspeakers in the source loudspeaker setup and the positions of the loudspeakers of the source loudspeaker setup for each frame. In some examples, such as where the source loudspeaker setup for current frame is the same as a source loudspeaker setup for a previous frame, bitstream generation unit 52A may omit signaling the number of loudspeakers in the source loudspeaker setup and the positions of the loudspeakers of the source loudspeaker setup for the current frame.

In operation, audio encoding device 14A may receive audio signal 50 as a six-channel multi-channel audio signal and receive loudspeaker position information 48 as an indication of the positions of the source loudspeakers in the form of the 5.1 pre-defined set-up. As discussed above, bitstream generation unit 52A may encode loudspeaker position information 48 and audio signal 50 into bitstream 56A. For instance, bitstream generation unit 52A may encode a representation of the six-channel multi-channel (audio signal 50) and the indication that the encoded audio signal is a 5.1 audio signal (the source loudspeaker position information 48) into bitstream 56A.

As discussed above, in some examples, audio encoding device 14A may directly transmit the encoded audio data (i.e., bitstream 56A) to an audio decoding device. In other examples, audio encoding device 14A may store the encoded audio data (i.e., bitstream 56A) onto a storage medium or a file server for later access by an audio decoding device for decoding and/or playback. In the example of FIG. 3, memory 54 may store at least a portion of bitstream 56A prior to output by audio encoding device 14A. In other words, memory 54 may store all of bitstream 56A or a part of bitstream 56A.

Thus, audio encoding device 14A may include one or more processors configured to: receive a multi-channel audio signal for a source loudspeaker configuration (e.g., multi-channel audio signal 50 for loudspeaker position information 48); obtain, based on the source loudspeaker configuration, a plurality of spatial positioning vectors in the Higher-Order Ambisonics (HOA) domain that, in combination with the multi-channel audio signal, represent a set of higher-order ambisonic (HOA) coefficients that represent the multi-channel audio signal; and encode, in a coded audio bitstream (e.g., bitstream 56A), a representation of the multi-channel audio signal (e.g., coded audio signal 62) and an indication of the plurality of spatial positioning vectors (e.g., loudspeaker position information 48). Further, audio encoding device 14A may include a memory (e.g., memory 54), electrically coupled to the one or more processors, configured to store the coded audio bitstream.

Figure 4:
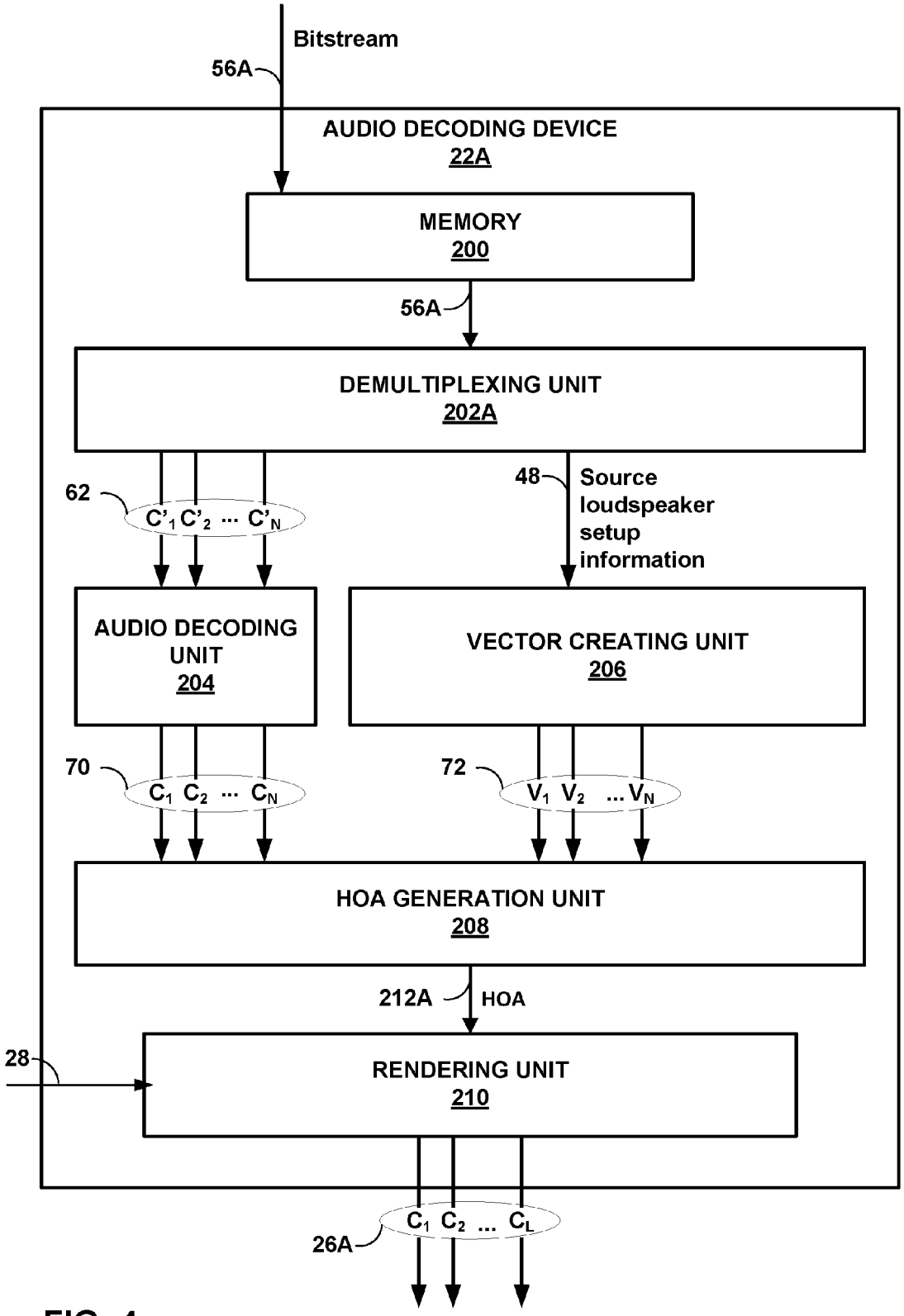
FIG. 4 is a block diagram illustrating an example implementation of an audio decoding device for use with the example implementation of audio encoding device shown in FIG. 3, in accordance with one or more techniques of this disclosure.

FIG. 4 is a block diagram illustrating an example implementation of audio decoding device 22 for use with the example implementation of audio encoding device 14A shown in FIG. 3, in accordance with one or more techniques of this disclosure. The example implementation of audio decoding device 22 shown in FIG. 4 is labeled 22A. The implementation of audio decoding device 22 in FIG. 4 includes memory 200, demultiplexing unit 202A, audio decoding unit 204, vector creating unit 206, an HOA generation unit 208A, and a rendering unit 210. In other examples, audio decoding device 22A may include more, fewer, or different units. For instance, rendering unit 210 may be implemented in a separate device, such as a loudspeaker, headphone unit, or audio base or satellite device, and may be connected to audio decoding device 22A via one or more wired or wireless connections.

Memory 200 may obtain encoded audio data, such as bitstream 56A. In some examples, memory 200 may directly receive the encoded audio data (i.e., bitstream 56A) from an audio encoding device. In other examples, the encoded audio data may be stored and memory 200 may obtain the encoded audio data (i.e., bitstream 56A) from a storage medium or a file server. Memory 200 may provide access to bitstream 56A to one or more components of audio decoding device 22A, such as demultiplexing unit 202.

Demultiplexing unit 202A may demultiplex bitstream 56A to obtain coded audio data 62 and source loudspeaker setup information 48. Demultiplexing unit 202A may provide the obtained data to one or more components of audio decoding device 22A. For instance, demultiplexing unit 202A may provide coded audio data 62 to audio decoding unit 204 and provide source loudspeaker setup information 48 to vector creating unit 206.

Audio decoding unit 204 may be configured to decode coded audio signal 62 into audio signal 70. For instance, audio decoding unit 204 may dequantize, deformat, or otherwise decompress audio signal 62 to generate audio signal 70. As shown in the example of FIG. 4, audio decoding unit 204 may decode channels $C'_1$-$C'_N$ of audio signal 62 into channels $C'_1$-$C'_N$ of decoded audio signal 70. In some examples, such as where audio signal 62 is coded using a lossless coding technique, audio signal 70 may be approximately equal or approximately equivalent to audio signal 50 of FIG. 3. In some examples, audio decoding unit 204 may be referred to as an audio CODEC. Audio decoding unit 204 may provide decoded audio signal 70 to one or more components of audio decoding device 22A, such as HOA generation unit 208A.

Vector creating unit 206 may be configured to generate one or more spatial positioning vectors. For instance, as shown in the example of FIG. 4, vector creating unit 206 may generate spatial positioning vectors 72 based on source loudspeaker setup information 48. In some examples, spatial positioning vector 72 may be in the Higher-Order Ambisonics (HOA) domain. In some examples, to generate spatial positioning vector 72, vector creating unit 206 may determine a source rendering format D based on source loudspeaker setup information 48. Using the determined source rendering format D, vector creating unit 206 may determine spatial positioning vectors 72 to satisfy Equations (15) and (16), above. Vector creating unit 206 may provide spatial positioning vectors 72 to one or more components of audio decoding device 22A, such as HOA generation unit 208A.

HOA generation unit 208A may be configured to generate an HOA soundfield based on multi-channel audio data and spatial positioning vectors. For instance, as shown in the example of FIG. 4, HOA generation unit 208A may generate set of HOA coefficients 212A based on decoded audio signal 70 and spatial positioning vectors 72. In some examples, HOA generation unit 208A may generate set of HOA coefficients 212A in accordance with Equation (28), below, where H represents HOA coefficients 212A, $C_i$ represents decoded audio signal 70, and $V_i^T$ represents the transpose of spatial positioning vectors 72.

$$H = \sum_{i=1}^{N} C_i V_i^T \tag{28}$$

HOA generation unit 208A may provide the generated HOA soundfield to one or more other components. For instance, as shown in the example of FIG. 4, HOA generation unit 208A may provide HOA coefficients 212A to rendering unit 210.

Rendering unit 210 may be configured to render an HOA soundfield to generate a plurality of audio signals. In some examples, rendering unit 210 may render HOA coefficients 212A of the HOA soundfield to generate audio signals 26A for playback at a plurality of local loudspeakers, such as loudspeakers 24 of FIG. 1. Where the plurality of local loudspeakers includes L loudspeakers, audio signals 26A may include channels $C_1$ through $C_L$ that are respectively indented for playback through loudspeakers 1 through L.

Rendering unit 210 may generate audio signals 26A based on local loudspeaker setup information 28, which may represent positions of the plurality of local loudspeakers. In some examples, local loudspeaker setup information 28 may be in the form of a local rendering format $\tilde{D}$. In some examples, local rendering format $\tilde{D}$ may be a local rendering matrix. In some examples, such as where local loudspeaker setup information 28 is in the form of an azimuth and an elevation of each of the local loudspeakers, rendering unit 210 may determine local rendering format $\tilde{D}$ based on local loudspeaker setup information 28. In some examples, rendering unit 210 may generate audio signals 26A based on local loudspeaker setup information 28 in accordance with Equation (29), where $\tilde{C}$ represents audio signals 26A, H represents HOA coefficients 212A, and $\tilde{D}^T$ represents the transpose of the local rendering format $\tilde{D}$.

$$\tilde{C}=H\tilde{D}^T \tag{29}$$

In some examples, the local rendering format $\tilde{D}$ may be different than the source rendering format D used to determine spatial positioning vectors 72. As one example, positions of the plurality of local loudspeakers may be different than positions of the plurality of source loudspeakers. As another example, a number of loudspeakers in the plurality of local loudspeakers may be different than a number of loudspeakers in the plurality of source loudspeakers. As another example, both the positions of the plurality of local loudspeakers may be different than positions of the plurality of source loudspeakers and the number of loudspeakers in the plurality of local loudspeakers may be different than the number of loudspeakers in the plurality of source loudspeakers.

Thus, audio decoding device 22A may include a memory (e.g., memory 200) configured to store a coded audio bitstream. Audio decoding device 22A may further include one or more processors electrically coupled to the memory and configured to: obtain, from the coded audio bitstream, a representation of a multi-channel audio signal for a source loudspeaker configuration (e.g., coded audio signal 62 for loudspeaker position information 48); obtain a representation of a plurality of spatial positioning vectors (SPVs) in the Higher-Order Ambisonics (HOA) domain that are based on the source loudspeaker configuration (e.g., spatial positioning vectors 72); and generate a HOA soundfield (e.g., HOA coefficients 212A) based on the multi-channel audio signal and the plurality of spatial positioning vectors.

Figure 5:
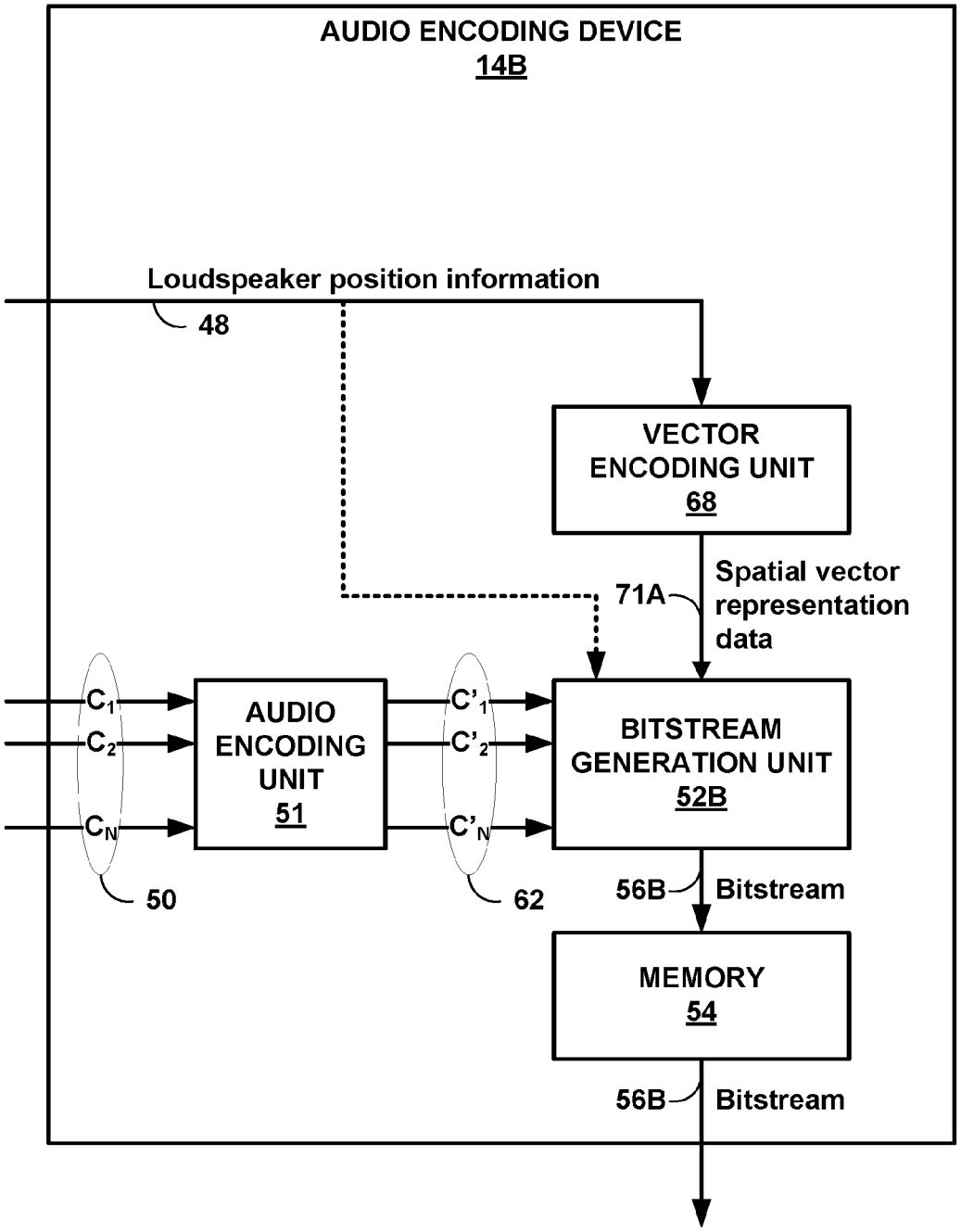
FIG. 5 is a block diagram illustrating an example implementation of an audio encoding device, in accordance with one or more techniques of this disclosure.

FIG. 5 is a block diagram illustrating an example implementation of audio encoding device 14, in accordance with one or more techniques of this disclosure. The example implementation of audio encoding device 14 shown in FIG. 5 is labeled audio encoding device 14B. Audio encoding device 14B includes audio encoding unit 51, bitstream generation unit 52A, and memory 54. In other examples, audio encoding device 14B may include more, fewer, or different units. For instance, audio encoding device 14B may not include audio encoding unit 51 or audio encoding unit 51 may be implemented in a separate device may be connected to audio encoding device 14B via one or more wired or wireless connections.

In contrast to audio encoding device 14A of FIG. 3 which may encode coded audio signal 62 and loudspeaker position information 48 without encoding an indication of the spatial positioning vectors, audio encoding device 14B includes vector encoding unit 68 which may determine spatial positioning vectors. In some examples, vector encoding unit 68 may determine the spatial positioning vectors based on loudspeaker position information 48 and output spatial vector representation data 71A for encoding into bitstream 56B by bitstream generation unit 52B.

In some examples, vector encoding unit 68 may generate vector representation data 71A as indices in a codebook. As one example, vector encoding unit 68 may generate vector representation data 71A as indices in a codebook that is dynamically created (e.g., based on loudspeaker position information 48). Additional details of one example of vector encoding unit 68 that generates vector representation data 71A as indices in a dynamically created codebook are discussed below with reference to FIGS. 6-8. As another example, vector encoding unit 68 may generate vector representation data 71A as indices in a codebook that includes spatial positioning vectors for pre-determined source loudspeaker setups. Additional details of one example of vector encoding unit 68 that generates vector representation data 71A as indices in a codebook that includes spatial positioning vectors for pre-determined source loudspeaker setups are discussed below with reference to FIG. 9.

Bitstream generation unit 52B may include data representing coded audio signal 60 and spatial vector representation data 71A in a bitstream 56B. In some examples, bitstream generation unit 52B may also include data representing loudspeaker position information 48 in bitstream 56B. In the example of FIG. 5, memory 54 may store at least a portion of bitstream 56B prior to output by audio encoding device 14B.

Thus, audio encoding device 14B may include one or more processors configured to: receive a multi-channel audio signal for a source loudspeaker configuration (e.g., multi-channel audio signal 50 for loudspeaker position information 48); obtain, based on the source loudspeaker configuration, a plurality of spatial positioning vectors in the Higher-Order Ambisonics (HOA) domain that, in combination with the multi-channel audio signal, represent a set of HOA coefficients that represent the multi-channel audio signal; and encode, in a coded audio bitstream (e.g., bitstream 56B), a representation of the multi-channel audio signal (e.g., coded audio signal 62) and an indication of the plurality of spatial positioning vectors (e.g., spatial vector representation data 71A). Further, audio encoding device 14B may include a memory (e.g., memory 54), electrically coupled to the one or more processors, configured to store the coded audio bitstream.

Figure 6:
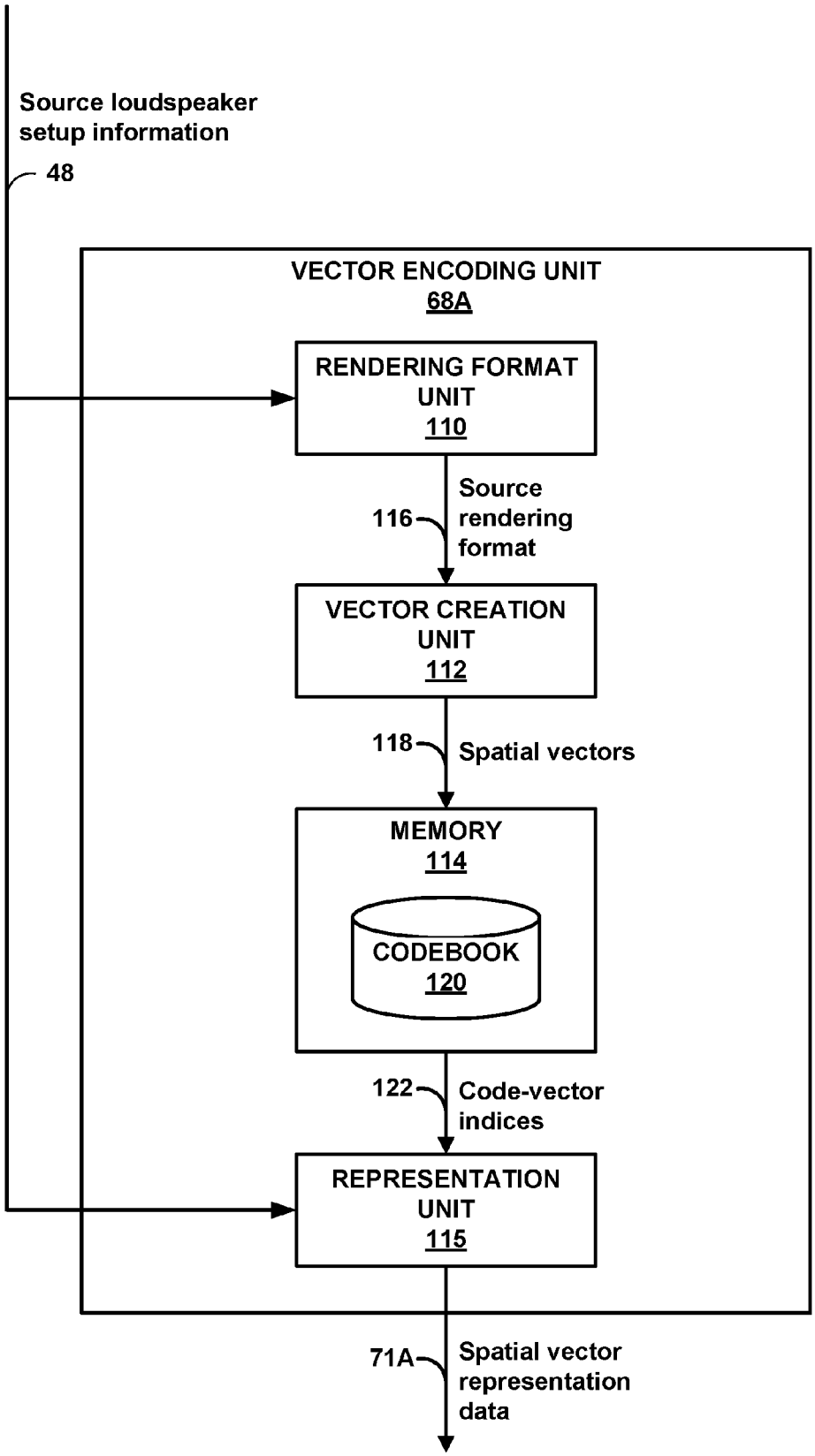
FIG. 6 is a diagram illustrating example implementation of a vector encoding unit, in accordance with one or more techniques of this disclosure.

FIG. 6 is a diagram illustrating example implementation of vector encoding unit 68, in accordance with one or more techniques of this disclosure. In the example of FIG. 6, the example implementation of vector encoding unit 68 is labeled vector encoding unit 68A. In the example of FIG. 6, vector encoding unit 68A comprises a rendering format unit 110, a vector creation unit 112, a memory 114, and a representation unit 115. Furthermore, as shown in the example of FIG. 6, rendering format unit 110 receives source loudspeaker setup information 48.

Rendering format unit 110 uses source loudspeaker setup information 48 to determine a source rendering format 116. Source rendering format 116 may be a rendering matrix for rendering a set of HOA coefficients into a set of loudspeaker feeds for loudspeakers arranged in a manner described by source loudspeaker setup information 48. Rendering format unit 110 may determine source rendering format 116 in various ways. For example, rendering format unit 110 may use the technique described in ISO/IEC 23008-3, "Information technology—High efficiency coding and media delivery in heterogeneous environments—Part 3: 3D audio," First Edition, 2015 (available at iso.org).

In an example where rendering format unit 110 uses the technique described in ISO/IEC 23008-3, source loudspeaker setup information 48 includes information specifying directions of loudspeakers in the source loudspeaker setup. For ease of explanation, this disclosure may refer to the loudspeakers in the source loudspeaker setup as the "source loudspeakers." Thus, source loudspeaker setup information 48 may include data specifying L loudspeaker directions, where L is the number of source loudspeakers. The data specifying the L loudspeaker directions may be denoted $\mathfrak{D}_L$. The data specifying the directions of the source loudspeakers may be expressed as pairs of spherical coordinates. Hence, $\mathfrak{D}_L=[\hat{\Omega}_1, \ldots, \hat{\Omega}_L]$ with spherical angle $\hat{\Omega}_1=[\hat{\theta}_1, \hat{\Phi}_1]^T$. $\hat{\theta}_1$ indicates the angle of inclination and $\hat{\Phi}_1$ indicates the angle of azimuth, which may be expressed in rad. In this example, rendering format unit 110 may assume the source loudspeakers have a spherical arrangement, centered at the acoustic sweet spot.

In this example, rendering format unit 110 may determine a mode matrix, denoted $\tilde{\Psi}$, based on an HOA order and a set of ideal spherical design positions. FIG. 7 shows an example set of ideal spherical design positions. FIG. 8 is a table showing another example set of ideal spherical design positions. The ideal spherical design positions may be denoted $\mathfrak{D}_s=[\Omega_1, \ldots, \Omega_s]$, where S is the number of ideal spherical design positions and $\Omega_s=[\theta_s, \phi_s]$. The mode matrix may be defined such that $\tilde{\Psi}=[y_1, \ldots, y_S,]$, with $y_s=[s_0^0(\Omega_s), s_1^{-1}(\Omega_s), \ldots, s_N^N(\Omega_s)]^H$, where $y_s$ holds the real valued spherical harmonic coefficients $s_N^N(\Omega_s)$. In general, a real valued spherical harmonic coefficients $s_N^N(\Omega_s)$ may be represented in accordance with Equations (30) and (31).

$$S_n^m(\theta, \phi) = \sqrt{(2n+1)\frac{(n-|m|)!}{(n-|m|)!}}\, P_{n,|m|}(\cos\theta) trg_m(\phi) \tag{30}$$

with $$trg_m(\phi) = \begin{cases} \sqrt{2}\cos(m\phi) & m > 0 \\ 1 & m = 0 \\ \sqrt{2}\sin(m\phi) & m < 0 \end{cases} \tag{31}$$

In Equations (30) and (31), the Legendre functions $P_{n,m}(x)$ may be defined in accordance with Equation (32), below, with the Legendre Polynomial $P_n(x)$ and without the Condon-Shortley phase term $(-1)^m$.

$$P_{n,m}(x) = (1-x^2)^{m/2}\frac{d^m}{dx^m}P_n(x),\ m \geq 0 \tag{32}$$

FIG. 7 presents an example table 130 having entries that correspond to ideal spherical design positions. In the example of FIG. 7, each row of table 130 is an entry corresponding to a predefined loudspeaker position. Column 131 of table 130 specifies ideal azimuths for loudspeakers in degrees. Column 132 of table 130 specifies ideal elevations for loudspeakers in degrees. Columns 133 and 134 of table 130 specify acceptable ranges of azimuth angles for loudspeakers in degrees. Columns 135 and 136 of table 130 specify acceptable ranges of elevation angles of loudspeakers in degrees.

FIG. 8 presents a portion of another example table 140 having entries that that correspond to ideal spherical design positions. Although not shown in FIG. 8, table 140 includes 900 entries, each specifying a different azimuth angle, φ, and elevation, θ, of a loudspeaker location. In the example of FIG. 8, audio encoding device 20 may specify a position of a loudspeaker in the source loudspeaker setup by signaling an index of an entry in table 140. For example, audio encoding device 20 may specify a loudspeaker in the source loudspeaker setup is at azimuth 1.967778 radians and elevation 0.428967 radians by signaling index value 46.

Returning to the example of FIG. 6, vector creation unit 112 may obtain source rendering format 116. Vector creation unit 112 may determine a set of spatial vectors 118 based on source rendering format 116. In some examples, the number of spatial vectors generated by vector creation unit 112 is equal to the number of loudspeakers in the source loudspeaker setup. For instance, if there are N loudspeakers in the source loudspeaker setup, vector creation unit 112 may determine N spatial vectors. For each loudspeaker n in the source loudspeaker setup, where n ranges from 1 to N, the spatial vector for the loudspeaker may be equal or equivalent to $V_n=[A_n(DD^T)^{-1}D]^T$. In this equation, D is the source rendering format represented as a matrix and $A_n$ is a matrix consisting of a single row of elements equal in number to N (i.e., $A_n$ is an N-dimensional vector). Each element in $A_n$ is equal to 0 except for one element whose value is equal to 1. The index of the position within $A_n$ of the element equal to 1 is equal to n. Thus, when n is equal to 1, $A_n$ is equal to [1, 0, 0, . . . , 0]; when n is equal to 2, $A_n$ is equal to [0, 1, 0, . . . , 0]; and so on.

Memory 114 may store a codebook 120. Memory 114 may be separate from vector encoding unit 68A and may form part of a general memory of audio encoding device 14. Codebook 120 includes a set of entries, each of which maps a respective code-vector index to a respective spatial vector of the set of spatial vectors 118. The following table is an example codebook. In this table, each respective row corresponds to a respective entry, N indicates the number of loudspeakers, and D represents the source rendering format represented as a matrix.

| Code-vector index | Spatial vector |
|---|---|
| 1 | $V_1 = [[1, 0, 0, \ldots, 0, \ldots, 0](DD^T)^{-1}D]^T$ |
| 2 | $V_2 = [[0, 1, 0, \ldots, 0, \ldots, 0](DD^T)^{-1}D]^T$ |
| . . . | . . . |
| N | $V_N = [[0, 0, 0, \ldots, 0, \ldots, 1](DD^T)^{-1}D]^T$ |

For each respective loudspeaker of the source loudspeaker setup, representation unit 115 outputs the code-vector index corresponding to the respective loudspeaker. For example, representation unit 115 may output data indicating the code-vector index corresponding to a first channel is 2, the code-vector index corresponding to a second channel is equal to 4, and so on. A decoding device having a copy of codebook 120 is able to use the code-vector indices to determine the spatial vector for the loudspeakers of the source loudspeaker setup. Hence, the code-vector indexes are a type of spatial vector representation data. As discussed above, bitstream generation unit 52B may include spatial vector representation data 71A in bitstream 56B.

Furthermore, in some examples, representation unit 115 may obtain source loudspeaker setup information 48 and may include data indicating locations of the source loudspeakers in spatial vector representation data 71A. In other examples, representation unit 115 does not include data indicating locations of the source loudspeakers in spatial vector representation data 71A. Rather, in at least some such examples, the locations of the source loudspeakers may be preconfigured at audio decoding device 22.

In examples where representation unit 115 includes data indicating locations of the source loudspeaker in spatial vector representation data 71A, representation unit 115 may indicate the locations of the source loudspeakers in various ways. In one example, source loudspeaker setup information 48 specifies a surround sound format, such as the 5.1 format, the 7.1 format, or the 22.2 format. In this example, each of the loudspeakers of the source loudspeaker setup is at a predefined location. Accordingly, representation unit 115 may include, in spatial representation data 115, data indicating the predefined surround sound format. Because the loudspeakers in the predefined surround sound format are at predefined positions, the data indicating the predefined surround sound format may be sufficient for audio decoding device 22 to generate a codebook matching codebook 120.

In another example, ISO/IEC 23008-3 defines a plurality of CICP speaker layout index values for different loudspeaker layouts. In this example, source loudspeaker setup information 48 specifies a CICP speaker layout index (CICPspeakerLayoutIdx) as specified in ISO/IEC 23008-3. Rendering format unit 110 may determine, based on this CICP speaker layout index, locations of loudspeakers in the source loudspeaker setup. Accordingly, representation unit 115 may include, in spatial vector representation data 71A, an indication of the CICP speaker layout index.

In another example, source loudspeaker setup information 48 specifies an arbitrary number of loudspeakers in the source loudspeaker setup and arbitrary locations of loudspeakers in the source loudspeaker setup. In this example, rendering format unit 110 may determine the source rendering format based on the arbitrary number of loudspeakers in the source loudspeaker setup and arbitrary locations of loudspeakers in the source loudspeaker setup. In this example, the arbitrary locations of the loudspeakers in the source loudspeaker setup may be expressed in various ways. For example, representation unit 115 may include, in spatial vector representation data 71A, spherical coordinates of the loudspeakers in the source loudspeaker setup. In another example, audio encoding device 20 and audio decoding device 24 are configured with a table having entries corresponding to a plurality of predefined loudspeaker positions. FIG. 7 and FIG. 8 are examples of such tables. In this example, rather than spatial vector representation data 71A further specifying spherical coordinates of loudspeakers, spatial vector representation data 71A may instead include data indicating index values of entries in the table. Signaling an index value may be more efficient than signaling spherical coordinates.

Figure 9:
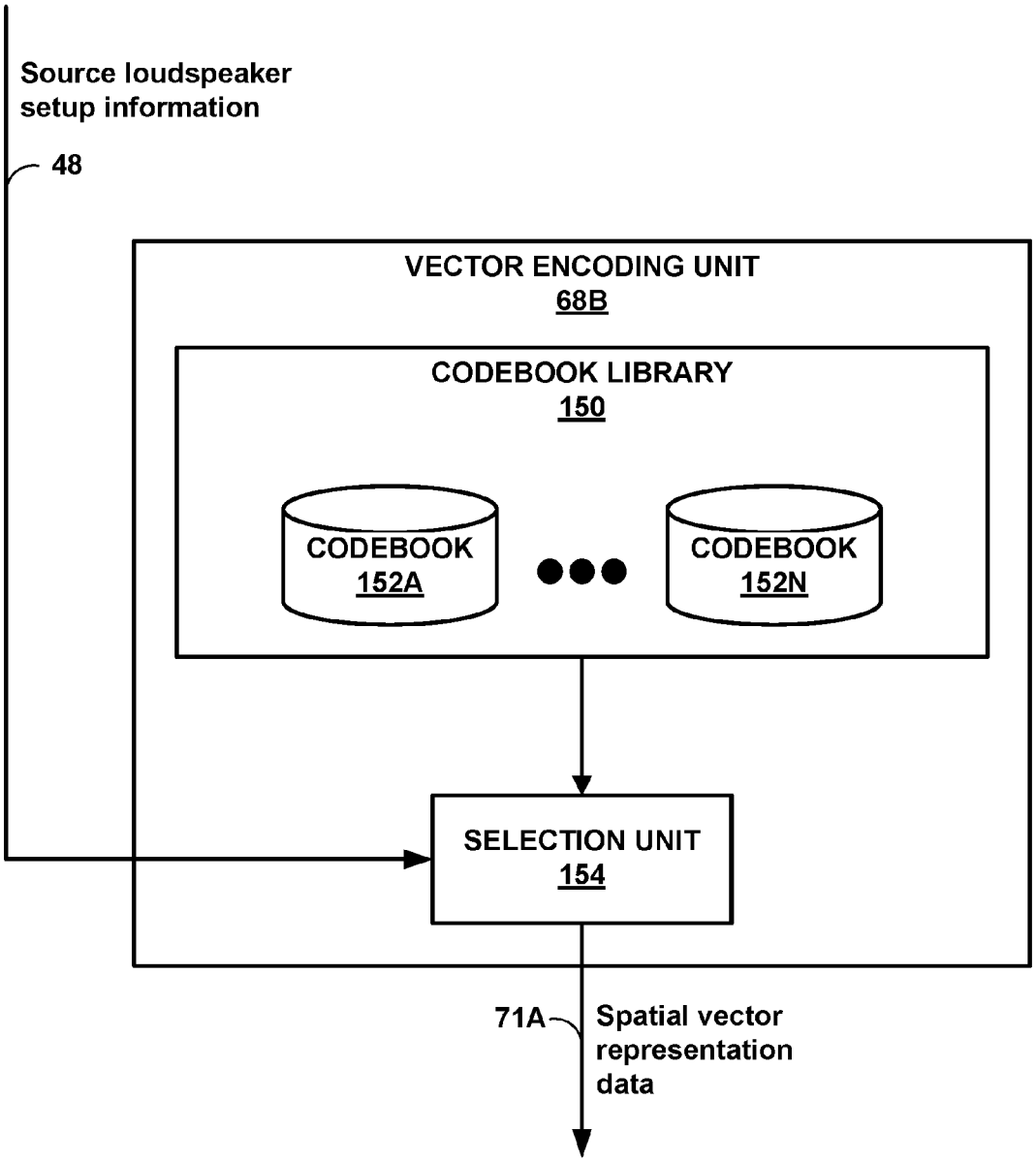
FIG. 9 is a block diagram illustrating an example implementation of a vector encoding unit, in accordance with one or more techniques of this disclosure.

FIG. 9 is a block diagram illustrating an example implementation of vector encoding unit 68, in accordance with one or more techniques of this disclosure. In the example of FIG. 9, the example implementation of vector encoding unit 68 is labeled vector encoding unit 68B. In the example of FIG. 9, spatial vector unit 68B includes a codebook library 150 and a selection unit 154. Codebook library 150 may be implemented using a memory. Codebook library 150 includes one or more predefined codebooks 152A-152N (collectively, "codebooks 152"). Each respective one of codebooks 152 includes a set of one or more entries. Each respective entry maps a respective code-vector index to a respective spatial vector.

Each respective one of codebooks 152 corresponds to a different predefined source loudspeaker setup. For example, a first codebook in codebook library 150 may correspond to a source loudspeaker setup consisting of two loudspeakers. In this example, a second codebook in codebook library 150 corresponds to a source loudspeaker setup consisting of five loudspeakers arranged at the standard locations for the 5.1 surround sound format. Furthermore, in this example, a third codebook in codebook library 150 corresponds to a source loudspeaker setup consisting of seven loudspeakers arranged at the standard locations for the 7.1 surround sound format. In this example, a fourth codebook in codebook library 100 corresponds to a source loudspeaker setup consisting of 22 loudspeakers arranged at the standard locations for the 22.2 surround sound format. Other examples may include more, fewer, or different codebooks than those mentioned in the previous example.

In the example of FIG. 9, selection unit 154 receives source loudspeaker setup information 48. In one example, source loudspeaker information 48 may consist of or comprises information identifying a predefined surround sound format, such as 5.1, 7.1, 22.2, and others. In another example, source loudspeaker information 48 consists of or comprises information identifying another type of predefined number and arrangement of loudspeakers.

Selection unit 154 identifies, based on the source loudspeaker setup information, which of codebooks 152 is applicable to the audio signals received by audio decoding device 24. In the example of FIG. 9, selection unit 154 outputs spatial vector representation data 71A indicating which of audio signals 50 corresponds to which entries in the identified codebook. For instance, selection unit 154 may output a code-vector index for each of audio signals 50.

In some examples, vector encoding unit 68 employs a hybrid of the predefined codebook approach of FIG. 6 and the dynamic codebook approach of FIG. 9. For instance, as described elsewhere in this disclosure, where channel-based audio is used, each respective channel corresponds to a respective loudspeaker of the source loudspeaker setup and vector encoding unit 68 determines a respective spatial vector for each respective loudspeaker of the source loudspeaker setup. In some of such examples, such as where channel-based audio is used, vector encoding unit 68 may use one or more predefined codebooks to determine the spatial vectors of particular loudspeakers of the source loudspeaker setup. Vector encoding unit 68 may determine a source rendering format based on the source loudspeaker setup, and use the source rendering format to determine spatial vectors for other loudspeakers of the source loudspeaker setup.

Figure 10:
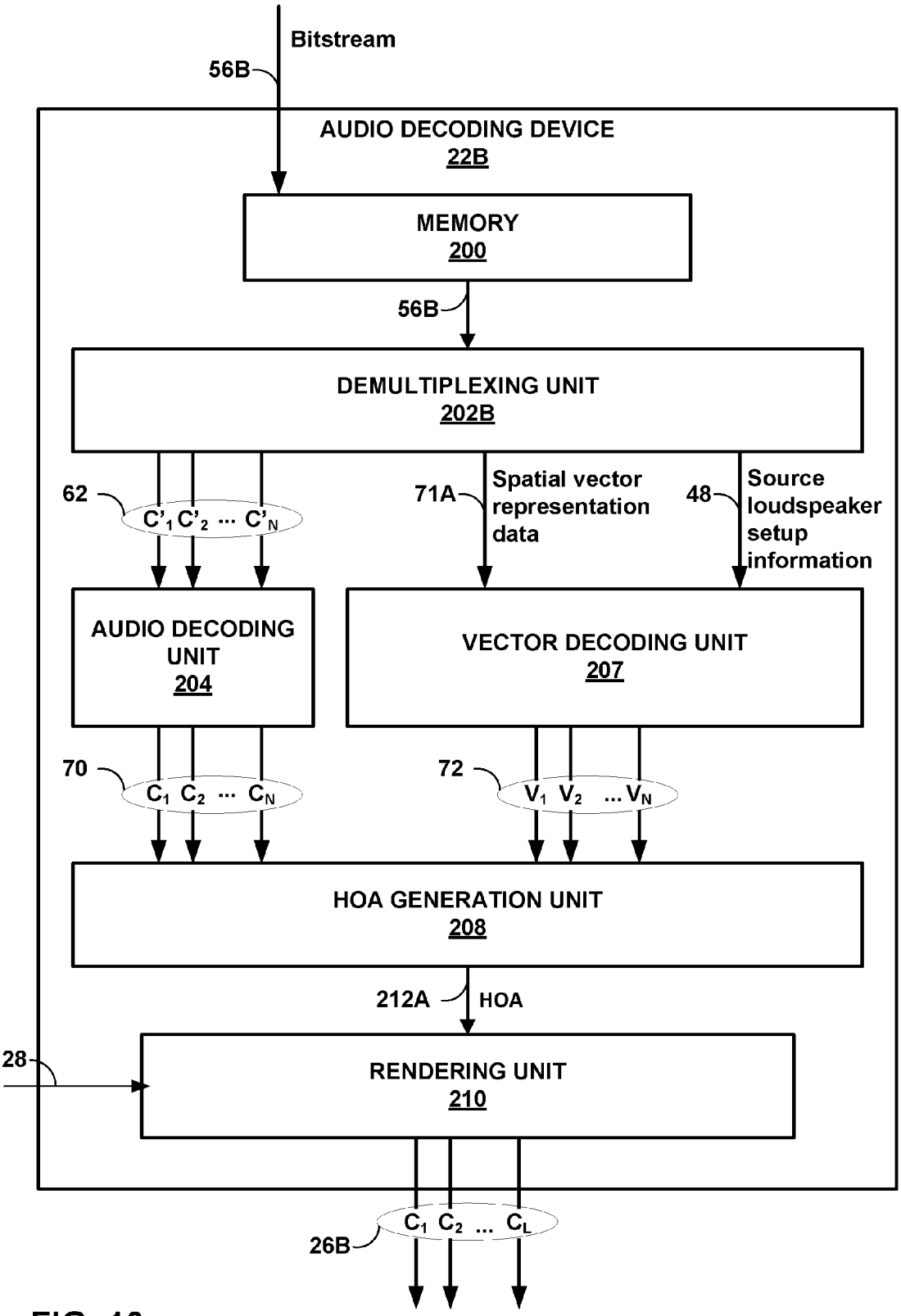
FIG. 10 is a block diagram illustrating an example implementation of an audio decoding device, in accordance with one or more techniques of this disclosure.

FIG. 10 is a block diagram illustrating an example implementation of audio decoding device 22, in accordance with one or more techniques of this disclosure. The example implementation of audio decoding device 22 shown in FIG. 5 is labeled audio decoding device 22B. The implementation of audio decoding device 22 in FIG. 10 includes memory 200, demultiplexing unit 202B, audio decoding unit 204, vector decoding unit 207, an HOA generation unit 208A, and a rendering unit 210. In other examples, audio decoding device 22B may include more, fewer, or different units. For instance, rendering unit 210 may be implemented in a separate device, such as a loudspeaker, headphone unit, or audio base or satellite device, and may be connected to audio decoding device 22B via one or more wired or wireless connections.

In contrast to audio decoding device 22A of FIG. 4 which may generate spatial positioning vectors 72 based on loudspeaker position information 48 without receiving an indication of the spatial positioning vectors, audio decoding device 22B includes vector decoding unit 207 which may determine spatial positioning vectors 72 based on received spatial vector representation data 71A.

In some examples, vector decoding unit 207 may determine spatial positioning vectors 72 based on codebook indices represented by spatial vector representation data 71A. As one example, vector decoding unit 207 may determine spatial positioning vectors 72 from indices in a codebook that is dynamically created (e.g., based on loudspeaker position information 48). Additional details of one example of vector decoding unit 207 that determines spatial positioning vectors from indices in a dynamically created codebook are discussed below with reference to FIG. 11. As another example, vector decoding unit 207 may determine spatial positioning vectors 72 from indices in a codebook that includes spatial positioning vectors for pre-determined source loudspeaker setups. Additional details of one example of vector decoding unit 207 that determines spatial positioning vectors from indices in a codebook that includes spatial positioning vectors for pre-determined source loudspeaker setups are discussed below with reference to FIG. 12.

In any case, vector decoding unit 207 may provide spatial positioning vectors 72 to one or more other components of audio decoding device 22B, such as HOA generation unit 208A.

Thus, audio decoding device 22B may include a memory (e.g., memory 200) configured to store a coded audio bitstream. Audio decoding device 22B may further include one or more processors electrically coupled to the memory and configured to: obtain, from the coded audio bitstream, a representation of a multi-channel audio signal for a source loudspeaker configuration (e.g., coded audio signal 62 for loudspeaker position information 48); obtain a representation of a plurality of SPVs in the HOA domain that are based on the source loudspeaker configuration (e.g., spatial positioning vectors 72); and generate a HOA soundfield (e.g., HOA coefficients 212A) based on the multi-channel audio signal and the plurality of spatial positioning vectors.

Figure 11:
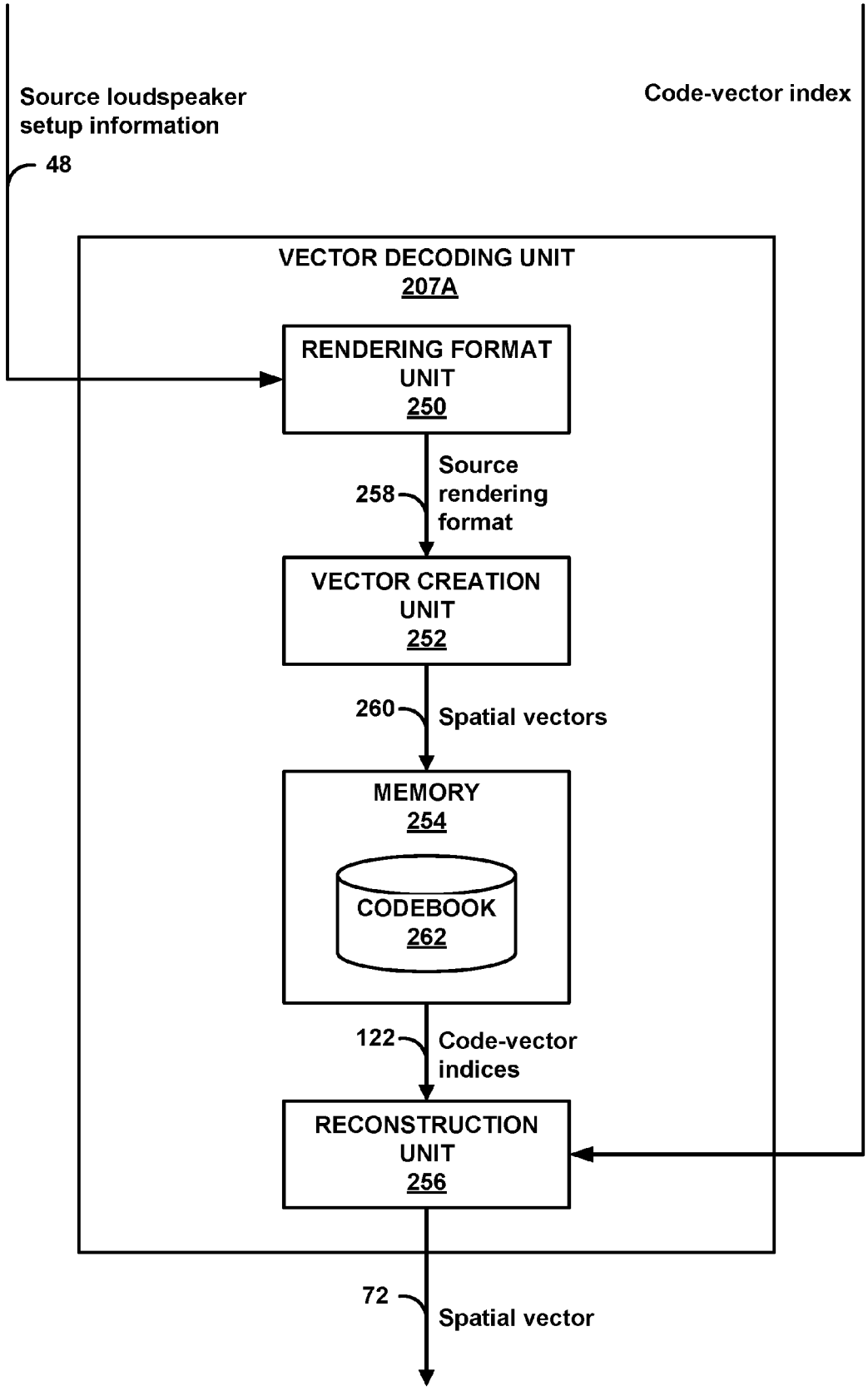
FIG. 11 is a block diagram illustrating an example implementation of a vector decoding unit, in accordance with one or more techniques of this disclosure.

FIG. 11 is a block diagram illustrating an example implementation of vector decoding unit 207, in accordance with one or more techniques of this disclosure. In the example of FIG. 11, the example implementation of vector decoding unit 207 is labeled vector decoding unit 207A. In the example of FIG. 11, vector decoding unit 207 includes a rendering format unit 250, a vector creation unit 252, a memory 254, and a reconstruction unit 256. In other examples, vector decoding unit 207 may include more, fewer, or different components.

Rendering format unit 250 may operate in a manner similar to that of rendering format unit 110 of FIG. 6. As with rendering format unit 110, rendering format unit 250 may receive source loudspeaker setup information 48. In some examples, source loudspeaker setup information 48 is obtained from a bitstream. In other examples, source loudspeaker setup information 48 is preconfigured at audio decoding device 22. Furthermore, like rendering format unit 110, rendering format unit 250 may generate a source rendering format 258. Source rendering format 258 may match source rendering format 116 generated by rendering format unit 110.

Vector creation unit 252 may operate in a manner similar to that of vector creation unit 112 of FIG. 6. Vector creation unit 252 may use source rendering format 258 to determine a set of spatial vectors 260. Spatial vectors 260 may match spatial vectors 118 generated by vector generation unit 112. Memory 254 may store a codebook 262. Memory 254 may be separate from vector decoding 206 and may form part of a general memory of audio decoding device 22. Codebook 262 includes a set of entries, each of which maps a respective code-vector index to a respective spatial vector of the set of spatial vectors 260. Codebook 262 may match codebook 120 of FIG. 6.

Reconstruction unit 256 may output the spatial vectors identified as corresponding to particular loudspeakers of the source loudspeaker setup. For instance, reconstruction unit 256 may output spatial vectors 72.

Figure 12:
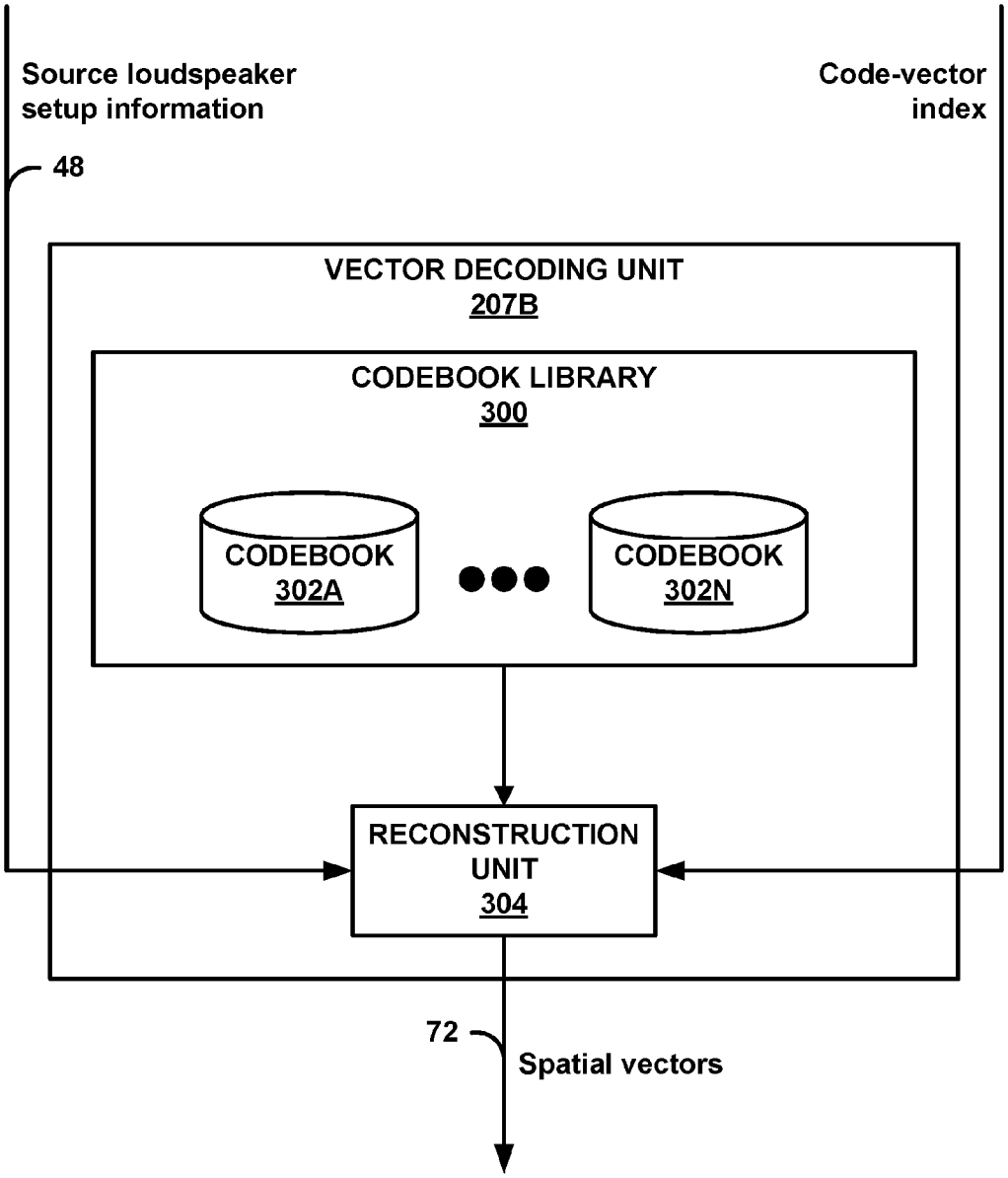
FIG. 12 is a block diagram illustrating an alternative implementation of a vector decoding unit, in accordance with one or more techniques of this disclosure.

FIG. 12 is a block diagram illustrating an alternative implementation of vector decoding unit 207, in accordance with one or more techniques of this disclosure. In the example of FIG. 12, the example implementation of vector decoding unit 207 is labeled vector decoding unit 207B. Vector decoding unit 207 includes a codebook library 300 and a reconstruction unit 304. Codebook library 300 may be implemented using a memory. Codebook library 300 includes one or more predefined codebooks 302A-302N (collectively, "codebooks 302"). Each respective one of codebooks 302 includes a set of one or more entries. Each respective entry maps a respective code-vector index to a respective spatial vector. Codebook library 300 may match codebook library 150 of FIG. 9.

In the example of FIG. 12, reconstruction unit 304 obtains source loudspeaker setup information 48. In a similar manner as selection unit 154 of FIG. 9, reconstruction unit 304 may use source loudspeaker setup information 48 to identify an applicable codebook in codebook library 300. Reconstruction unit 304 may output the spatial vectors specified in the applicable codebook for the loudspeakers of the source loudspeaker setup information.

Figure 13:
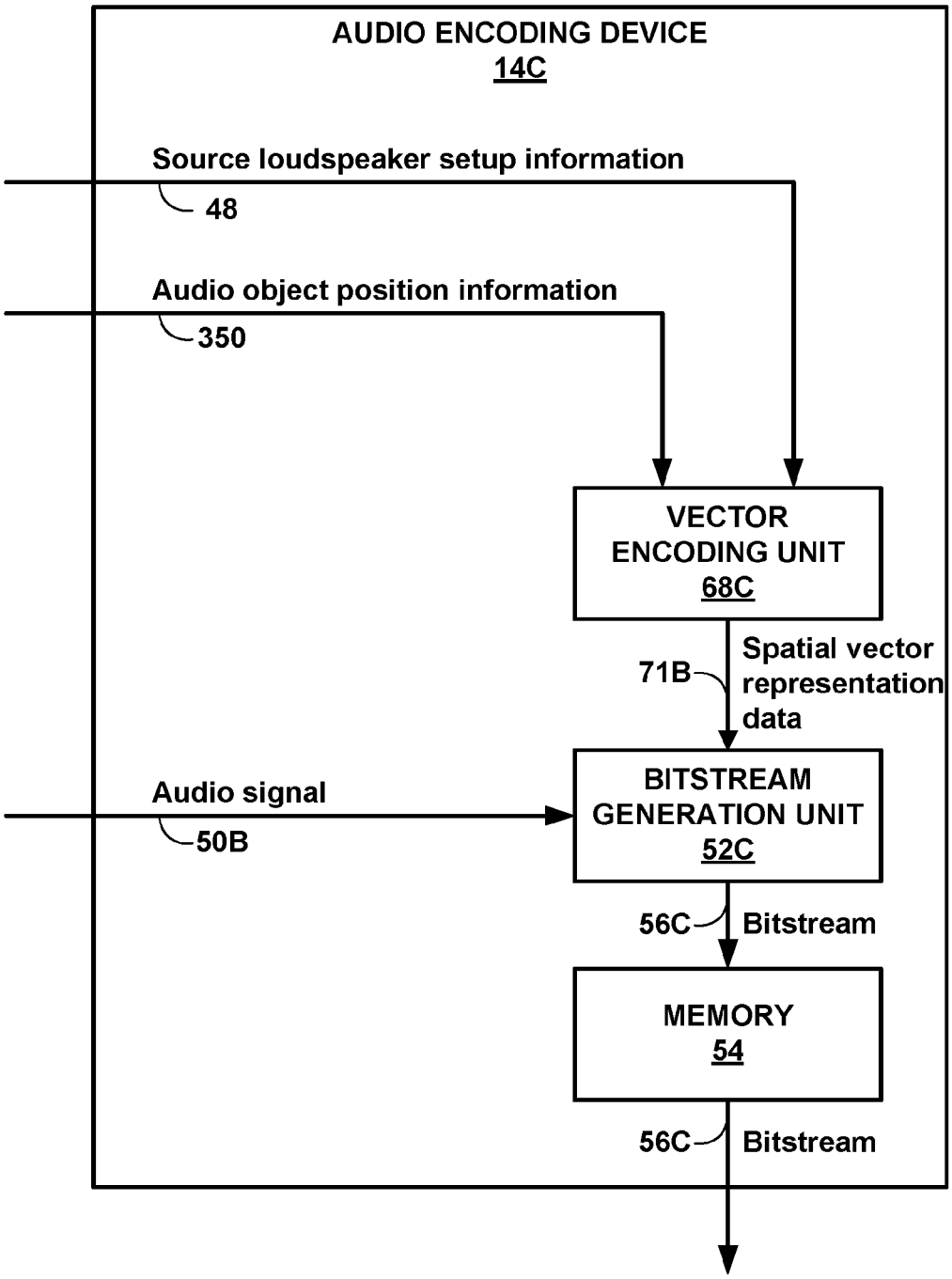
FIG. 13 is a block diagram illustrating an example implementation of an audio encoding device in which the audio encoding device is configured to encode object-based audio data, in accordance with one or more techniques of this disclosure.

FIG. 13 is a block diagram illustrating an example implementation of audio encoding device 14 in which audio encoding device 14 is configured to encode object-based audio data, in accordance with one or more techniques of this disclosure. The example implementation of audio encoding device 14 shown in FIG. 13 is labeled 14C. In the example of FIG. 13, audio encoding device 14C includes a vector encoding unit 68C, a bitstream generation unit 52C, and a memory 54.

Figure 14:
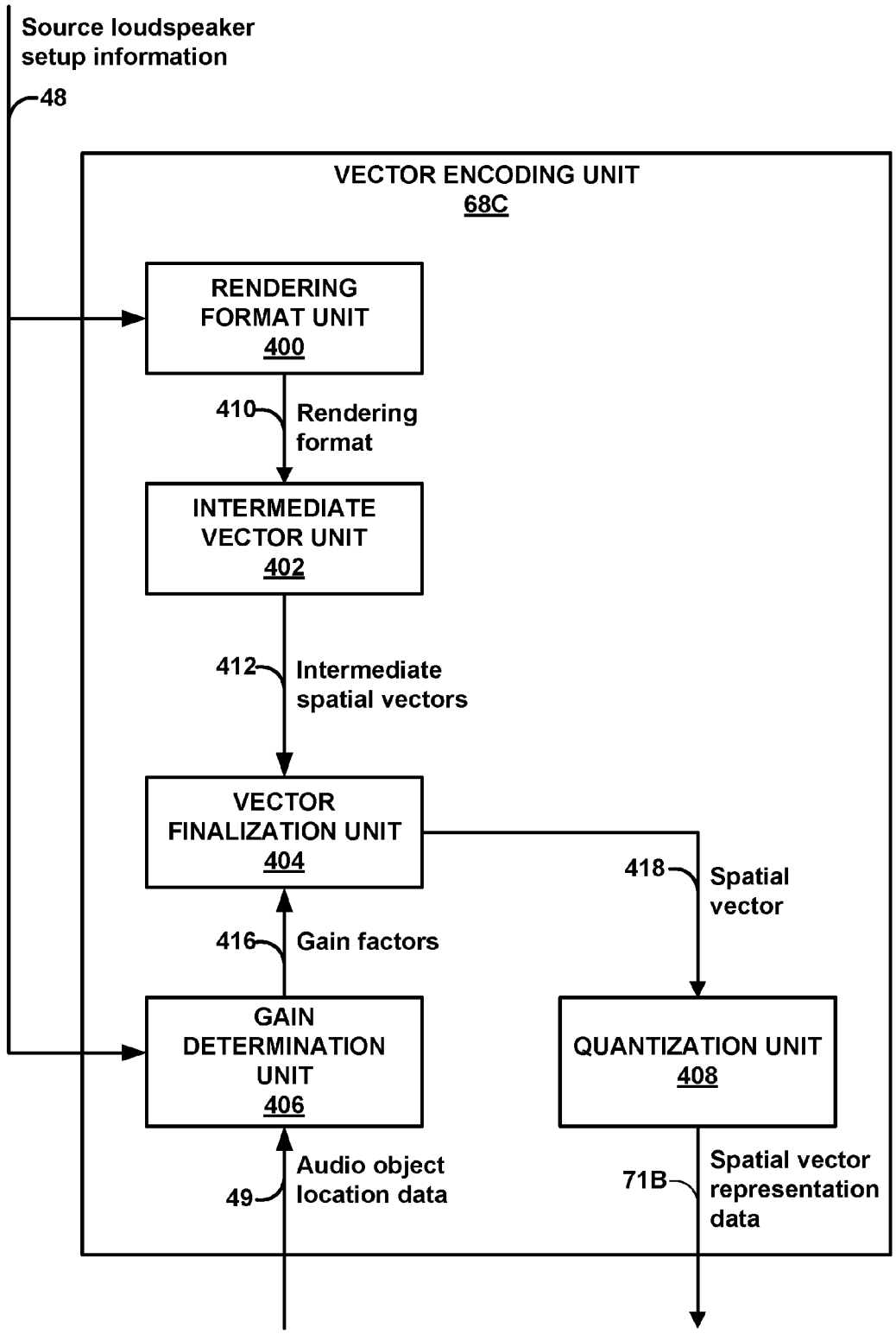
FIG. 14 is a block diagram illustrating an example implementation of vector encoding unit 68C for object-based audio data, in accordance with one or more techniques of this disclosure.

In the example of FIG. 13, vector encoding unit 68C obtains source loudspeaker setup information 48. In addition, vector encoding unit 58C obtains audio object position information 350. Audio object position information 350 specifies a virtual position of an audio object. Vector encoding unit 68B uses source loudspeaker setup information 48 and audio object position information 350 to determine spatial vector representation data 71B for the audio object. FIG. 14, described in detail below, describes an example implementation of vector encoding unit 68C.

Bitstream generation unit 52C obtains an audio signal 50B for the audio object. Bitstream generation unit 52C may include data representing audio signal 50C and spatial vector representation data 71B in a bitstream 56C. In some examples, bitstream generation unit 52C may encode audio signal 50B using a known audio compression format, such as MP3, AAC, Vorbis, FLAC, and Opus. In some instances, bitstream generation unit 52C may transcode audio signal 50B from one compression format to another. In some examples, audio encoding device 14C may include an audio encoding unit, such as an audio encoding unit 51 of FIGS. 3 and 5, to compress and/or transcode audio signal 50B. In the example of FIG. 13, memory 54 stores at least portions of bitstream 56C prior to output by audio encoding device 14C.

Thus, audio encoding device 14C includes a memory configured to store an audio signal of an audio object (e.g., audio signal 50B) for a time interval and data indicating a virtual source location of the audio object (e.g., audio object position information 350). Furthermore, audio encoding device 14C includes one or more processors electrically coupled to the memory. The one or more processors are configured to determine, based on the data indicating the virtual source location for the audio object and data indicating a plurality of loudspeaker locations (e.g., source loudspeaker setup information 48), a spatial vector of the audio object in a HOA domain. Furthermore, in some examples, audio encoding device 14C may include, in a bitstream, data representative of the audio signal and data representative of the spatial vector. In some examples, the data representative of the audio signal is not a representation of data in the HOA domain. Furthermore, in some examples, a set of HOA coefficients describing a sound field containing the audio signal during the time interval is equal or equivalent to the audio signal multiplied by the transpose of the spatial vector.

Additionally, in some examples, spatial vector representation data 71B may include data indicating locations of loudspeakers in the source loudspeaker setup. Bitstream generation unit 52C may include the data representing the locations of the loudspeakers of the source loudspeaker setup in bitstream 56C. In other examples, bitstream generation unit 52C does not include data indicating locations of loudspeakers of the source loudspeaker setup in bitstream 56C.

FIG. 14 is a block diagram illustrating an example implementation of vector encoding unit 68C for object-based audio data, in accordance with one or more techniques of this disclosure. In the example of FIG. 14, vector encoding unit 68C includes a rendering format unit 400, an intermediate vector unit 402, a vector finalization unit 404, a gain determination unit 406, and a quantization unit 408.

In the example of FIG. 14, rendering format unit 400 obtains source loudspeaker setup information 48. Rendering format unit 400 determines a source rendering format 410 based on source loudspeaker setup information 48. Rendering format unit 400 may determine source rendering format 410 in accordance with one or more of the examples provided elsewhere in this disclosure.

In the example of FIG. 14, intermediate vector unit 402 determines a set of intermediate spatial vectors 412 based on source rendering format 410. Each respective intermediate spatial vector of the set of intermediate spatial vectors 412 corresponds to a respective loudspeaker of the source loudspeaker setup. For instance, if there are N loudspeakers in the source loudspeaker setup, intermediate vector unit 402 determines N intermediate spatial vectors. For each loudspeaker n in the source loudspeaker setup, where n ranges from 1 to N, the intermediate spatial vector for the loudspeaker may be equal or equivalent to $V_n=[A_n(DD^T)^{-1}D]^T$. In this equation, D is the source rendering format represented as a matrix and $A_n$ is a matrix consisting of a single row of elements equal in number to N. Each element in $A_n$ is equal to 0 except for one element whose value is equal to 1. The index of the position within $A_n$ of the element equal to 1 is equal to n.

Figure 15:
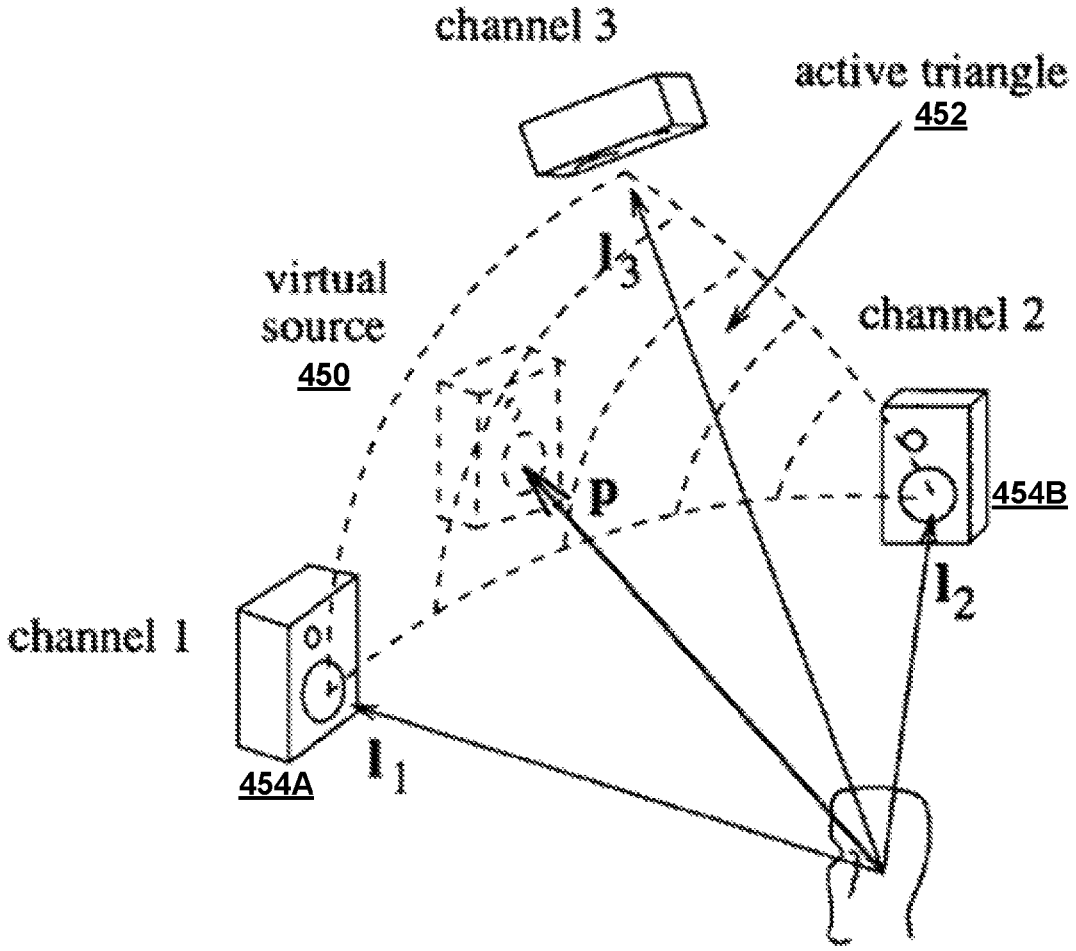
FIG. 15 is a conceptual diagram illustrating VBAP.

Furthermore, in the example of FIG. 14, gain determination unit 406 obtains source loudspeaker setup information 48 and audio object location data 49. Audio object location data 49 specifies the virtual location of an audio object. For example, audio object location data 49 may specify spherical coordinates of the audio object. In the example of FIG. 14, gain determination unit 406 determines a set of gain factors 416. Each respective gain factor of the set of gain factors 416 corresponds to a respective loudspeaker of the source loudspeaker setup. Gain determination unit 406 may use vector base amplitude panning (VBAP) to determine gain factors 416. VBAP may be used to place virtual audio sources with an arbitrary loudspeaker setup where the same distance of the loudspeakers from the listening position is assumed. Pulkki, "Virtual Sound Source Positioning Using Vector Base Amplitude Panning," Journal of Audio Engineering Society, Vol. 45, No. 6, June 1997, provides a description of VBAP FIG. 15 is a conceptual diagram illustrating VBAP. In VBAP, the gain factors applied to an audio signal output by three speakers trick a listener into perceiving that the audio signal is coming from a virtual source position 450 located within an active triangle 452 between the three loudspeakers. Virtual source position 450 may be a position indicated by the location coordinates of an audio object. For instance, in the example of FIG. 15, virtual source position 450 is closer to loudspeaker 454A than to loudspeaker 454B. Accordingly, the gain factor for loudspeaker 454A may be greater than the gain factor for loudspeaker 454B. Other examples are possible with greater numbers of loudspeakers or with two loudspeakers.

VBAP uses a geometrical approach to calculate gain factors 416. In examples, such as FIG. 15, where three loudspeakers are used for each audio object, the three loudspeakers are arranged in a triangle to form a vector base. Each vector base is identified by the loudspeaker numbers k, m, n and the loudspeaker position vectors $I_m$, and $I_n$ given in Cartesian coordinates normalized to unity length. The vector base for loudspeakers k, m, and n may be defined by:

$$I_{k,m,n}=(I_k,I_m,I_n) \tag{33}$$

The desired direction $\Omega=(\theta, \varphi)$ of the audio object may be given as azimuth angle $\varphi$ and elevation angle $\theta$. $\theta$, $\varphi$ may be the location coordinates of an audio object. The unity length position vector $p(\Omega)$ of the virtual source in Cartesian coordinates is therefore defined by:

$$p(\Omega)=(\cos\varphi\sin\theta,\sin\varphi\sin\theta,\cos\theta)^T \tag{34}$$

A virtual source position can be represented with the vector base and the gain factors $g(\Omega)=g(\Omega)=(\tilde{g}_k,\tilde{g}_m,\tilde{g}_n)^T$ by $$p(\Omega)=L_{kmn}g(\Omega)=\tilde{g}_kI_k+\tilde{g}_mI_m+\tilde{g}_nI_n. \tag{35}$$

By inverting the vector base matrix, the required gain factors can be computed by:

$$g(\Omega)=L_{kmn}^{-1}p(\Omega). \tag{36}$$

The vector base to be used is determined according to Equation (36). First, the gains are calculated according to Equation (36) for all vector bases. Subsequently, for each vector base, the minimum over the gain factors is evaluated by $g(\Omega)=\min\{\tilde{g}_k, \tilde{g}_m, \tilde{g}_n\}$. The vector base where $\tilde{g}_{min}$ has the highest value is used. In general, the gain factors are not permitted to be negative. Depending on the listening room acoustics, the gain factors may be normalized for energy preservation.

In the example of FIG. 14, vector finalization unit 404 obtains gain factors 416. Vector finalization unit 404 generates, based on intermediate spatial vectors 412 and gain factors 416, a spatial vector 418 for the audio object. In some examples, vector finalization unit 404 determines the spatial vector using the following equation:

$$V=\Sigma_{i=1}^{N} g_i I_i \tag{37}$$

In the equation above, V is the spatial vector, N is the number of loudspeakers in the source loudspeaker setup, $g_i$ is the gain factor for loudspeaker i, and $I_i$ is the intermediate spatial vector for loudspeaker i. In some examples where gain determination unit 406 uses VBAP with three loudspeakers, only three of gain factors $g_i$ are non-zero.

Thus, in an example where vector finalization unit 404 determines spatial vector 418 using Equation (37), spatial vector 418 is equal or equivalent to a sum of a plurality of operands. Each respective operand of the plurality of operands corresponds to a respective loudspeaker location of the plurality of loudspeaker locations. For each respective loudspeaker location of the plurality of loudspeaker locations, a plurality of loudspeaker location vectors includes a loudspeaker location vector for the respective loudspeaker location. Furthermore, for each respective loudspeaker location of the plurality of loudspeaker locations, the operand corresponding to the respective loudspeaker location is equal or equivalent to a gain factor for the respective loudspeaker location multiplied by the loudspeaker location vector for the respective loudspeaker location. In this example, the gain factor for the respective loudspeaker location indicates a respective gain for the audio signal at the respective loudspeaker location.

Thus, in this example, the spatial vector 418 is equal or equivalent to a sum of a plurality of operands. Each respective operand of the plurality of operands corresponds to a respective loudspeaker location of the plurality of loudspeaker locations. For each respective loudspeaker location of the plurality of loudspeaker locations, a plurality of loudspeaker location vectors includes a loudspeaker location vector for the respective loudspeaker location. Furthermore, the operand corresponding to the respective loudspeaker location is equal or equivalent to a gain factor for the respective loudspeaker location multiplied by the loudspeaker location vector for the respective loudspeaker location. In this example, the gain factor for the respective loudspeaker location indicates a respective gain for the audio signal at the respective loudspeaker location.

To summarize, in some examples, rendering format unit 400 of video encoding unit 68C may determine a rendering format for rendering a set of HOA coefficients into loudspeaker feeds for loudspeakers at source loudspeaker locations. Additionally, vector finalization unit 404 may determine a plurality of loudspeaker location vectors. Each respective loudspeaker location vector of the plurality of loudspeaker location vectors may correspond to a respective loudspeaker location of the plurality of loudspeaker locations. To determine the plurality of loudspeaker location vectors, gain determination unit 406 may, for each respective loudspeaker location of the plurality of loudspeaker locations, determine, based on location coordinates of the audio object, a gain factor for the respective loudspeaker location. The gain factor for the respective loudspeaker location may indicate a respective gain for the audio signal at the respective loudspeaker location. Additionally, for each respective loudspeaker location of the plurality of loudspeaker locations, determine, based on location coordinates of the audio object, intermediate vector unit 402 may determine, based on the rendering format, the loudspeaker location vector corresponding to the respective loudspeaker location. Vector finalization unit 404 may determine the spatial vector as a sum of a plurality of operands, each respective operand of the plurality of operands corresponding to a respective loudspeaker location of the plurality of loudspeaker locations. For each respective loudspeaker location of the plurality of loudspeaker locations, the operand corresponding to the respective loudspeaker location is equal or equivalent to the gain factor for the respective loudspeaker location multiplied by the loudspeaker location vector corresponding to the respective loudspeaker location.

Quantization unit 408 quantizes the spatial vector for the audio object. For instance, quantization unit 408 may quantize the spatial vector according to the vector quantization techniques described elsewhere in this disclosure. For instance, quantization unit 408 may quantize spatial vector 418 using the scalar quantization, scalar quantization with Huffman coding, or vector quantization techniques described with regard to FIG. 17. Thus, the data representative of the spatial vector that is included in bitstream 70C is the quantized spatial vector.

As discussed above, spatial vector 418 may be equal or equivalent to a sum of a plurality of operands. For purposes of this disclosure, a first element may be considered to be equal to a second element where any of the following is true (1) a value of the first element is mathematically equal to a value of the second element, (2) the value of the first element, when rounded (e.g., due to bit depth, register limits, floating-point representation, fixed point representation, binary-coded decimal representation, etc.), is the same as the value of the second element, when rounded (e.g., due to bit depth, register limits, floating-point representation, fixed point representation, binary-coded decimal representation, etc.), or (3) the value of the first element is identical to the value of the second element.

Figure 16:
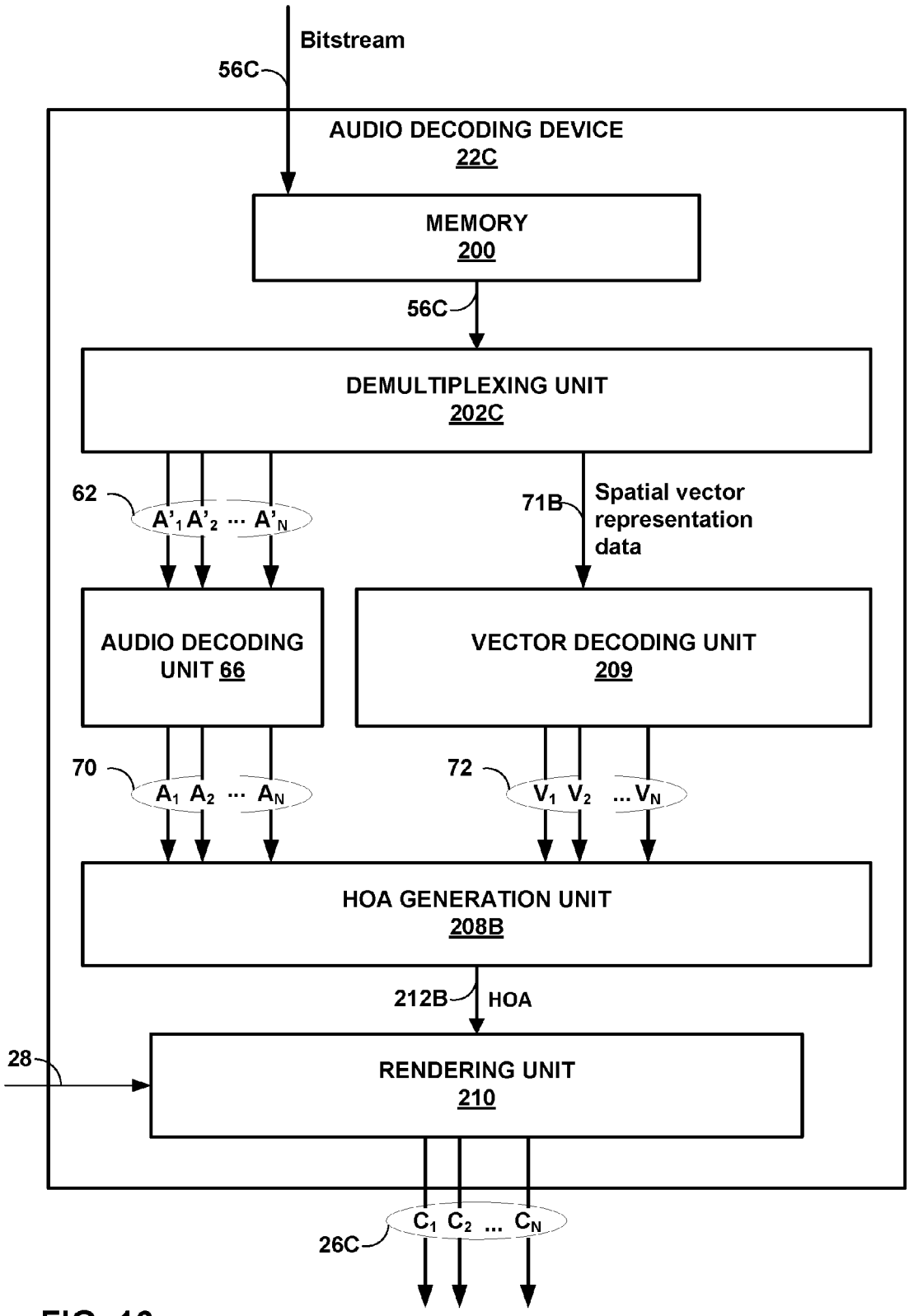
FIG. 16 is a block diagram illustrating an example implementation of an audio decoding device in which the audio decoding device is configured to decode object-based audio data, in accordance with one or more techniques of this disclosure.

FIG. 16 is a block diagram illustrating an example implementation of audio decoding device 22 in which audio decoding device 22 is configured to decode object-based audio data, in accordance with one or more techniques of this disclosure. The example implementation of audio decoding device 22 shown in FIG. 16 is labeled 22C. In the example of FIG. 16, audio decoding device 22C includes memory 200, demultiplexing unit 202C, audio decoding unit 66, vector decoding unit 209, HOA generation unit 208B, and rendering unit 210. In general, memory 200, demultiplexing unit 202C, audio decoding unit 66, HOA generation unit 208B, and rendering unit 210 may operate in a manner similar to that described with regard to memory 200, demultiplexing unit 202B, audio decoding unit 204, HOA generation unit 208A, and rendering unit 210 of the example of FIG. 10. In other examples, the implementation of audio decoding device 22 described with regard to FIG. 14 may include more, fewer, or different units. For instance, rendering unit 210 may be implemented in a separate device, such as a loudspeaker, headphone unit, or audio base or satellite device.

In the example of FIG. 16, audio decoding device 22C obtains bitstream 56C. Bitstream 56C may include an encoded object-based audio signal of an audio object and data representative of a spatial vector of the audio object. In the example of FIG. 16, the object-based audio signal is not based, derived from, or representative of data in the HOA domain. However, the spatial vector of the audio object is in the HOA domain. In the example of FIG. 16, memory 200 is configured to store at least portions of bitstream 56C and, hence, is configured to store data representative of the audio signal of the audio object and the data representative of the spatial vector of the audio object.

Demultiplexing unit 202C may obtain spatial vector representation data 71B from bitstream 56C. Spatial vector representation data 71B includes data representing spatial vectors for each audio object. Thus, demultiplexing unit 202C may obtain, from bitstream 56C, data representing an audio signal of an audio object and may obtain, from bitstream 56C, data representative of a spatial vector for the audio object. In examples, such as where the data representing the spatial vectors is quantized, vector decoding unit 209 may inverse quantize the spatial vectors to determine the spatial vectors 72 of the audio objects.

HOA generation unit 208B may then use spatial vectors 72 in the manner described with regard to FIG. 10. For instance, HOA generation unit 208B may generate an HOA soundfield, such HOA coefficients 212B, based on spatial vectors 72 and audio signal 70.

Thus, audio decoding device 22B includes a memory 58 configured to store a bitstream. Additionally, audio decoding device 22B includes one or more processors electrically coupled to the memory. The one or more processors are configured to determine, based on data in the bitstream, an audio signal of the audio object, the audio signal corresponding to a time interval. Furthermore, the one or more processors are configured to determine, based on data in the bitstream, a spatial vector for the audio object. In this example, the spatial vector is defined in a HOA domain. Furthermore, in some examples, the one or more processors convert the audio signal of the audio object and the spatial vector to a set of HOA coefficients 212B describing a sound field during the time interval. As described elsewhere in this disclosure, HOA generation unit 208B may determine the set of HOA coefficients such that the set of HOA coefficients is equal to the audio signal multiplied by a transpose of the spatial vector.

In the example of FIG. 16, rendering unit 210 may operate in a similar manner as rendering unit 210 of FIG. 10. For instance, rendering unit 210 may generate a plurality of audio signals 26 by applying a rendering format (e.g., a local rendering matrix) to HOA coefficients 212B. Each respective audio signal of the plurality of audio signals 26 may correspond to a respective loudspeaker in a plurality of loudspeakers, such as loudspeakers 24 of FIG. 1.

In some examples, rendering unit 210B may adapt the local rendering format based on information 28 indicating locations of a local loudspeaker setup. Rendering unit 210B may adapt the local rendering format in the manner described below with regard to FIG. 19.

Figure 17:
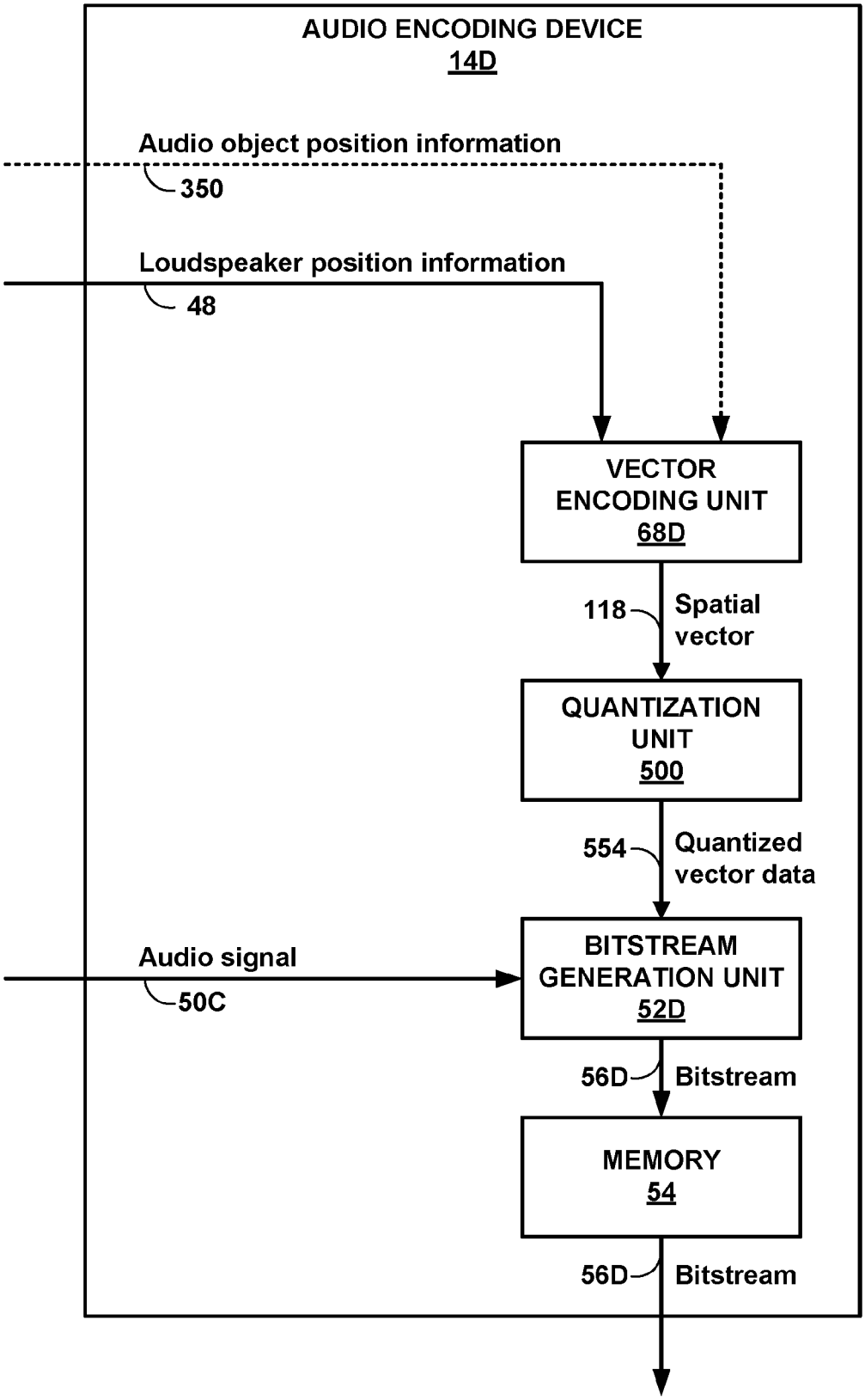
FIG. 17 is a block diagram illustrating an example implementation of an audio encoding device in which the audio encoding device is configured to quantize spatial vectors, in accordance with one or more techniques of this disclosure.

FIG. 17 is a block diagram illustrating an example implementation of audio encoding device 14 in which audio encoding device 14 is configured to quantize spatial vectors, in accordance with one or more techniques of this disclosure. The example implementation of audio encoding device 14 shown in FIG. 17 is labeled 14D. In the example of FIG. 17, audio encoding device 14D includes a vector encoding unit 68D, a quantization unit 500, a bitstream generation unit 52D, and a memory 54.

In the example of FIG. 17, vector encoding unit 68D may operate in a manner similar to that described above with regard to FIG. 5 and/or FIG. 13. For instance, if audio encoding device 14D is encoding channel-based audio, vector encoding unit 68D may obtain source loudspeaker setup information 48. Vector encoding unit 68 may determine a set of spatial vectors based on the positions of loudspeakers specified by source loudspeaker setup information 48. If audio encoding device 14D is encoding object-based audio, vector encoding unit 68D may obtain audio object position information 350 in addition to source loudspeaker setup information 48. Audio object position information 49 may specify a virtual source location of an audio object. In this example, spatial vector unit 68D may determine a spatial vector for the audio object in much the same way that vector encoding unit 68C shown in the example of FIG. 13 determines a spatial vector for an audio object. In some examples, spatial vector unit 68D is configured to determine spatial vectors for both channel-based audio and object-based audio. In other examples, vector encoding unit 68D is configured to determine spatial vectors for only one of channel-based audio or object-based audio.

Quantization unit 500 of audio encoding device 14D quantizes spatial vectors determined by vector encoding unit 68C. Quantization unit 500 may use various quantization techniques to quantize a spatial vector. Quantization unit 500 may be configured to perform only a single quantization technique or may be configured to perform multiple quantization techniques. In examples where quantization unit 500 is configured to perform multiple quantization techniques, quantization unit 500 may receive data indicating which of the quantization techniques to use or may internally determine which of the quantization techniques to apply.

In one example quantization technique, the spatial vector may be generated by vector encoding unit 68D for channel or object i is denoted $V_i$. In this example, quantization unit 500 may calculate an intermediate spatial vector $\overline{V}_i$ such that $\overline{V}_i$ is equal to $V_i/\|V_i\|$, where $\|V_i\|$ may be a quantization step size. Furthermore, in this example, quantization unit 500 may quantize the intermediate spatial vector $\overline{V}_i$. The quantized version of the intermediate spatial vector $\overline{V}_i$ may be denoted $\hat{V}_i$. In addition, quantization unit 500 may quantize $\|V_i\|$. The quantized version of $\|V_i\|$ may be denoted $\|\hat{V}_i\|$. Quantization unit 500 may output $\hat{V}_i$ and $\|\hat{V}_i\|$ for inclusion in bitstream 56D. Thus, quantization unit 500 may output a set of quantized vector data for audio signal 50D. The set of quantized vector data for audio signal 50C may include $\hat{V}_i$ and $\|\hat{V}_i\|$.

Quantization unit 500 may quantize intermediate spatial vector $\overline{V}_i$ in various ways. In one example, quantization unit 500 may apply scalar quantization (SQ) to the intermediate spatial vector $\overline{V}_i$. In another example quantization technique, quantization unit 200 may apply a scalar quantization with Huffman coding to the intermediate spatial vector $\overline{V}_i$. In another example quantization technique, quantization unit 200 may apply a vector quantization to the intermediate spatial vector $\overline{V}_i$. In examples where quantization unit 200 applies a scalar quantization technique, a scalar quantization plus Huffman coding technique, or a vector quantization technique, audio decoding device 22 may inverse quantize a quantized spatial vector.

Conceptually, in scalar quantization, a number line is divided into a plurality of bands, each corresponding to a different scalar value. When quantization unit 500 applies scalar quantization to the intermediate spatial vector $\overline{V}_i$, quantization unit 500 replaces each respective element of the intermediate spatial vector $\overline{V}_i$ with the scalar value corresponding to the band containing the value specified by the respective element. For ease of explanation, this disclosure may refer to the scalar values corresponding to the bands containing the values specified by the elements of the spatial vectors as "quantized values." In this example, quantization unit 500 may output a quantized spatial vector $\hat{V}_i$ that includes the quantized values.

The scalar quantization plus Huffman coding technique may be similar to the scalar quantization technique. However, quantization unit 500 additionally determines a Huffman code for each of the quantized values. Quantization unit 500 replaces the quantized values of the spatial vector with the corresponding Huffman codes. Thus, each element of the quantized spatial vector $\hat{V}_i$ specifies a Huffman code. Huffman coding allows each of the elements to be represented as a variable length value instead of a fixed length value, which may increase data compression. Audio decoding device 22D may determine an inverse quantized version of the spatial vector by determining the quantized values corresponding to the Huffman codes and restoring the quantized values to their original bit depths.

In at least some examples where quantization unit 500 applies vector quantization to intermediate spatial vector $\overline{V}_i$, quantization unit 500 may transform the intermediate spatial vector $\overline{V}_i$ to a set of values in a discrete subspace of lower dimension. For ease of explanation, this disclosure may refer to the dimensions of the discrete subspace of lower dimension as the "reduced dimension set" and the original dimensions of the spatial vector as the "full dimension set." For instance, the full dimension set may consist of twenty-two dimensions and the reduced dimension set may consist of eight dimensions. Hence, in this instance, quantization unit 500 transforms the intermediate spatial vector $\overline{V}_i$ from a set of twenty-two values to a set of eight values. This transformation may take the form of a projection from the higher-dimensional space of the spatial vector to the subspace of lower dimension.

In at least some examples where quantization unit 500 applies vector quantization, quantization unit 500 is configured with a codebook that includes a set of entries. The codebook may be predefined or dynamically determined. The codebook may be based on a statistical analysis of spatial vectors. Each entry in the codebook indicates a point in the lower-dimension subspace. After transforming the spatial vector from the full dimension set to the reduced dimension set, quantization unit 500 may determine a codebook entry corresponding to the transformed spatial vector. Among the codebook entries in the codebook, the codebook entry corresponding to the transformed spatial vector specifies the point closest to the point specified by the transformed spatial vector. In one example, quantization unit 500 outputs the vector specified by the identified codebook entry as the quantized spatial vector. In another example, quantization unit 200 outputs a quantized spatial vector in the form of a code-vector index specifying an index of the codebook entry corresponding to the transformed spatial vector. For instance, if the codebook entry corresponding to the transformed spatial vector is the $8^{th}$ entry in the codebook, the code-vector index may be equal to 8. In this example, audio decoding device 22 may inverse quantize the code-vector index by looking up the corresponding entry in the codebook. Audio decoding device 22D may determine an inverse quantized version of the spatial vector by assuming the components of the spatial vector that are in the full dimension set but not in the reduced dimension set are equal to zero.

In the example of FIG. 17, bitstream generation unit 52D of audio encoding device 14D obtains quantized spatial vectors 204 from quantization unit 200, obtains audio signals 50C, and outputs bitstream 56D. In examples where audio encoding device 14D is encoding channel-based audio, bitstream generation unit 52D may obtain an audio signal and a quantized spatial vector for each respective channel. In examples where audio encoding device 14 is encoding object-based audio, bitstream generation unit 52D may obtain an audio signal and a quantized spatial vector for each respective audio object. In some examples, bitstream generation unit 52D may encode audio signals 50C for greater data compression. For instance, bitstream generation unit 52D may encode each of audio signals 50C using a known audio compression format, such as MP3, AAC, Vorbis, FLAC, and Opus. In some instances, bitstream generation unit 52C may transcode audio signals 50C from one compression format to another. Bitstream generation unit 52D may include the quantized spatial vectors in bitstream 56C as metadata accompanying the encoded audio signals.

Thus, audio encoding device 14D may include one or more processors configured to: receive a multi-channel audio signal for a source loudspeaker configuration (e.g., multi-channel audio signal 50 for loudspeaker position information 48); obtain, based on the source loudspeaker configuration, a plurality of spatial positioning vectors in the Higher-Order Ambisonics (HOA) domain that, in combination with the multi-channel audio signal, represent a set of higher-order ambisonic (HOA) coefficients that represent the multi-channel audio signal; and encode, in a coded audio bitstream (e.g., bitstream 56D), a representation of the multi-channel audio signal (e.g., audio signal 50C) and an indication of the plurality of spatial positioning vectors (e.g., quantized vector data 554). Further, audio encoding device 14A may include a memory (e.g., memory 54), electrically coupled to the one or more processors, configured to store the coded audio bitstream.

Figure 18:
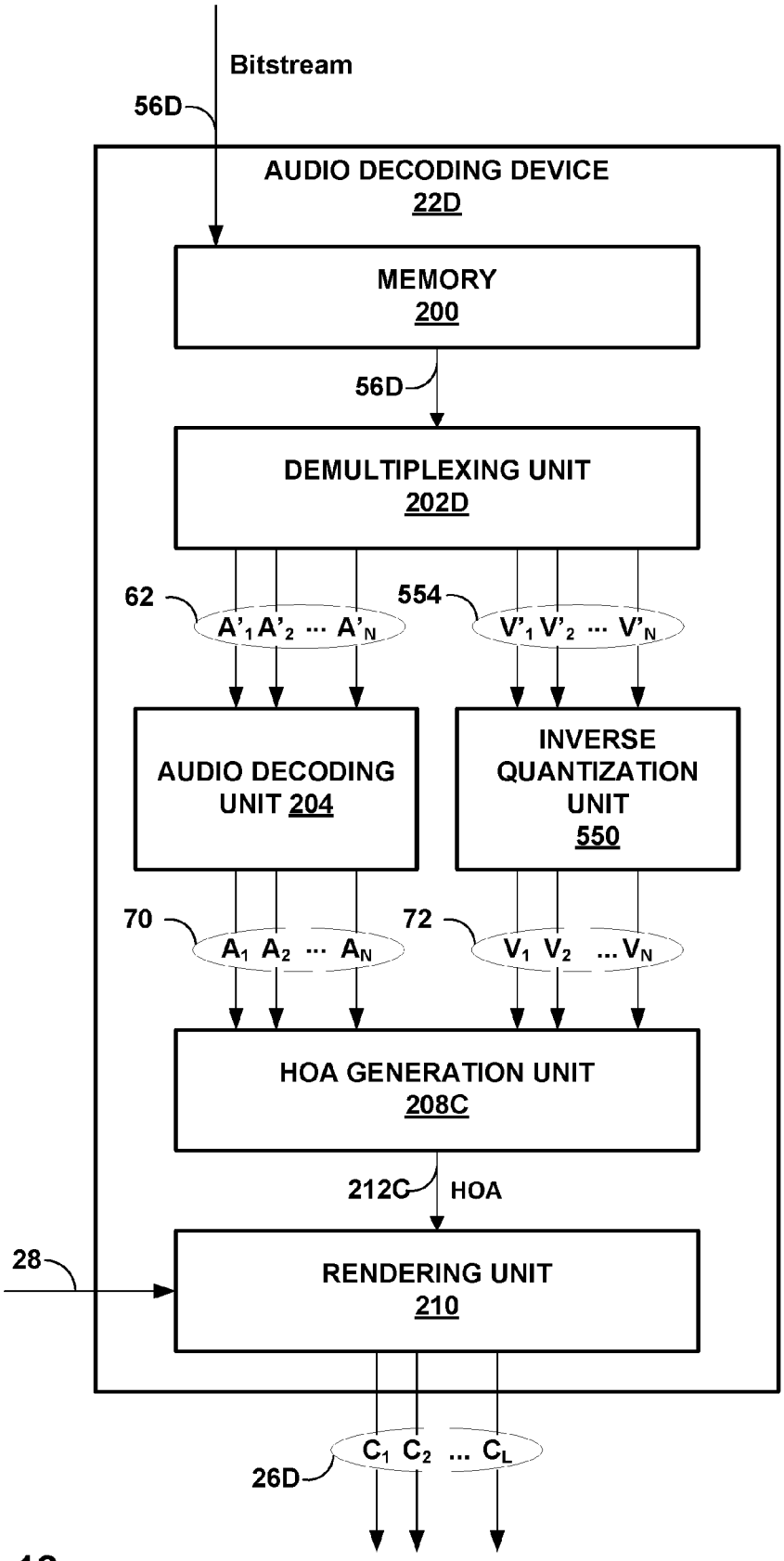
FIG. 18 is a block diagram illustrating an example implementation of an audio decoding device for use with the example implementation of the audio encoding device shown in FIG. 17, in accordance with one or more techniques of this disclosure.

FIG. 18 is a block diagram illustrating an example implementation of audio decoding device 22 for use with the example implementation of audio encoding device 14 shown in FIG. 17, in accordance with one or more techniques of this disclosure. The implementation of audio decoding device 22 shown in FIG. 18 is labeled audio decoding device 22D. Similar to the implementation of audio decoding device 22 described with regard to FIG. 10, the implementation of audio decoding device 22 in FIG. 18 includes memory 200, demultiplexing unit 202D, audio decoding unit 204, HOA generation unit 208C, and rendering unit 210.

In contrast to the implementations of audio decoding device 22 described with regard to FIG. 10, the implementation of audio decoding device 22 described with regard to FIG. 18 may include inverse quantization unit 550 in place of vector decoding unit 207. In other examples, audio decoding device 22D may include more, fewer, or different units. For instance, rendering unit 210 may be implemented in a separate device, such as a loudspeaker, headphone unit, or audio base or satellite device.

Memory 200, demultiplexing unit 202D, audio decoding unit 204, HOA generation unit 208C, and rendering unit 210 may operate in the same way as described elsewhere in this disclosure with regard to the example of FIG. 10. However, demultiplexing unit 202D may obtain sets of quantized vector data 554 from bitstream 56D. Each respective set of quantized vector data corresponds to a respective one of audio signals 70. In the example of FIG. 18, sets of quantized vector data 554 are denoted $V'_1$ through $V'_N$. Inverse quantization unit 550 may use the sets of quantized vector data 554 to determine inverse quantized spatial vectors 72. Inverse quantization unit 550 may provide the inverse quantized spatial vectors 72 to one or more components of audio decoding device 22D, such as HOA generation unit 208C.

Inverse quantization unit 550 may use the sets quantized vector data 554 to determine inverse quantized vectors in various ways. In one example, each set of quantized vector data includes a quantized spatial vector $\hat{V}_i$ and a quantized quantization step size $\|\hat{V}_i\|$ for an audio signal $\hat{C}_i$. In this example, inverse quantization unit 550 may determine an inverse quantized spatial vector $\check{V}_i$ based on the quantized spatial vector $\hat{V}_i$ and the quantized quantization step size $\|\hat{V}_i\|$. For instance, inverse quantization unit 550 may determine the inverse quantized spatial vector $\check{V}_i$, such that $\check{V}_i=\hat{V}_i*\|\hat{V}_i\|$. Based on the inverse quantized spatial vector $\check{V}_i$ and the audio signal $\hat{C}_i$, HOA generation unit 208C may determine an HOA domain representation as $H=\Sigma_{i=1}^{N}\hat{C}_i\check{V}_i^T$. As described elsewhere in this disclosure, rendering unit 210 may obtain a local rendering format $\tilde{D}$. In addition, loudspeaker feeds 80 may be denoted $\hat{C}$. Rendering unit 210C may generate loudspeaker feeds 26 as $\hat{C}=H\tilde{D}$.

Thus, audio decoding device 22D may include a memory (e.g., memory 200) configured to store a coded audio bitstream (e.g., bitstream 56D). Audio decoding device 22D may further include one or more processors electrically coupled to the memory and configured to: obtain, from the coded audio bitstream, a representation of a multi-channel audio signal for a source loudspeaker configuration (e.g., coded audio signal 62 for loudspeaker position information 48); obtain a representation of a plurality of spatial positioning vectors (SPVs) in the Higher-Order Ambisonics (HOA) domain that are based on the source loudspeaker configuration (e.g., spatial positioning vectors 72); and generate a HOA soundfield (e.g., HOA coefficients 212C) based on the multi-channel audio signal and the plurality of spatial positioning vectors.

Figure 19:
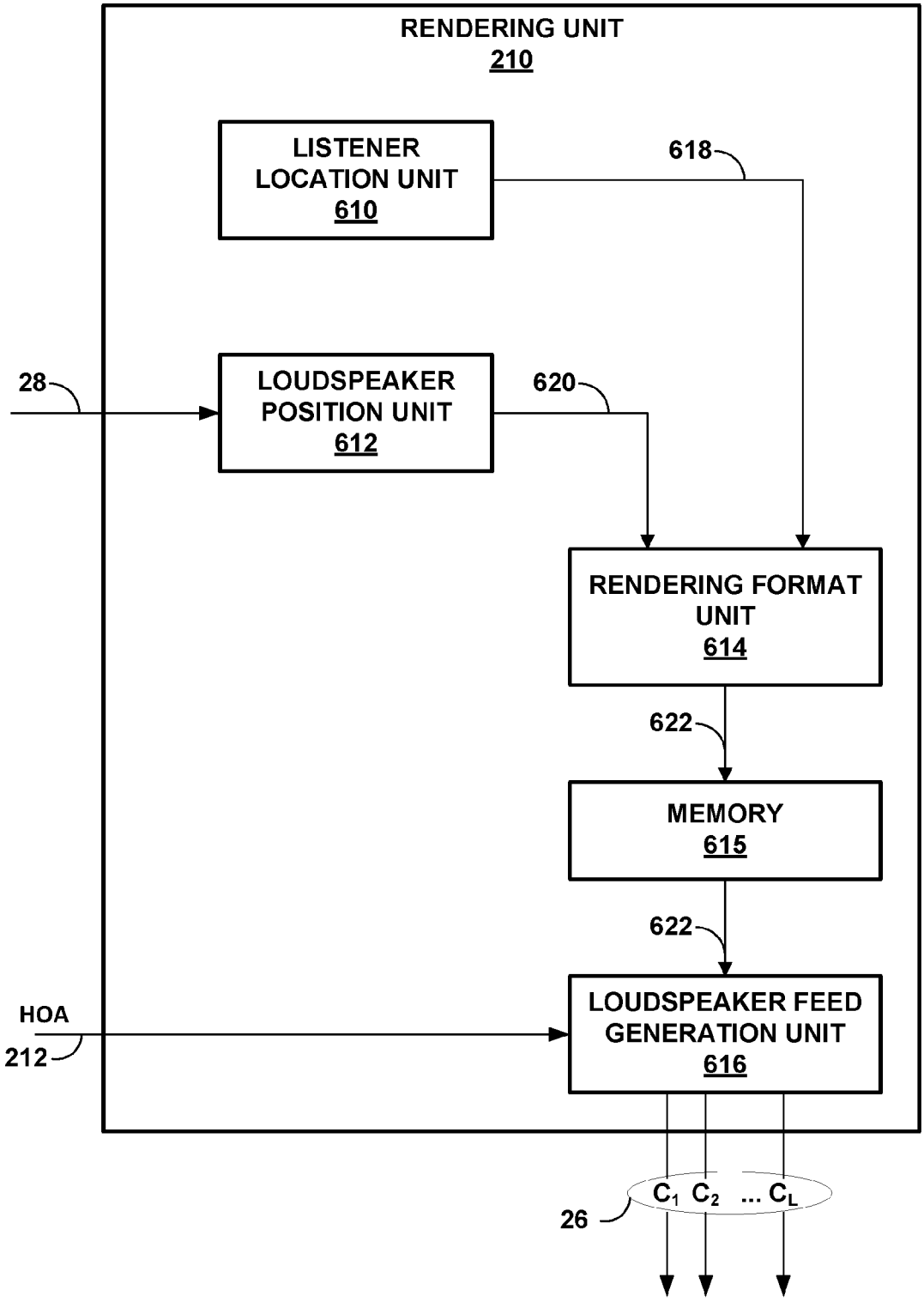
FIG. 19 is a block diagram illustrating an example implementation of rendering unit 210, in accordance with one or more techniques of this disclosure.

FIG. 19 is a block diagram illustrating an example implementation of rendering unit 210, in accordance with one or more techniques of this disclosure. As illustrated in FIG. 19, rendering unit 210 may include listener location unit 610, loudspeaker position unit 612, rendering format unit 614, memory 615, and loudspeaker feed generation unit 616.

Listener location unit 610 may be configured to determine a location of a listener of a plurality of loudspeakers, such as loudspeakers 24 of FIG. 1. In some examples, listener location unit 610 may determine the location of the listener periodically (e.g., every 1 second, 5 seconds, 10 seconds, 30 seconds, 1 minute, 5 minutes, 10 minutes, etc.). In some examples, listener location unit 610 may determine the location of the listener based on a signal generated by a device positioned by the listener. Some example of devices which may be used by listener location unit 610 to determine the location of the listener include, but are not limited to, mobile computing devices, video game controllers, remote controls, or any other device that may indicate a position of a listener. In some examples, listener location unit 610 may determine the location of the listener based on one or more sensors. Some example of sensors which may be used by listener location unit 610 to determine the location of the listener include, but are not limited to, cameras, microphones, pressure sensors (e.g., embedded in or attached to furniture, vehicle seats), seatbelt sensors, or any other sensor that may indicate a position of a listener. Listener location unit 610 may provide indication 618 of the position of the listener to one or more other components of rendering unit 210, such as rendering format unit 614.

Loudspeaker position unit 612 may be configured to obtain a representation of positions of a plurality of local loudspeakers, such as loudspeakers 24 of FIG. 1. In some examples, loudspeaker position unit 612 may determine the representation of positions of the plurality of local loudspeakers based on local loudspeaker setup information 28. Loudspeaker position unit 612 may obtain local loudspeaker setup information 28 from a wide variety of sources. As one example, a user/listener may manually enter local loudspeaker setup information 28 via a user interface of audio decoding unit 22. As another example, loudspeaker position unit 612 may cause the plurality of local loudspeakers to emit various tones and utilize a microphone to determine local loudspeaker setup information 28 based on the tones. As another example, loudspeaker position unit 612 may receive images from one or more cameras, and perform image recognition to determine local loudspeaker setup information 28 based on the images. Loudspeaker position unit 612 may provide representation 620 of the positions of the plurality of local loudspeakers to one or more other components of rendering unit 210, such as rendering format unit 614. As another example, local loudspeaker setup information 28 may be pre-programmed (e.g., at a factory) into audio decoding unit 22. For instance, where loudspeakers 24 are integrated into a vehicle, local loudspeaker setup information 28 may be pre-programmed into audio decoding unit 22 by a manufacturer of the vehicle and/or an installer of loudspeakers 24.

Rendering format unit 614 may be configured to generate local rendering format 622 based on a representation of positions of a plurality of local loudspeakers (e.g., a local reproduction layout) and a position of a listener of the plurality of local loudspeakers. In some examples, rendering format unit 614 may generate local rendering format 622 such that, when HOA coefficients 212 are rendered into loudspeaker feeds and played back through the plurality of local loudspeakers, the acoustic "sweet spot" is located at or near the position of the listener. In some examples, to generate local rendering format 622, rendering format unit 614 may generate a local rendering matrix $\tilde{D}$. Rendering format unit 614 may provide local rendering format 622 to one or more other components of rendering unit 210, such as loudspeaker feed generation unit 616 and/or memory 615.

Memory 615 may be configured to store a local rendering format, such as local rendering format 622. Where local rendering format 622 comprises local rendering matrix $\tilde{D}$, memory 615 may be configured to store local rendering matrix $\tilde{D}$.

Loudspeaker feed generation unit 616 may be configured to render HOA coefficients into a plurality of output audio signals that each correspond to a respective local loudspeaker of the plurality of local loudspeakers. In the example of FIG. 19, loudspeaker feed generation unit 616 may render the HOA coefficients based on local rendering format 622 such that when the resulting loudspeaker feeds 26 are played back through the plurality of local loudspeakers, the acoustic "sweet spot" is located at or near the position of the listener as determined by listener location unit 610. In some examples, loudspeaker feed generation unit 616 may generate loudspeaker feeds 26 in accordance with Equation (35), where $\tilde{C}$ represents loudspeaker feeds 26, H is HOA coefficients 212, and $\tilde{D}^T$ is the transpose of the local rendering matrix.

$$\tilde{C}=H\tilde{D}^T \tag{35}$$

Figure 20:
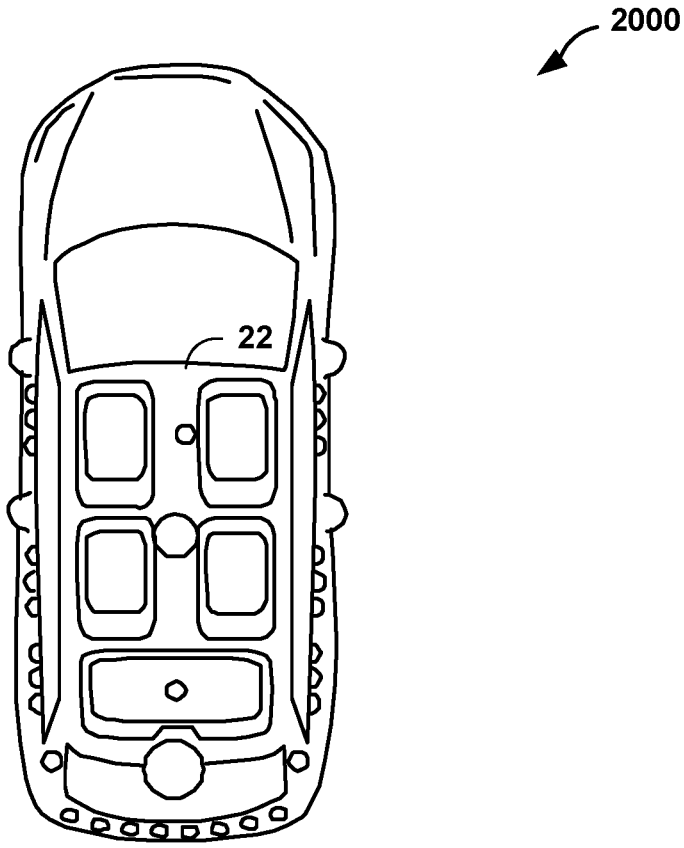
FIG. 20 illustrates an automotive speaker playback environment, in accordance with one or more techniques of this disclosure.

FIG. 20 illustrates an automotive speaker playback environment, in accordance with one or more techniques of this disclosure. As illustrated in FIG. 20, in some examples, audio decoding device 22 may be included in a vehicle, such as car 2000. In some examples, vehicle 2000 may include one or more occupant sensors. Examples of occupant sensors which may be included in vehicle 2000 include, but are not necessarily limited to, seatbelt sensors, and pressure sensors integrated into seats of vehicle 2000.

Figure 21:
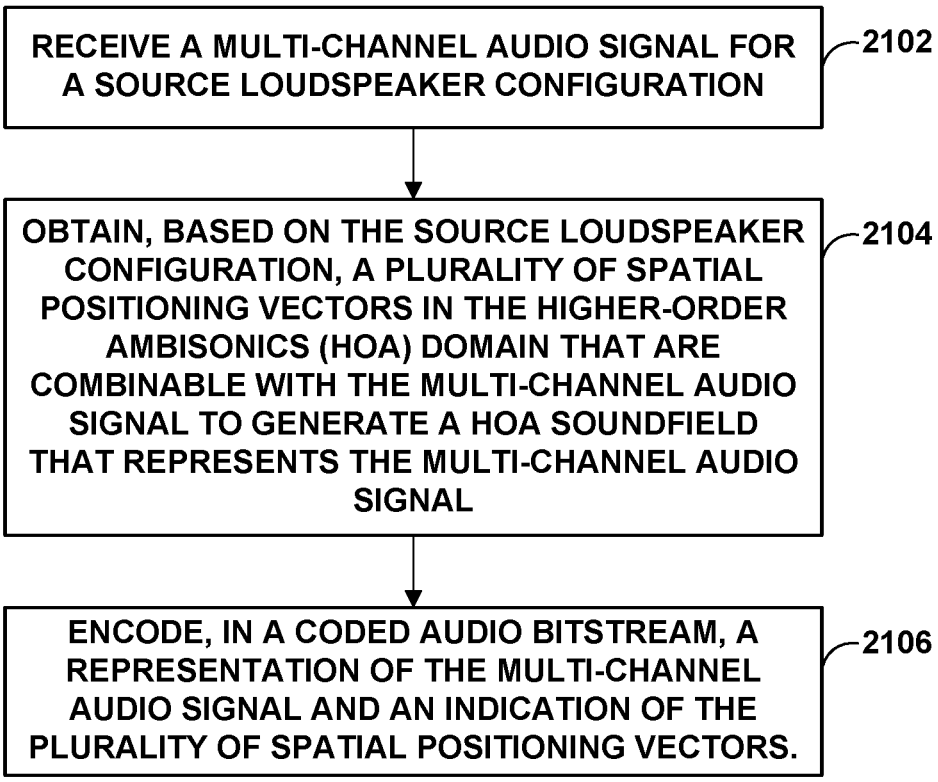
FIG. 21 is a flow diagram illustrating example operations of an audio encoding device, in accordance with one or more techniques of this disclosure.

FIG. 21 is a flow diagram illustrating example operations of an audio encoding device, in accordance with one or more techniques of this disclosure. The techniques of FIG. 21 may be performed by one or more processors of an audio encoding device, such as audio encoding device 14 of FIGS. 1, 3, 5, 13, and 17, though audio encoding devices having configurations other than audio encoding device 14 may perform the techniques of FIG. 21.

In accordance with one or more techniques of this disclosure, audio encoding device 14 may receive a multi-channel audio signal for a source loudspeaker configuration (2102). For instance, audio encoding device 14 may receive six-channels of audio data in the 5.1 surround sound format (e.g., for the source loudspeaker configuration of 5.1). As discussed above, the multi-channel audio signal received by audio encoding device 14 may include live audio data 10 and/or pre-generated audio data 12 of FIG. 1.

Audio encoding device 14 may obtain, based on the source loudspeaker configuration, a plurality of spatial positioning vectors in the higher-order ambisonics (HOA) domain that are combinable with the multi-channel audio signal to generate a HOA soundfield that represents the multi-channel audio signal (2104). In some examples, the plurality of spatial positioning vectors may be combinable with the multi-channel audio signal to generate a HOA soundfield that represents the multi-channel audio signal in accordance with Equation (20), above.

Audio encoding device 14 may encode, in a coded audio bitstream, a representation of the multi-channel audio signal and an indication of the plurality of spatial positioning vectors (2016). As one example, bitstream generation unit 52A of audio encoding device 14A may encode a representation of coded audio data 62 and a representation of loudspeaker position information 48 in bitstream 56A. As another example, bitstream generation unit 52B of audio encoding device 14B may encode a representation of coded audio data 62 and spatial vector representation data 71A in bitstream 56B. As another example, bitstream generation unit 52D of audio encoding device 14D may encode a representation of audio signal 50C and a representation of quantized vector data 554 in bitstream 56D.

Figure 22:
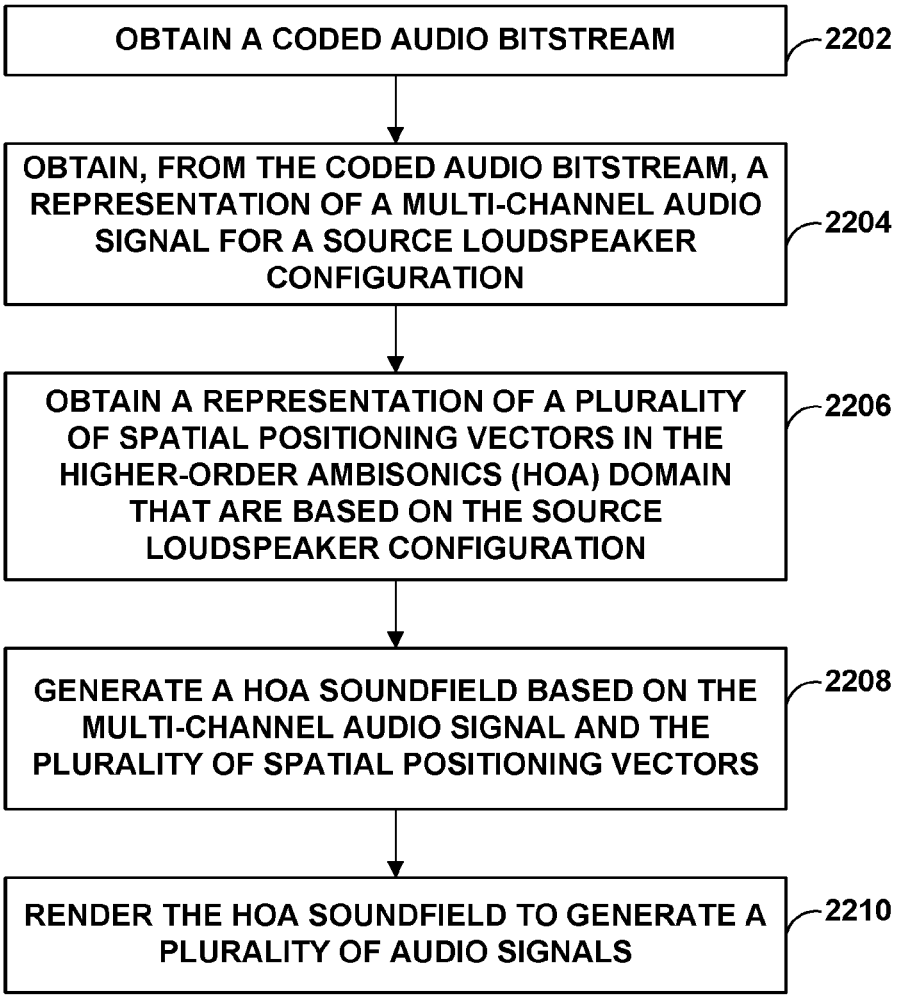
FIG. 22 is a flow diagram illustrating example operations of an audio decoding device, in accordance with one or more techniques of this disclosure.

FIG. 22 is a flow diagram illustrating example operations of an audio decoding device, in accordance with one or more techniques of this disclosure. The techniques of FIG. 22 may be performed by one or more processors of an audio decoding device, such as audio decoding device 22 of FIGS. 1, 4, 10, 16, and 18, though audio encoding devices having configurations other than audio encoding device 14 may perform the techniques of FIG. 22.

In accordance with one or more techniques of this disclosure, audio decoding device 22 may obtain a coded audio bitstream (2202). As one example, audio decoding device 22 may obtain the bitstream over a transmission channel, which may be a wired or wireless channel, a data storage device, or the like. As another example, audio decoding device 22 may obtain the bitstream from a storage medium or a file server.

Audio decoding device 22 may obtain, from the coded audio bitstream, a representation of a multi-channel audio signal for a source loudspeaker configuration (2204). For instance, audio decoding unit 204 may obtain, from the bitstream, six-channels of audio data in the 5.1 surround sound format (i.e., for the source loudspeaker configuration of 5.1).

Audio decoding device 22 may obtain a representation of a plurality of spatial positioning vectors in the higher-order ambisonics (HOA) domain that are based on the source loudspeaker configuration (2206). As one example, vector creating unit 206 of audio decoding device 22A may generate spatial positioning vectors 72 based on source loudspeaker setup information 48. As another example, vector decoding unit 207 of audio decoding device 22B may decode spatial positioning vectors 72, which are based on source loudspeaker setup information 48, from spatial vector representation data 71A. As another example, inverse quantization unit 550 of audio decoding device 22D may inverse quantize quantized vector data 554 to generate spatial positioning vectors 72, which are based on source loudspeaker setup information 48.

Audio decoding device 22 may generate a HOA soundfield based on the multi-channel audio signal and the plurality of spatial positioning vectors (2208). For instance, HOA generation unit 208A may generate HOA coefficients 212A based on multi-channel audio signal 70 and spatial positioning vectors 72 in accordance with Equation (20), above.

Audio decoding device 22 may render the HOA soundfield to generate a plurality of audio signals (2210). For instance, rendering unit 210 (which may or may not be included in audio decoding device 22) may render the set of HOA coefficients to generate a plurality of audio signals based on a local rendering configuration (e.g., a local rendering format). In some examples, rendering unit 210 may render the set of HOA coefficients in accordance with Equation (21), above.

Figure 23:
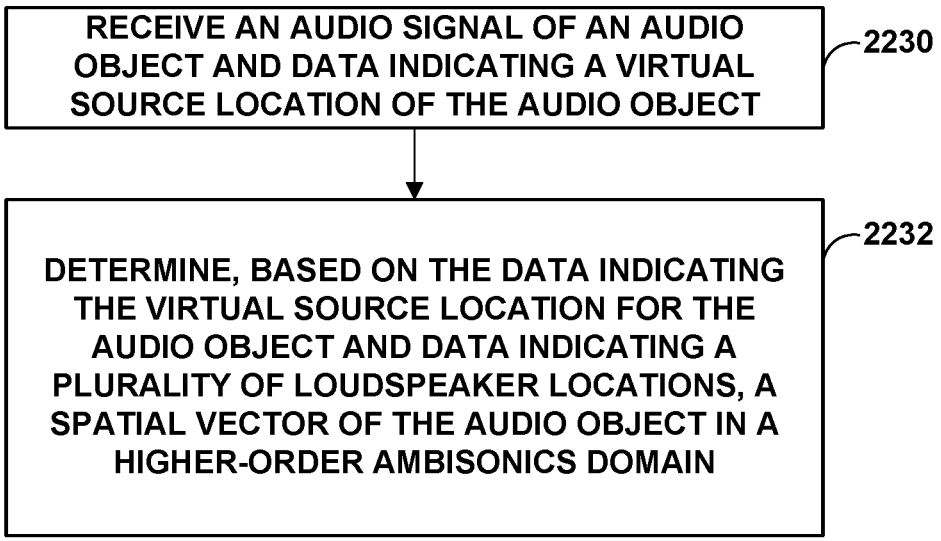
FIG. 23 is a flow diagram illustrating example operations of an audio encoding device, in accordance with one or more techniques of this disclosure.

FIG. 23 is a flow diagram illustrating example operations of an audio encoding device, in accordance with one or more techniques of this disclosure. The techniques of FIG. 23 may be performed by one or more processors of an audio encoding device, such as audio encoding device 14 of FIGS. 1, 3, 5, 13, and 17, though audio encoding devices having configurations other than audio encoding device 14 may perform the techniques of FIG. 23.

In accordance with one or more techniques of this disclosure, audio encoding device 14 may receive an audio signal of an audio object and data indicating a virtual source location of the audio object (2230). Additionally, audio encoding device 14 may determine, based on the data indicating the virtual source location for the audio object and data indicating a plurality of loudspeaker locations, a spatial vector of the audio object in a HOA domain (2232).

Figure 24:
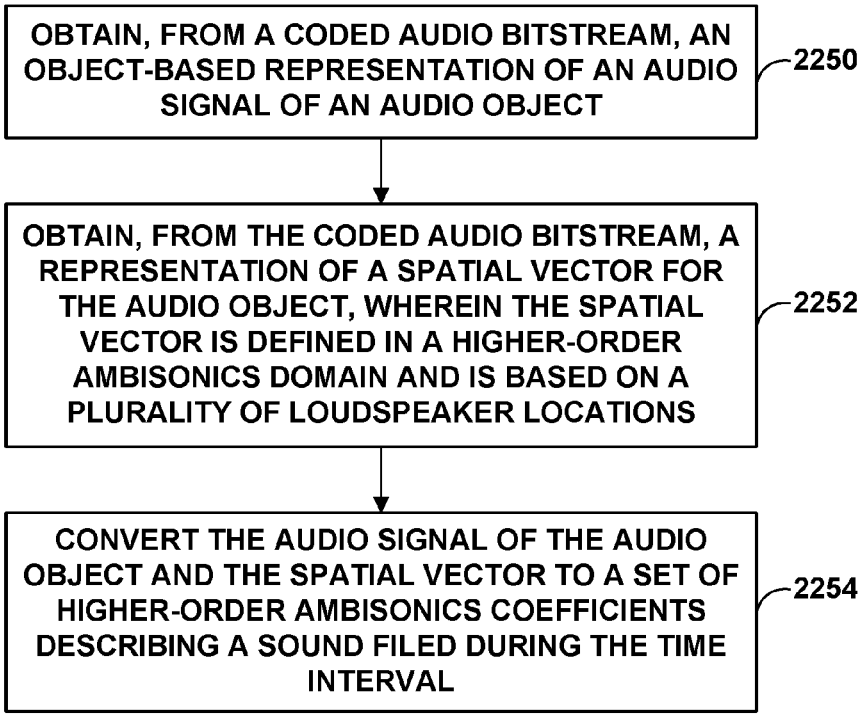
FIG. 24 is a flow diagram illustrating example operations of an audio decoding device, in accordance with one or more techniques of this disclosure.

FIG. 24 is a flow diagram illustrating example operations of an audio decoding device, in accordance with one or more techniques of this disclosure. The techniques of FIG. 24 may be performed by one or more processors of an audio decoding device, such as audio decoding device 22 of FIGS. 1, 4, 10, 16, and 18, though audio encoding devices having configurations other than audio encoding device 14 may perform the techniques of FIG. 24.

In accordance with one or more techniques of this disclosure, audio decoding device 22 may obtain, from a coded audio bitstream, an object-based representation of an audio signal of an audio object (2250). In this example, the audio signal corresponds to a time interval. Additionally, audio decoding device 22 may obtain, from the coded audio bitstream, a representation of a spatial vector for the audio object (2252). In this example, the spatial vector is defined in a HOA domain and is based on a plurality of loudspeaker locations. HOA generation unit 208B (or another unit of audio decoding device 22) may convert the audio signal of the audio object and the spatial vector to a set of HOA coefficients describing a sound field during the time interval (2254).

Figure 25:
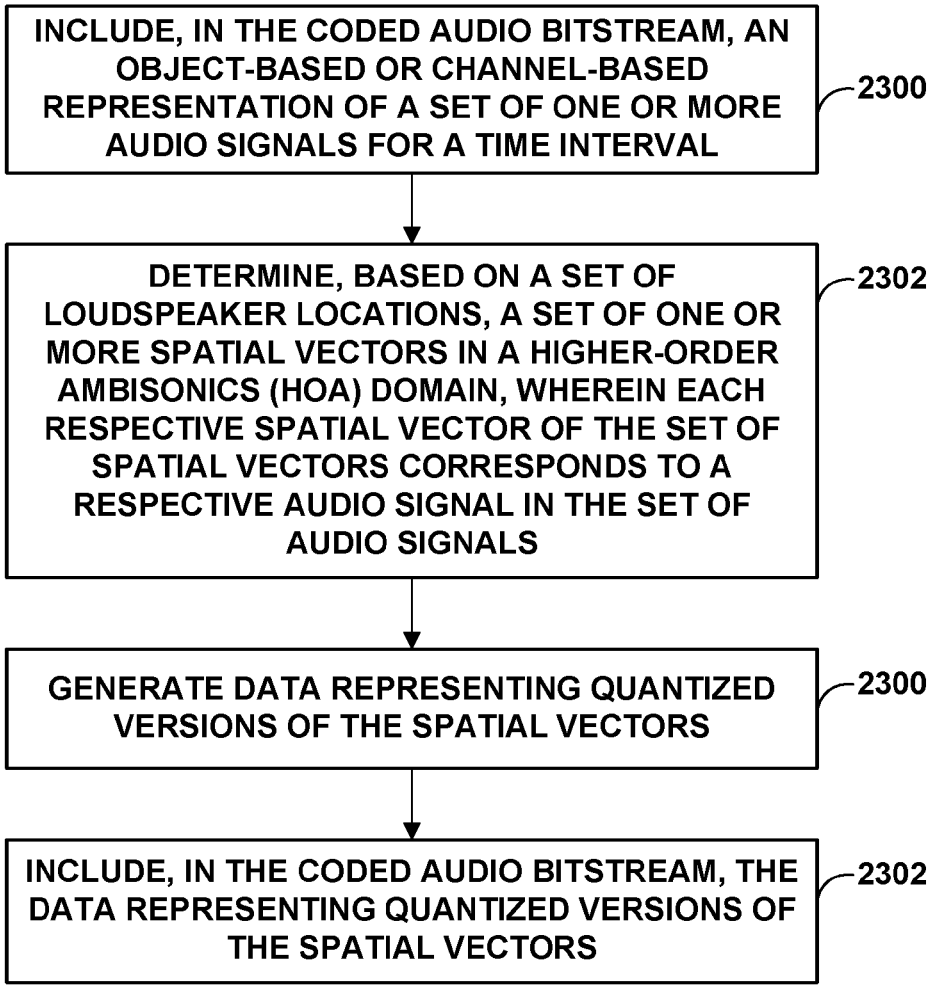
FIG. 25 is a flow diagram illustrating example operations of an audio encoding device, in accordance with one or more techniques of this disclosure.

FIG. 25 is a flow diagram illustrating example operations of an audio encoding device, in accordance with one or more techniques of this disclosure. The techniques of FIG. 25 may be performed by one or more processors of an audio encoding device, such as audio encoding device 14 of FIGS. 1, 3, 5, 13, and 17, though audio encoding devices having configurations other than audio encoding device 14 may perform the techniques of FIG. 25.

In accordance with one or more techniques of this disclosure, audio encoding device 14 may include, in a coded audio bitstream, an object-based or channel-based representation of a set of one or more audio signals for a time interval (2300). Furthermore, audio encoding device 14 may determine, based on a set of loudspeaker locations, a set of one or more spatial vectors in a HOA domain (2302). In this example, each respective spatial vector of the set of spatial vectors corresponds to a respective audio signal in the set of audio signals. Furthermore, in this example, audio encoding device 14 may generate data representing quantized versions of the spatial vectors (2304). Additionally, in this example, audio encoding device 14 may include, in the coded audio bitstream, the data representing quantized versions of the spatial vectors (2306).

Figure 26:
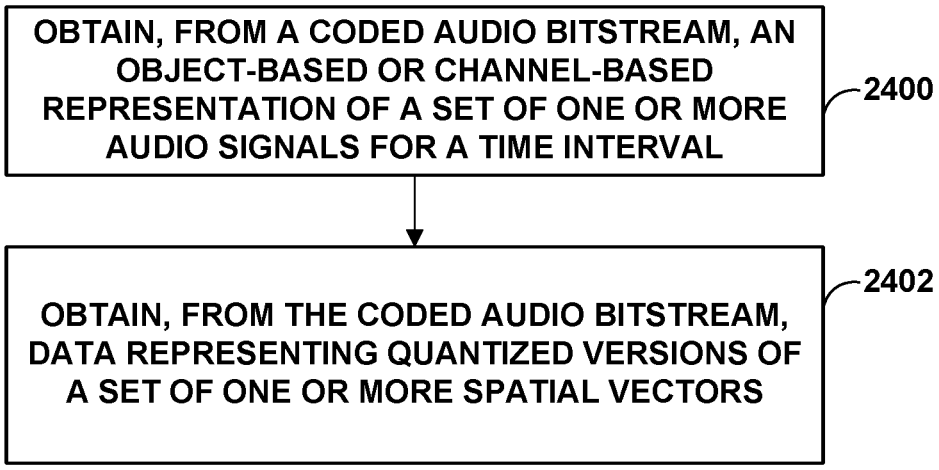
FIG. 26 is a flow diagram illustrating example operations of an audio decoding device, in accordance with one or more techniques of this disclosure.

FIG. 26 is a flow diagram illustrating example operations of an audio decoding device, in accordance with one or more techniques of this disclosure. The techniques of FIG. 26 may be performed by one or more processors of an audio decoding device, such as audio decoding device 22 of FIGS. 1, 4, 10, 16, and 18, though audio decoding devices having configurations other than audio decoding device 22 may perform the techniques of FIG. 26.

In accordance with one or more techniques of this disclosure, audio decoding device 22 may obtain, from a coded audio bitstream, an object-based or channel-based representation of a set of one or more audio signals for a time interval (2400). Additionally, audio decoding device 22 may obtain, from the coded audio bitstream, data representing quantized versions of a set of one or more spatial vectors (2402). In this example, each respective spatial vector of the set of spatial vectors corresponds to a respective audio signal of the set of audio signals. Furthermore, in this example, each of the spatial vectors is in a HOA domain and is computed based on a set of loudspeaker locations.

Figure 27:
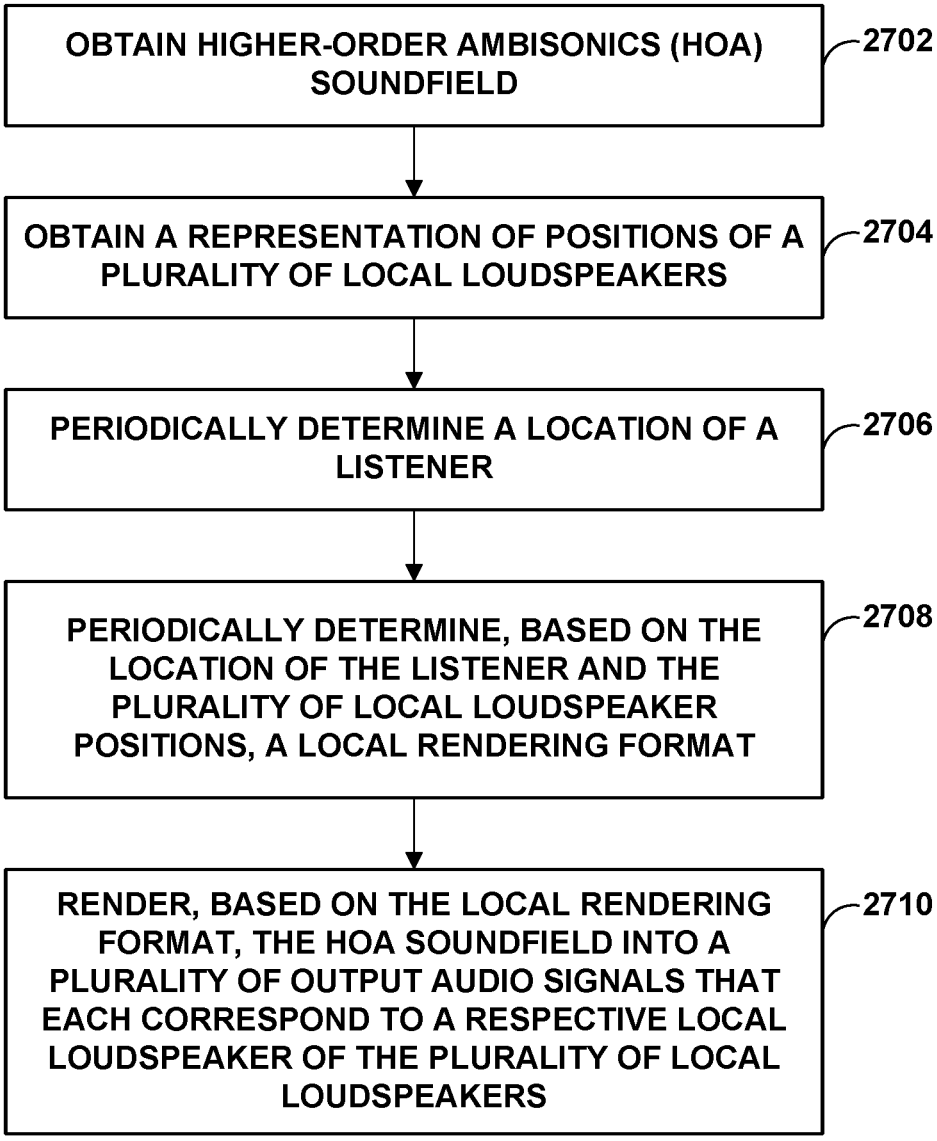
FIG. 27 is a flow diagram illustrating example operations of an audio encoding device, in accordance with one or more techniques of this disclosure.

FIG. 27 is a flow diagram illustrating example operations of an audio decoding device, in accordance with one or more techniques of this disclosure. The techniques of FIG. 27 may be performed by one or more processors of an audio decoding device, such as audio decoding device 22 of FIGS. 1, 4, 10, 16, and 18, though audio decoding devices having configurations other than audio decoding device 22 may perform the techniques of FIG. 27.

In accordance with one or more techniques of this disclosure, audio decoding device 22 may obtain a higher-order ambisonics (HOA) soundfield (2702). For instance, an HOA generation unit of audio decoding device 22 (e.g., HOA generation unit 208A/208B/208C) may provide a set of HOA coefficients (e.g., HOA coefficients 212A/212B/212C) to rendering unit 210 of audio decoding device 22.

Audio decoding device 22 may obtain a representation of positions of a plurality of local loudspeakers (2704). For instance, loudspeaker position unit 612 of rendering unit 210 of audio decoding device 22 may determine the representation of positions of the plurality of local loudspeakers based on local loudspeaker setup information (e.g., local loudspeaker setup information 28). As discussed above, loudspeaker position unit 612 may obtain local loudspeaker setup information 28 from a wide variety of sources.

Audio decoding device 22 may periodically determine a location of a listener (2706). For instance, in some examples, listener location unit 610 of rendering unit 210 of audio decoding device 22 may determine the location of the listener based on a signal generated by a device positioned by the listener. Some example of devices which may be used by listener location unit 610 to determine the location of the listener include, but are not limited to, mobile computing devices, video game controllers, remote controls, or any other device that may indicate a position of a listener. In some examples, listener location unit 610 may determine the location of the listener based on one or more sensors. Some example of sensors which may be used by listener location unit 610 to determine the location of the listener include, but are not limited to, cameras, microphones, pressure sensors (e.g., embedded in or attached to furniture, vehicle seats), seatbelt sensors, or any other sensor that may indicate a position of a listener.

Audio decoding device 22 may periodically determine, based on the location of the listener and the plurality of local loudspeaker positions, a local rendering format (2708). For instance, rendering format unit 614 of rendering unit 210 of audio decoding device 22 may generate the local rendering format such that, when the HOA soundfield is rendered into loudspeaker feeds and played back through the plurality of local loudspeakers, the acoustic "sweet spot" is located at or near the position of the listener. In some examples, to generate the local rendering format, rendering configuration unit 614 may generate a local rendering matrix $\tilde{D}$.

Audio decoding device 22 may render, based on the local rendering format, the HOA soundfield into a plurality of output audio signals that each correspond to a respective local loudspeaker of the plurality of local loudspeakers (2710). For instance, loudspeaker feed generation unit 616 may render HOA coefficients generate loudspeaker feeds 26 in accordance with Equation (35) above.

In one example, to encode a multi-channel audio signal (e.g., $\{C_i\}_{i=1, \ldots, N}$), audio encoding device 14 may determine a number of loudspeakers in a source loudspeaker configuration (e.g., N), a number of HOA coefficients (e.g., $N_{HOA}$) to be used when generating an HOA soundfield based on the multi-channel audio signal, and positions of loudspeakers in the source loudspeaker configuration (e.g., $\{\theta_i, \phi_i\}_{i=1, \ldots, N}$). In this example, audio encoding device 14 may encode N, $N_{HOA}$, and $\{\theta_i,\phi_i\}_{i=1, \ldots, N}$ in a bitstream. In some examples, audio encoding device 14 may encode N, $N_{HOA}$, and $\{\theta_i,\phi_i\}_{i=1, \ldots, N}$ in the bitstream for each frame. In some examples, if a previous frame uses the same N, $N_{HOA}$, and $\{\theta_i,\phi_i\}_{i=1, \ldots, N}$, audio encoding device 14 may omit encoding N, $N_{HOA}$, and $\{\theta_i,\phi_i\}_{i=1, \ldots, N}$ in the bitstream for a current frame. In some examples, audio encoding device 14 may generate rendering matrix $D_1$ based on N, $N_{HOA}$, and $\{\theta_i,\phi_i\}_{i=1, \ldots, N}$. In some examples, if needed, audio encoding device 14 may generate and use one or more spatial positioning vectors (e.g., $V_i=[[0, \ldots, 0, 1, 0, \ldots, 0](D_1D_1^T)^{-1}D_1]^T$). In some examples, audio encoding device 14 may quantize the multi-channel audio signal (e.g., $\{C_i\}_{i=1, \ldots, N}$), to generate a quantized multi-channel audio signal (e.g., $\{\hat{C}_i\}_{i=1, \ldots, N}$), and encode the quantized multi-channel audio signal in the bitstream.

Audio decoding device 22 may receive the bitstream. Based on the received number of loudspeakers in the source loudspeaker configuration (e.g., N), number of HOA coefficients (e.g., $N_{HOA}$) to be used when generating an HOA soundfield based on the multi-channel audio signal, and positions of loudspeakers in the source loudspeaker configuration (e.g., $\{\theta_i,\phi_i\}_{i=1, \ldots, N}$), audio decoding device 22 may generate a rendering matrix $D_2$. In some examples, $D_2$ may not be the same as $D_1$, so long as $D_2$ is generated based on the received N, $N_{HOA}$, and $\{\theta_i,\phi_i\}_{i=1, \ldots, N}$ (i.e., the source loudspeaker configuration). Based on $D_2$, audio decoding device 22 may calculate one or more spatial positioning vectors (e.g., $\check{V}=[[0, \ldots, 0, 1, 0, \ldots, 0](D_2D_2^T)^{-1}D_2]^T$). Based on the one or more spatial positioning vectors and the received audio signal (e.g., audio decoding device 22 may generate an HOA domain representation as $H=\Sigma_{i=1}^{N}\hat{C}_1\check{V}_i^T$. Based on the local loudspeaker configuration (i.e., the number and positions of loudspeakers at the decoder) (e.g., $\hat{N}$, and $\{\hat{\theta}_i, \hat{\phi}_i\}_{i=1, \ldots, \hat{N}}$), audio decoding device 22 may generate a local rendering matrix $D_3$. Audio decoding device 22 may generate speaker feeds for the local loudspeakers (e.g., $\hat{C}$) by multiplying the local rendering matrix by the generated HOA domain representation (e.g., $\hat{C}=HD_3$).

In another example, to encode a multi-channel audio signal (e.g., $\{C_i\}_{i=1, \ldots, N}$), audio encoding device 14 may determine a number of loudspeakers in a source loudspeaker configuration (e.g., N), a number of HOA coefficients (e.g., $N_{HOA}$) to be used when generating an HOA soundfield based on the multi-channel audio signal, and positions of loudspeakers in the source loudspeaker configuration (e.g., $\{\theta_i, \phi_i\}_{i=1, \ldots, N}$) In some examples, audio encoding device 14 may generate rendering matrix $D_1$ based on N, $N_{HOA}$, and $\{\theta_i,\phi_i\}_{i=1, \ldots, N}$. In some examples, audio encoding device 14 may calculate one or more spatial positioning vectors (e.g., $V_L=[[0, \ldots, 0, 1, 0, \ldots, 0](D_1D_1^T)^{-1}D_1]^T$). In some examples, audio encoding device 14 may normalize the spatial positioning vectors as $\overline{V}_i=V_i/\|V_i\|$, and quantize $\overline{V}_i$ to $\hat{V}_i$ (e.g., using vector quantization methods such as (SQ, SQ+Huff, VQ) in ISO/IEC 23008-3, and encode $\hat{V}_i$ and $\|V_i\|$ in a bitstream. In some examples, audio encoding device 14 may quantize the multi-channel audio signal (e.g., $\{C_i\}_{i=1, \ldots, N}$), to generate a quantized multi-channel audio signal (e.g., $\{\hat{C}_i\}_{i=1, \ldots, N}$), and encode the quantized multi-channel audio signal in the bitstream.

Audio decoding device 22 may receive the bitstream. Based on $\hat{V}_i$ and $\|V_i\|$, audio decoding device 22 may reconstruct the spatial positioning vectors by $\check{V}_i=\hat{V}_i*\|\|V_i\|$. Based on the one or more spatial positioning vectors (e.g., $\check{V}_i$) and the received audio signal (e.g., $\{\hat{C}_i\}_{i=1, \ldots, N}$), audio decoding device 22 may generate an HOA domain representation as $H=\Sigma_{i=1}^{N}\hat{C}_i\check{V}_i^T$. Based on the local loudspeaker configuration (i.e., the number and positions of loudspeakers at the decoder) (e.g., $\hat{N}$, and $\{\hat{\theta}_i, \hat{\phi}_i\}_{i=1, \ldots, \hat{N}}$), audio decoding device 22 may generate a local rendering matrix $D_3$. Audio decoding device 22 may generate speaker feeds for the local loudspeakers (e.g., $\hat{C}$) by multiplying the local rendering matrix by the generated HOA domain representation (e.g., $\hat{C}=HD_3$).

Figure 28:
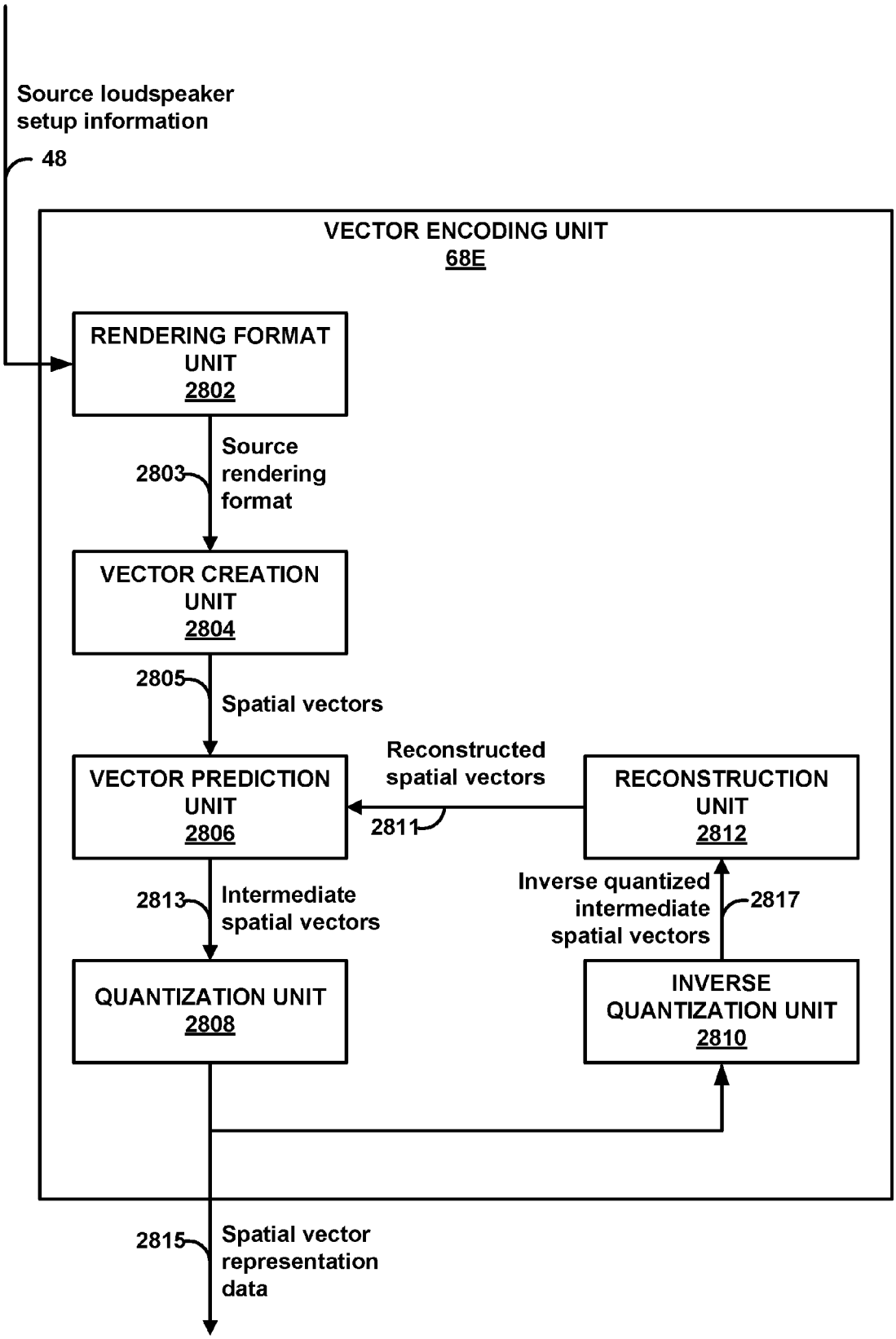
FIG. 28 is a block diagram illustrating an example vector encoding unit, in accordance with a technique of this disclosure.

FIG. 28 is a block diagram illustrating an example vector encoding unit 68E, in accordance with a technique of this disclosure. Vector encoding unit 68E may an instance of vector encoding unit 68 of FIG. 5. In the example of FIG. 28, vector encoding unit 68E includes a rendering format unit, a vector creation unit 2804, a vector prediction unit 2806, a representation unit 2808, an inverse quantization unit 2810, and a reconstruction unit 2812.

Rendering format unit 2802 uses source loudspeaker setup information 48 to determine a source rendering format 2803. Source rendering format 116 may be a rendering matrix for rendering a set of HOA coefficients into a set of loudspeaker feeds for loudspeakers arranged in a manner described by source loudspeaker setup information 48. Rendering format unit 2802 may determine source rendering format 2803 in accordance with examples described elsewhere in this disclosure.

Vector creation unit 2804 may determine, based on source rendering format 116, a set of spatial vectors 2805. In some examples, vector creation unit 2804 determines spatial vectors 2805 in the manner described elsewhere in this disclosure with respect to vector creation unit 112 of FIG. 6. In some examples, vector creation unit 2804 determines spatial vectors 2805 in the manner described with regard to intermediate vector unit 402 and vector finalization unit 404 of FIG. 14.

In the example of FIG. 28, vector prediction unit 2806 may obtain reconstructed spatial vectors 2811 from reconstruction unit 2812. Vector prediction unit 2806 may determine, based on reconstructed spatial vectors 2811, intermediate spatial vectors 2813. In some examples, vector prediction unit 2806 may determine intermediate spatial vectors 2806 such that, for each respective spatial vector of spatial vectors 2805, a respective intermediate spatial vector of intermediate spatial vectors 2806 is equivalent to or based on a difference between the respective spatial vector and a corresponding reconstructed spatial vector of reconstructed spatial vectors 2811. Corresponding spatial vectors and reconstructed spatial vectors may correspond to the same loudspeaker of the source loudspeaker setup.

Quantization unit 2808 may quantize intermediate spatial vectors 2813. Quantization unit 2808 may quantize intermediate spatial vectors 2813 in accordance with quantization techniques described elsewhere in this disclosure. Quantization unit 2808 outputs spatial vector representation data 2815. Spatial vector representation data 2815 may comprise data representing quantized versions of spatial vectors 2805. More specifically, in the example of FIG. 28, spatial vector representation data 2815 may comprise data representing the quantized versions of intermediate spatial vectors 2813. In some examples, using techniques similar to those described elsewhere in this disclosure with respect to codebooks, the data representing the quantized versions of intermediate spatial vectors 2813 comprises code book indexes that indicate entries in dynamically- or statically-defined codebooks that specify values of quantized versions of intermediate spatial vectors. In some examples, spatial vector representation data 2815 comprises the quantized versions of intermediate spatial vectors 2813.

Furthermore, in the example of FIG. 28, inverse quantization unit 2810 may obtain spatial vector representation data 2815. In other words, inverse quantization unit 2810 may obtain data representing quantized versions of spatial vectors 2805. More specifically, in the example of FIG. 28, inverse quantization unit 2810 may obtain data representing quantized versions of intermediate spatial vectors 2813. Inverse quantization unit 2810 may inverse quantize the quantized versions of intermediate spatial vectors 2813. Thus, inverse quantization unit 2810 may generate inverse quantized intermediate spatial vectors 2817. Inverse quantization unit 2810 may inverse quantize the quantized versions of intermediate spatial vectors 2813 in accordance with examples described elsewhere in this disclosure for inverse quantizing spatial vectors. Because quantization may involve loss of information, inverse quantized intermediate spatial vectors 2817 may not be exactly the same as intermediate spatial vectors 2813.

Additionally, reconstruction unit 2813 may generate, based on inverse quantized intermediate spatial vectors 2817, a set of reconstructed spatial vectors. In some examples, reconstruction unit 2813 may generate the set of reconstructed spatial vectors such that, for each respective inverse quantized spatial vector of the set of inverse quantized spatial vectors 2817, a respective reconstructed spatial vector is equivalent to a sum of the respective inverse quantized spatial vector and a corresponding reconstructed spatial vector for a previous time interval in decoding order. Vector prediction unit 2806 may use the reconstructed spatial vectors for generating intermediate spatial vectors for a subsequent time interval.

Thus, in the example of FIG. 28, inverse quantization unit 2810 may obtain data representing quantized versions of a first set of one or more spatial vectors. Each respective spatial vector of the first set of spatial vectors corresponds to a respective audio signal of a set of audio signals for a first time interval. Each of the spatial vectors in the first set of spatial vectors is in the HOA domain and is computed based on a set of loudspeaker locations. Furthermore, inverse quantization unit 2810 may inverse quantize the quantized versions of the first set of spatial vectors. Additionally, in this example, vector creation unit 2804 may determine a second set of spatial vectors. Each respective spatial vector of the second set of spatial vectors corresponds to a respective audio signal of a set of audio signals for a second time interval subsequent to the first time interval in decoding order. Each spatial vector of the second set of spatial vectors is in the HOA domain and is computed based on the set of loudspeaker locations. Vector prediction unit 2806 may determine, based on the inverse quantized first set of spatial vectors, intermediate versions of spatial vectors in the second set of spatial vectors. Quantization unit 2808 may quantize the intermediate versions of the spatial vectors in the second set of spatial vectors. The audio encoding device may include, in the coded audio bitstream, data representing the quantized versions of the intermediate versions of the spatial vectors in the second set of spatial vectors.

The following numbered exampled may illustrate one or more aspects of the disclosure:

Example 1

A device for decoding a coded audio bitstream, the device comprising: a memory configured to store a coded audio bitstream; and one or more processors electrically coupled to the memory, the one or more processors configured to: obtain, from the coded audio bitstream, a representation of a multi-channel audio signal for a source loudspeaker configuration; obtain, in a Higher-Order Ambisonics (HOA) domain, a representation of a plurality of spatial positioning vectors that are based on a source rendering matrix, which is based on the source loudspeaker configuration; generate a HOA soundfield based on the multi-channel audio signal and the plurality of spatial positioning vectors; and render the HOA soundfield to generate a plurality of audio signals based on a local loudspeaker configuration that represents positions of a plurality of local loudspeakers, wherein each respective audio signal of the plurality of audio signals corresponds to a respective loudspeaker of the plurality of local loudspeakers.

Example 2

The device of example 1, wherein the one or more processors are further configured to: obtain, from the coded audio bitstream, an indication of the source loudspeaker configuration; generate, based on the indication, the source rendering matrix, wherein, to obtain the representation of the plurality of spatial positioning vectors in the HOA domain, the one or more processors are configured to generate, based on the source rendering matrix, the spatial positioning vectors.

Example 3

The device of example 1, wherein the one or more processors are configured to obtain the representation of the plurality of spatial positioning vectors in the HOA domain from the coded audio bitstream.

Example 4

The device of any combination of examples 1-3, wherein, to generate the HOA soundfield based on the multi-channel audio signal and the plurality of spatial positioning vectors, the one or more processors are configured to generate a set of HOA coefficients based on the multi-channel audio signal and the plurality of spatial positioning vectors.

Example 5

The device of example 4, wherein the one or more processors are configured to generate the set of HOA coefficients in accordance with the following equation: $H=\Sigma_{i=1}^{N}C_iSP_i$ where His the set of HOA coefficients, $C_i$ is an ith channel of the multi-channel audio signal, and $SP_i$ is a spatial position vector of the plurality of spatial positioning vectors that corresponds to the ith channel of the multi-channel audio signal.

Example 6

The device of any combination of examples 1-5, wherein each spatial positioning vector of the plurality of spatial positioning vectors corresponds to a channel included in the multi-channel audio signal, wherein the spatial positioning vector of the plurality of spatial positioning vectors that corresponds to an Nth channel is equivalent to a transpose of a matrix resulting from a multiplication of a first matrix, a second matrix, and the source rendering matrix, the first matrix consisting of a single respective row of elements equivalent in number of the number of loudspeaker in the source loudspeaker configuration, the Nth element of the respective row of elements being equivalent to one and elements other than the Nth element of the respective row being equivalent to 0, the second matrix being an inverse of a matrix resulting from a multiplication of the source rendering matrix and the transpose of the source rendering matrix.

Example 7

The device of any combination of examples 1-6, wherein the one or more processors are included in an audio system of vehicle.

Example 8

A device for encoding audio data, the device comprising: one or more processors configured to: receive a multi-channel audio signal for a source loudspeaker configuration; obtain a source rendering matrix that is based on the source loudspeaker configuration; obtain, based on the source rendering matrix, a plurality of spatial positioning vectors, in a Higher-Order Ambisonics (HOA) domain, that, in combination with the multi-channel audio signal, represent an HOA soundfield that corresponds the multi-channel audio signal; and encode, in a coded audio bitstream, a representation of the multi-channel audio signal and an indication of the plurality of spatial positioning vectors; and a memory, electrically coupled to the one or more processors, configured to store the coded audio bitstream.

Example 9

The device of example 8, wherein, to encode the indication of the plurality of spatial positioning vectors, the one or more processors are configured to: encode an indication of the source loudspeaker configuration.

Example 10

The device of example 8, wherein, to encode the indication of the plurality of spatial positioning vectors, the one or more processors are configured to: encode quantized values of the spatial positioning vectors.

Example 11

The device of any combination of examples 8-10, wherein the representation of the multi-channel audio signal is a non-compressed version of the multi-channel audio signal.

Example 12

The device of any combination of examples 8-10, wherein the representation of the multi-channel audio signal is a non-compressed pulse-code modulation (PCM) version of the multi-channel audio signal.

Example 13

The device of any combination of examples 8-10, wherein the representation of the multi-channel audio signal is a compressed version of the multi-channel audio signal.

Example 14

The device of any combination of examples 8-10, wherein the representation of the multi-channel audio signal is a compressed pulse-code modulation (PCM) version of the multi-channel audio signal.

Example 15

The device of any combination of examples 8-14, wherein each spatial positioning vector of the plurality of spatial positioning vectors corresponds to a channel included in the multi-channel audio signal, wherein the spatial positioning vector of the plurality of spatial positioning vectors that corresponds to an Nth channel is equivalent to a transpose of a matrix resulting from a multiplication of a first matrix, a second matrix, and the source rendering matrix, the first matrix consisting of a single respective row of elements equivalent in number of the number of loudspeaker in the source loudspeaker configuration, the Nth element of the respective row of elements being equivalent to one and elements other than the Nth element of the respective row being equivalent to 0, the second matrix being an inverse of a matrix resulting from a multiplication of the source rendering matrix and the transpose of the source rendering matrix.

Example 16

A method for decoding a coded audio bitstream, the method comprising: obtaining, from a coded audio bitstream, a representation of a multi-channel audio signal for a source loudspeaker configuration; obtaining, in a Higher-Order Ambisonics (HOA) domain, a representation of a plurality of spatial positioning vectors that are based on a source rendering matrix, which is based on the source loudspeaker configuration; generating a HOA soundfield based on the multi-channel audio signal and the plurality of spatial positioning vectors; and rendering the HOA soundfield to generate a plurality of audio signals based on a local loudspeaker configuration that represents positions of a plurality of local loudspeakers, wherein each respective audio signal of the plurality of audio signals corresponds to a respective loudspeaker of the plurality of local loudspeakers.

Example 17

The method of example 16, further comprising: obtaining, from the coded audio bitstream, an indication of the source loudspeaker configuration; and generating, based on the indication, the source rendering matrix, wherein obtaining the representation of the plurality of spatial positioning vectors in the HOA domain, comprises generating, based on the source rendering matrix, the spatial positioning vectors.

Example 18

The method of example 16, wherein obtaining the representation of the plurality of spatial positioning vectors comprises obtaining, from the coded audio bitstream, the representation of the plurality of spatial positioning vectors in the HOA domain.

Example 19

The method of any combination of examples 16-18, wherein generating the HOA soundfield based on the multi-channel audio signal and the plurality of spatial positioning vectors comprises: generating a set of HOA coefficients based on the multi-channel audio signal and the plurality of spatial positioning vectors.

Example 20

The method of any combination of examples 16-19, wherein generating the set of HOA coefficients comprises generating the set of HOA coefficients in accordance with the following equation: $H=\Sigma_{i=1}^{N}C_iSP_i$ where H is the set of HOA coefficients, $C_i$ is an ith channel of the multi-channel audio signal, and $SP_i$ is a spatial position vector of the plurality of spatial positioning vectors that corresponds to the ith channel of the multi-channel audio signal.

Example 21

A method for encoding a coded audio bitstream, the method comprising: receiving a multi-channel audio signal for a source loudspeaker configuration; obtaining a source rendering matrix that is based on the source loudspeaker configuration; obtaining, based on the source rendering matrix, a plurality of spatial positioning vectors, in a Higher-Order Ambisonics (HOA) domain, that, in combination with the multi-channel audio signal, represent an HOA soundfield that corresponds to the multi-channel audio signal; and encoding, in a coded audio bitstream, a representation of the multi-channel audio signal and an indication of the plurality of spatial positioning vectors.

Example 22

The method of example 21, wherein encoding the indication of the plurality of spatial positioning vectors comprises: encoding an indication of the source loudspeaker configuration.

Example 23

The method of example 21, wherein encoding the indication of the plurality of spatial positioning vectors comprises: encoding quantized values of the spatial positioning vectors.

Example 24

A computer-readable storage medium storing instructions that, when executed, cause one or more processors of an audio encoding or audio decoding device to perform the method of any combination of examples 16-22.

Example 25

An audio encoding or audio decoding device comprising means for performing the method of any combination of examples 16-22.

In each of the various instances described above, it should be understood that the audio encoding device 14 may perform a method or otherwise comprise means to perform each step of the method for which the audio encoding device 14 is configured to perform. In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio encoding device 14 has been configured to perform.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media. Data storage media may be any available media that can be accessed by one or more computers or one or more processors to retrieve instructions, code, and/or data structures for implementation of the techniques described in this disclosure. A computer program product may include a computer-readable medium.

Likewise, in each of the various instances described above, it should be understood that the audio decoding device 22 may perform a method or otherwise comprise means to perform each step of the method for which the audio decoding device 22 is configured to perform. In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio decoding device 24 has been configured to perform.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. It should be understood, however, that computer-readable storage media and data storage media do not include connections, carrier waves, signals, or other transitory media, but are instead directed to non-transitory, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware.

Various aspects of the techniques have been described. These and other aspects of the techniques are within the scope of the following claims.

The invention claimed is:

1. A device for decoding a coded audio bitstream, the device comprising:

a memory configured to store a coded audio bitstream; and one or more processors electrically coupled to the memory, the one or more processors configured to:

obtain, from the coded audio bitstream, a representation of a multi-channel audio signal for a source loudspeaker configuration;

obtain, from the coded audio bitstream, an indication of the source loudspeaker configuration;

generate, based on the indication, a source rendering matrix;

generate, based on the source rendering matrix and in a Higher-Order Ambisonics (HOA) domain, a plurality of spatial positioning vectors;

generate a HOA soundfield based on the multi-channel audio signal and the plurality of spatial positioning vectors; and render the HOA soundfield to generate a plurality of audio signals based on a local loudspeaker configuration that represents positions of a plurality of local loudspeakers, wherein each respective audio signal of the plurality of audio signals corresponds to a respective loudspeaker of the plurality of local loudspeakers.

2. The device of claim 1, wherein, to generate the HOA soundfield based on the multi-channel audio signal and the plurality of spatial positioning vectors, the one or more processors are configured to generate a set of HOA coefficients based on the multi-channel audio signal and the plurality of spatial positioning vectors.

3. The device of claim 2, wherein the one or more processors are configured to generate the set of HOA coefficients in accordance with the following equation:

$$H = \sum_{i=1}^{N} C_i SP_i$$

where H is the set of HOA coefficients, $C_i$ is an ith channel of the multi-channel audio signal, and $SP_i$ is a spatial position vector of the plurality of spatial positioning vectors that corresponds to the ith channel of the multi-channel audio signal.

4. The device of claim 1, wherein each spatial positioning vector of the plurality of spatial positioning vectors corresponds to a channel included in the multi-channel audio signal, wherein the spatial positioning vector of the plurality of spatial positioning vectors that corresponds to an Nth channel is equivalent to a transpose of a matrix resulting from a multiplication of a first matrix, a second matrix, and the source rendering matrix, the first matrix consisting of a single respective row of elements equivalent in number of the number of loudspeaker in the source loudspeaker configuration, the Nth element of the respective row of elements being equivalent to one and elements other than the Nth element of the respective row being equivalent to 0, the second matrix being an inverse of a matrix resulting from a multiplication of the source rendering matrix and the transpose of the source rendering matrix.

5. The device of claim 1, wherein the one or more processors are included in an audio system of vehicle that includes the plurality of local loudspeakers.

6. The device of claim 1, further comprising:

one or more of the plurality of local loudspeakers.

7. A device for encoding audio data, the device comprising:

one or more processors configured to:

receive a multi-channel audio signal for a source loudspeaker configuration;

obtain a source rendering matrix that is based on the source loudspeaker configuration;

obtain, based on the source rendering matrix, a plurality of spatial positioning vectors, in a Higher-Order Ambisonics (HOA) domain, that, in combination with the multi-channel audio signal, represent an HOA soundfield that corresponds the multi-channel audio signal; and encode, in a coded audio bitstream, a representation of the multi-channel audio signal and an indication of the plurality of spatial positioning vectors; and a memory, electrically coupled to the one or more processors, configured to store the coded audio bitstream.

8. The device of claim 7, wherein, to encode the indication of the plurality of spatial positioning vectors, the one or more processors are configured to:

encode an indication of the source loudspeaker configuration.

9. The device of claim 7, wherein, to encode the indication of the plurality of spatial positioning vectors, the one or more processors are configured to:

encode quantized values of the spatial positioning vectors.

10. The device of claim 7, wherein the representation of the multi-channel audio signal is a non-compressed version of the multi-channel audio signal.

11. The device of claim 7, wherein the representation of the multi-channel audio signal is a non-compressed pulse-code modulation (PCM) version of the multi-channel audio signal.

12. The device of claim 7, wherein the representation of the multi-channel audio signal is a compressed version of the multi-channel audio signal.

13. The device of claim 7, wherein the representation of the multi-channel audio signal is a compressed pulse-code modulation (PCM) version of the multi-channel audio signal.

14. The device of claim 7, wherein each spatial positioning vector of the plurality of spatial positioning vectors corresponds to a channel included in the multi-channel audio signal, wherein the spatial positioning vector of the plurality of spatial positioning vectors that corresponds to an Nth channel is equivalent to a transpose of a matrix resulting from a multiplication of a first matrix, a second matrix, and the source rendering matrix, the first matrix consisting of a single respective row of elements equivalent in number of the number of loudspeaker in the source loudspeaker configuration, the Nth element of the respective row of elements being equivalent to one and elements other than the Nth element of the respective row being equivalent to 0, the second matrix being an inverse of a matrix resulting from a multiplication of the source rendering matrix and the transpose of the source rendering matrix.

15. The device of claim 7, further comprising:

one or more microphones configured to capture the multi-channel audio signal.

16. A method for decoding a coded audio bitstream, the method comprising:

obtaining, from a coded audio bitstream, a representation of a multi-channel audio signal for a source loudspeaker configuration;

obtaining, from the coded audio bitstream, an indication of the source loudspeaker configuration;

generating, based on the indication, the source rendering matrix;

generating, based on the source rendering matrix and in a Higher-Order Ambisonics (HOA) domain, a plurality of spatial positioning vectors;

generating a HOA soundfield based on the multi-channel audio signal and the plurality of spatial positioning vectors; and rendering the HOA soundfield to generate a plurality of audio signals based on a local loudspeaker configuration that represents positions of a plurality of local loudspeakers, wherein each respective audio signal of the plurality of audio signals corresponds to a respective loudspeaker of the plurality of local loudspeakers.

17. The method of claim 16, wherein generating the HOA soundfield based on the multi-channel audio signal and the plurality of spatial positioning vectors comprises:

generating a set of HOA coefficients based on the multi-channel audio signal and the plurality of spatial positioning vectors.

18. The method of claim 17, wherein generating the set of HOA coefficients comprises generating the set of HOA coefficients in accordance with the following equation:

$$H = \sum_{i=1}^{N} C_i SP_i$$

where H is the set of HOA coefficients, $C_i$ is an ith channel of the multi-channel audio signal, and $SP_i$ is a spatial position vector of the plurality of spatial positioning vectors that corresponds to the ith channel of the multi-channel audio signal.

19. A method for encoding a coded audio bitstream, the method comprising:

receiving a multi-channel audio signal for a source loudspeaker configuration;

obtaining a source rendering matrix that is based on the source loudspeaker configuration;

obtaining, based on the source rendering matrix, a plurality of spatial positioning vectors, in a Higher-Order Ambisonics (HOA) domain, that, in combination with the multi-channel audio signal, represent an HOA soundfield that corresponds to the multi-channel audio signal; and encoding, in a coded audio bitstream, a representation of the multi-channel audio signal and an indication of the plurality of spatial positioning vectors.

20. The method of claim 19, wherein encoding the indication of the plurality of spatial positioning vectors comprises:

encoding an indication of the source loudspeaker configuration.

21. The method of claim 19, wherein encoding the indication of the plurality of spatial positioning vectors comprises:

encoding quantized values of the spatial positioning vectors.

* * * * *